US007299190B2

(12) United States Patent
Thumpudi et al.

(10) Patent No.: US 7,299,190 B2
(45) Date of Patent: Nov. 20, 2007

(54) QUANTIZATION AND INVERSE QUANTIZATION FOR AUDIO

(75) Inventors: Naveen Thumpudi, Sammamish, WA (US); Wei-Ge Chen, Issaquah, WA (US)

(73) Assignee: Microsoft Corporation, Redmond, WA (US)

( * ) Notice: Subject to any disclaimer, the term of this patent is extended or adjusted under 35 U.S.C. 154(b) by 909 days.

(21) Appl. No.: 10/642,551

(22) Filed: Aug. 15, 2003

(65) Prior Publication Data

US 2004/0044527 A1 Mar. 4, 2004

Related U.S. Application Data

(60) Provisional application No. 60/408,538, filed on Sep. 4, 2002, provisional application No. 60/408,517, filed on Sep. 4, 2002, provisional application No. 60/408,432, filed on Sep. 4, 2002.

(51) Int. Cl.
*G10L 19/00* (2006.01)
*G10L 21/00* (2006.01)

(52) U.S. Cl. ..... 704/500; 704/200.1

(58) Field of Classification Search ..... 704/200.1, 704/500

See application file for complete search history.

(56) References Cited

U.S. PATENT DOCUMENTS 5,079,547 A 1/1992 Fuchigama et al.
5,260,980 A 11/1993 Akagiri et al.
5,388,181 A 2/1995 Anderson et al.
5,524,054 A 6/1996 Spille
5,627,938 A 5/1997 Johnston
5,629,780 A 5/1997 Watson
5,661,755 A 8/1997 Van De Kerkhof et al.
5,661,823 A 8/1997 Yamauchi et al.

(Continued)

FOREIGN PATENT DOCUMENTS

EP 0597649 5/1994

(Continued)

OTHER PUBLICATIONS

Advanced Television Systems Committee, ATSC Standard: Digital Audio Compression (AC-3), Revision A, 140 pp. (1995).

(Continued)

*Primary Examiner*—David Hudspeth
*Assistant Examiner*—Justin W. Rider
(74) *Attorney, Agent, or Firm*—Klarquist Sparkman, LLP

(57) ABSTRACT

An audio encoder and decoder use architectures and techniques that improve the efficiency of quantization (e.g., weighting) and inverse quantization (e.g., inverse weighting) in audio coding and decoding. The described strategies include various techniques and tools, which can be used in combination or independently. For example, an audio encoder quantizes audio data in multiple channels, applying multiple channel-specific quantizer step modifiers, which give the encoder more control over balancing reconstruction quality between channels. The encoder also applies multiple quantization matrices and varies the resolution of the quantization matrices, which allows the encoder to use more resolution if overall quality is good and use less resolution if overall quality is poor. Finally, the encoder compresses one or more quantization matrices using temporal prediction to reduce the bitrate associated with the quantization matrices. An audio decoder performs corresponding inverse processing and decoding.

21 Claims, 31 Drawing Sheets

U.S. PATENT DOCUMENTS

| | | | | |
|---|---|---|---|---|
| 5,682,152 | A | 10/1997 | Wang et al. | |
| 5,684,920 | A | 11/1997 | Iwakami et al. | |
| 5,686,964 | A | 11/1997 | Tabatabai et al. | |
| 5,701,346 | A | 12/1997 | Herre et al. | |
| 5,812,971 | A | 9/1998 | Herre | |
| 5,835,030 | A | 11/1998 | Tsutsui et al. | |
| 5,845,243 | A | 12/1998 | Smart et al. | |
| 5,956,674 | A * | 9/1999 | Smyth et al. | 704/200.1 |
| 5,974,380 | A * | 10/1999 | Smyth et al. | 704/229 |
| 5,995,151 | A | 11/1999 | Naveen et al. | |
| 6,029,126 | A | 2/2000 | Malvar | |
| 6,041,295 | A | 3/2000 | Hinderks | |
| 6,058,362 | A | 5/2000 | Malvar | |
| 6,064,954 | A | 5/2000 | Cohen et al. | |
| 6,115,688 | A | 9/2000 | Brandenburg et al. | |
| 6,115,689 | A | 9/2000 | Malvar | |
| 6,182,034 | B1 | 1/2001 | Malvar | |
| 6,240,380 | B1 | 5/2001 | Malvar | |
| 6,249,614 | B1 | 6/2001 | Kolesnik et al. | |
| 6,370,502 | B1 | 4/2002 | Wu et al. | |
| 6,418,405 | B1 * | 7/2002 | Satyamurti et al. | 704/206 |
| 6,445,739 | B1 | 9/2002 | Shen et al. | |
| 6,658,162 | B1 | 12/2003 | Zeng et al. | |
| 6,738,074 | B2 | 5/2004 | Rao et al. | |
| 6,766,293 | B1 | 7/2004 | Herre et al. | |
| 6,771,777 | B1 | 8/2004 | Gbur et al. | |
| 6,934,677 | B2 | 8/2005 | Chen et al. | |
| 7,062,445 | B2 | 6/2006 | Kadatch | |
| 2002/0143556 | A1 | 10/2002 | Kadatch | |
| 2004/0044527 | A1 | 3/2004 | Thumpudi et al. | |

FOREIGN PATENT DOCUMENTS

| | | |
|---|---|---|
| EP | 0669724 | 8/1995 |
| EP | 0910927 | 4/1999 |
| EP | 0931386 | 7/1999 |
| WO | WO 99/43110 | 8/1999 |

OTHER PUBLICATIONS

Beerends, "Audio Quality Determination Based on Perceptual Measurement Techniques," Applications of Digital Signal Processing to Audio and Acoustics, Chapter 1, Ed. Mark Kahrs, Karlheinz Brandenburg, Kluwer Acad. Publ., pp. 1-38 (1998).

Bosi et al., "ISO/IEC MPEG-2 Advanced Audio Coding," Journal of the Audio Engineering Society, Audio Engineering Society, vol. 45, No. 10, pp. 789-812 (1997).

Caetano et al., "Rate Control Strategy for Embedded Wavelet Video Coders," Electronics Letters, pp. 1815-1817 (Oct. 14, 1999).

De Luca, "AN1090 Application Note: STA013 MPEG 2.5 Layer III Source Decoder," STMicroelectronics, 17 pp. (1999).

de Queiroz et al., "Time-Varying Lapped Transforms and Wavelet Packets," IEEE Transactions on Signal Processing, vol. 41, pp. 3293-3305 (1993).

Dolby Laboratories, "AAC Technology," 4 pp. [Downloaded from the web site aac-audio.com on World Wide Web on Nov. 21, 2001.].

Fraunhofer-Gesellschaft, "MPEG Audio Layer-3," 4 pp. [Downloaded from the World Wide Web on Oct. 24, 2001.].

Fraunhofer-Gesellschaft, "MPEG-2 AAC," 3 pp. [Downloaded from the World Wide Web on Oct. 24, 2001.].

ISO/IEC 13818-7, Information technology—Generic coding of moving pictures and associated audio information—Part 7: Advanced Audio Coding (AAC), 150 pp. (1997).

ITU, Recommendation ITU-R BS 1387, Method for Objective Measurements of Perceived Audio Quality, 89 pp. (1998).

Kondoz, Digital Speech: Coding for Low Bit Rate Communications Systems, "Chapter 3.3: Linear Predictive Modeling of Speech Signals" and "Chapter 4: LPC Parameter Quantisation Using LSFs," John Wiley & Sons, pp. 42-53 and 79-97 (1994).

Malvar, "Biorthogonal and Nonuniform Lapped Transforms for Transform Coding with Reduced Blocking and Ringing Artifacts," appeared in IEEE Transactions on Signal Processing, Special Issue on Multirate Systems, Filter Banks, Wavelets, and Applications, vol. 46, 29 pp. (1998).

Malvar, "Lapped Transforms for Efficient Transform/Subband Coding," IEEE Transactions on Acoustics, Speech and Signal Processing, vol. 38, No. 6, pp. 969-978 (1990).

Malvar, "Signal Processing with Lapped Transforms," Artech House, Norwood, MA, pp. iv, vii-xi, 175-218, and 353-57 (1992).

OPTICOM GmbH, "Objective Perceptual Measurement," 14 pp. [Downloaded from the World Wide Web on Oct. 24, 2001.].

Phamdo, "Speech Compression," 13 pp. [Downloaded from the World Wide Web on Nov. 25, 2001.].

Ribas Corbera et al., "Rate Control in DCT Video Coding for Low-Delay Communications," IEEE Transactions on Circuits and Systems for Video Technology, vol. 9, No. 1, pp. 172-185 (Feb. 1999).

Search Report for European Patent Application No. 03 020 110.7.

Search Report for European Patent Application No. 03 020 111.5.

Shlien, "The Modulated Lapped Transform, Its Time-Varying Forms, and Its Application to Audio Coding Standards," IEEE Transactions on Speech and Audio Processing, vol. 5, No. 4, pp. 359-366 (Jul. 1997).

Srinivasan et al., "High-Quality Audio Compression Using an Adaptive Wavelet Packet Decomposition and Psychoacoustic Modeling," IEEE Transactions on Signal Processing, vol. 46, No. 4, pp. 1085-1093 (Apr. 1998).

Terhardt, "Calculating Virtual Pitch," Hearing Research, 1:155-182 (1979).

Wragg et al., "An Optimised Software Solution for an ARM PoweredTM MP3 Decoder," 9 pp. [Downloaded from the World Wide Web on Oct. 27, 2001.].

Zwicker, Psychoakustik, Title Page, Table of Contents, "Teil I: Einfuhrung," Index, Springer-Verlag, Berlin Heidelberg, New York, pp. II, IX-XI, 1-30, and 157-162 (1982).

Zwicker et al., Das Ohr als Nachrichtenempfä nger, Title page, Table of Contents, "I: Schallschwingungen," Index, Hirzel-Verlag, Stuttgart, pp. III, IX-XI, 1-26, and 231-32 (1967).

Brandenburg, "ASPEC Coding", *AES 10th International Conference*, pp. 81-90 (1991).

"ISO/IEC 13818-7, Information Technology—Generic Coding of Moving Pictures and Associated Audio Information—Part 7: Advanced Audio Coding (AAC), Technical Corrigendum 1," 22 pp. (1998).

Jesteadt et al., "Forward Masking as a Function of Frequency, Masker Level, and Signal Delay," *Journal of Acoustical Society of America*, 71:950-962 (1982).

Lutfi, "Additivity of Simultaneous Masking," *Journal of Acoustic Soceity of America*, 73:262-267 (1983).

Yang et al., "An Inter-Channel Redundancy Removal Approach for High-Quality Multichannel Audio Compression," in *AES 109th Convention*, Los Angeles, California, 8 pp. (Sep. 2000).

Wang et al., "A Multichannel Audio Coding Algorithm for Inter-Channel Redundancy Removal," in *AES 100th Convention*, Amsterdam, the Netherlands, 6pp. (May 2001).

Yang et al., "Adaptive Karhunen-Loeve Transform for Enhanced Multichannel Audio Coding," Proc. SPIE vol. 4475, 13 pp., Mathematics of Data/Image Coding, Compression, and Encryption IV San Diego, CA. (Jul. 29-Aug. 3, 2001).

Vaidyanathan, *Multirate Systems and Filter Banks*, Prentice Hall Signal Processing Series, Cover page, pp. 745-751 (1992).

"MPEG2 Audio for DVD: the Compromise Choice," 5 pp. (Oct. 1996).

Edler et al., "Perceptual Audio Coding Using a Time-Varying Linear Pre- and Post-Filter," in *AES 109th Convention*, Los Angeles, California, 12 pp. (Sep. 2000).

"ISO/IEC 13818-7, Information Technology—Generic Coding of Moving Pictures and Associated Audio Information—Part 7: Advanced Audio Coding (AAC)," 174 pp. (1997).

Wang et al., "EE225a Lecture 13: Karhunen Loève Transform and Discrete Cosine Transform," Department of EECS, Unversity of California at Berkley, 10 pp. (Mar. 2002).

Meares, D.J., "Matrixed Surround Sound in an MPEG Digital World," *Journal of the Audio Engineering Society*, vol. 46, No. 4, 13 pp. (Apr. 1998).
Stuart et al., "Lossless Compression for DVD-Audio," in *AES 9th Regional Convention Tokyo*, 4 pp. (1999).
Kuo et al., "A Study of Why Cross Channel Prediction is Not Applicable to Perceptual Audio Coding," *IEEE Signal Processing Letters*, vol. 8, No. 9, 3 pp. (Sep. 2001).
Van Assche et al., "Lossless Compression of Pre-Press Image Using a Novel Color Decorrelation Technique," *Proc. SPIE, Very High Resolution and Quality III*. vol. 3308, 8 pp. (1998).
Davis, "The AC-3 Multichannel Coder," Dolby Laboratories, 9 pp. (Downloaded from the World Wide Web on Aug. 15, 2002).
Gibson et al., *Digital Compression for Multimedia*, Title Page, Contents, "Chapter 7: Frequency Domain Coding," Morgan Kaufman Publishers, Inc., pp. iii, v-xi, and 227-262 (1998).
Herley et al., "Tilings of the Time-Frequency Plane: Construction of Arbitrary Orthogonal Bases and Fast Tiling Algorithms," *IEEE Transactions on Signal Processing*, vol. 41, No. 12, pp. 3341-3359 (1993).
"ISO/IEC 11172-3, Information Technology—Coding of Moving Pictures and Associated Audio for Digital Storage Media at Up to About 1.5 Mbit/s—Part 3: Audio," 154 pp. (1993).
ITU, Recommendation ITU-R BS 1115, Low Bit-Rate Audio Coding, 9 pp. (1994).
Solari, *Digital Video and Audio Compression*, Title Page, Contents, "Chapter 8: Sound and Audio," McGraw-Hill, Inc., pp. iii, v-vi, and 187-211 (1997).
"ATSC Standard: Digital Audio Compression (AC-3), Revision A," 140 pp. (Aug. 2001).
Chen et al., U.S. Appl. No. 10/017,702, entitled, "Quantization Matrices for Digital Audio," filed Dec. 14, 2001.
Chen et al., U.S. Appl. No. 10/017,861, entitled, "Techniques for Measurement of Perceptual Audio Quality," filed Dec. 14, 2001.
Chen et al., U.S. Appl. No. 10/020,708, entitled, "Adaptive Window-Size Selection in Transform Coding," filed Dec. 14, 2001.
Chen et al., U.S. Appl. No. 10/016,918, entitled, "Quality Improvement Techniques in an Audio Encoder," filed Dec. 14, 2001.
Chen et al., U.S. Appl. No. 10/017,694, entitled, "Quality and Rate Control Strategy for Digital Audio," filed Dec. 14, 2001.

* cited by examiner

Figure 1,
Prior Art
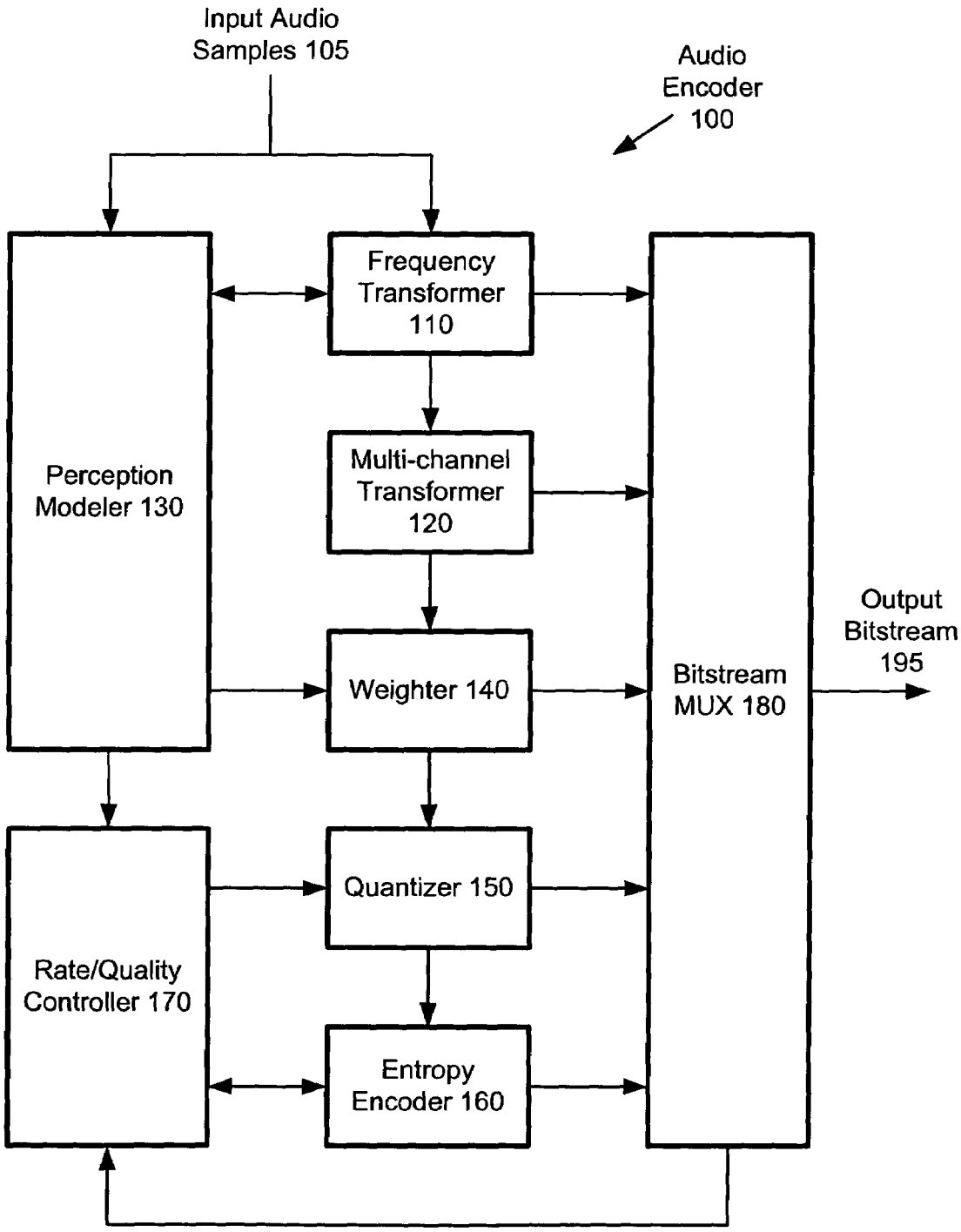

Figure 2, Prior Art
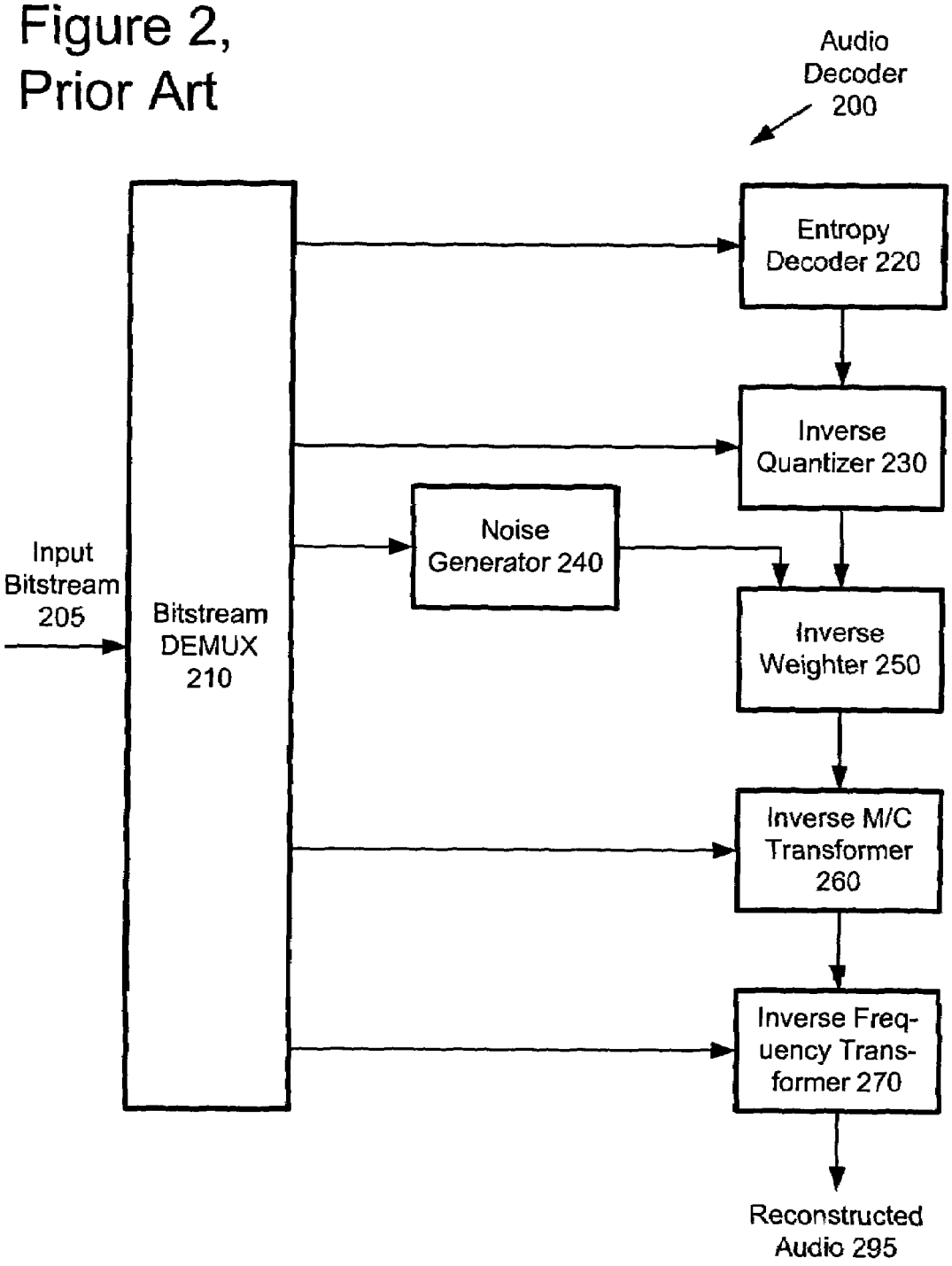

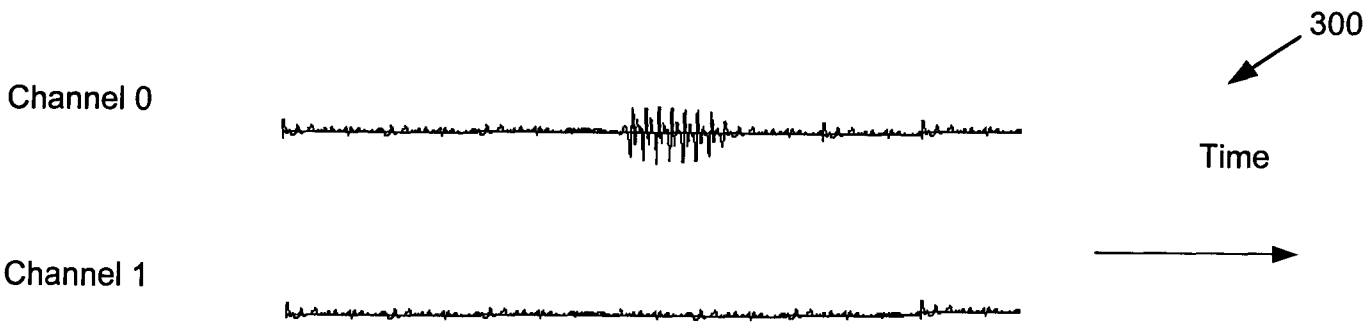
Figure 3a, Prior Art
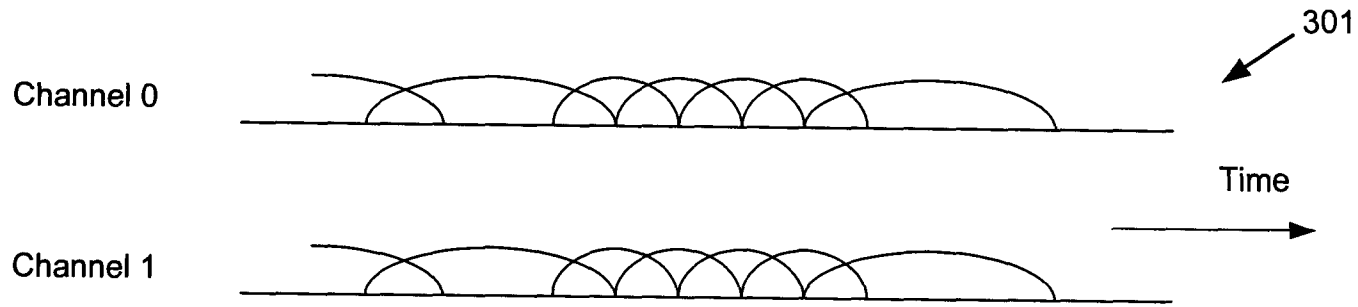
Figure 3b, Prior Art

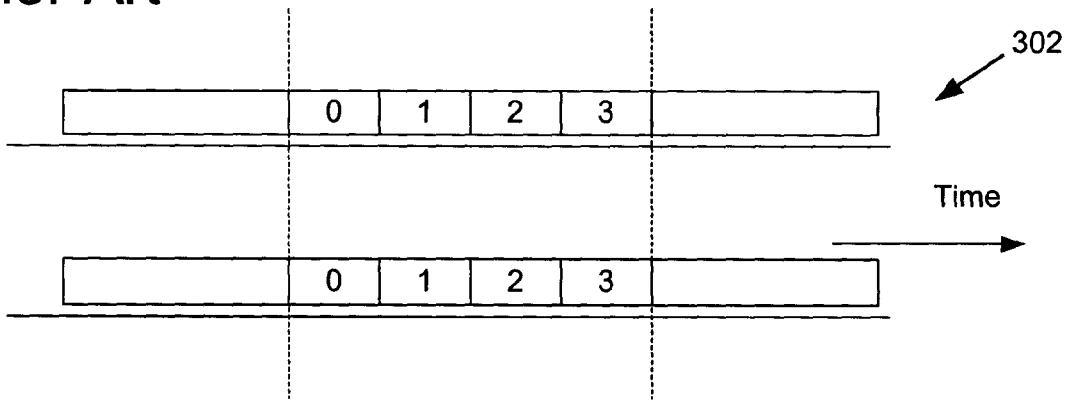
Figure 3c, Prior Art
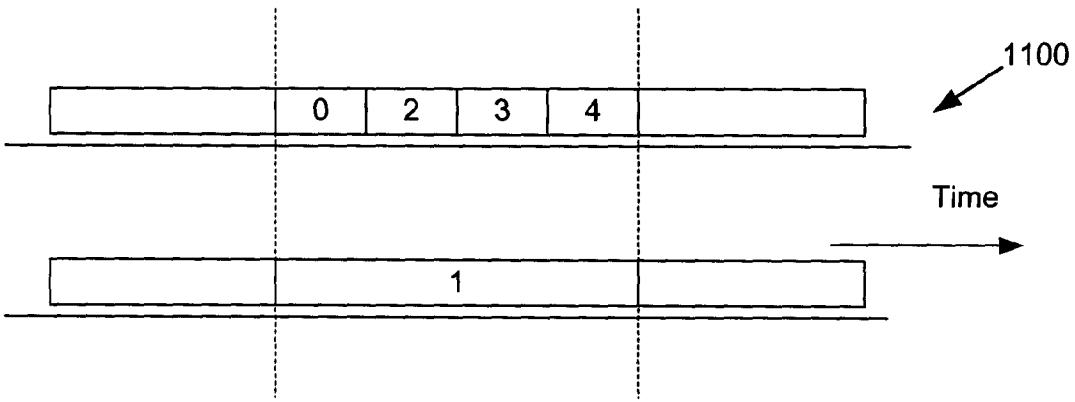
Figure 11a

Input Audio Samples 605
Audio Encoder 600
Selector 608
M/C Pre-Processor 610
Partitioner/ Tile Configurer 620
Frequency Transformer 630
Perception Modeler 640
Quant. Band Weighter 642
Channel Weighter 644
M/C Trans-former 650
Quantizer 660
Entropy Encoder 670
MUX 690
Output Bitstream 695
Mixed/Pure Lossless Coder 672
Entropy Encoder 674
Rate/Quality Controller 680

Figure 9a

Good quality pre-processing transform matrix 900

$$A_{low} = \begin{bmatrix} 1 & 0 & 0 & 0 & 0 & 0 \\ 0 & 1 & 0 & 0 & 0 & 0 \\ 0 & 0 & 1 & 0 & 0 & 0 \\ 0 & 0 & 0 & 1 & 0 & 0 \\ 0 & 0 & 0 & 0 & 1 & 0 \\ 0 & 0 & 0 & 0 & 0 & 1 \end{bmatrix}$$

Figure 9b

First intermediate quality pre-processing transform matrix 901

$$A_{inter,1} = \begin{bmatrix} \left(\frac{1}{1+0.5\cdot\alpha}\right) & 0 & \left(\frac{0.5\cdot\alpha}{1+0.5\cdot\alpha}\right) & 0 & 0 & 0 \\ 0 & \left(\frac{1}{1+0.5\cdot\alpha}\right) & \left(\frac{0.5\cdot\alpha}{1+0.5\cdot\alpha}\right) & 0 & 0 & 0 \\ \left(\frac{\alpha}{1+2\alpha}\right) & \left(\frac{\alpha}{1+2\alpha}\right) & \left(\frac{1}{1+2\alpha}\right) & 0 & 0 & 0 \\ 0 & 0 & 0 & 1 & 0 & 0 \\ 0 & 0 & 0 & 0 & \left(\frac{1}{1+\alpha}\right) & \left(\frac{\alpha}{1+\alpha}\right) \\ 0 & 0 & 0 & 0 & \left(\frac{\alpha}{1+\alpha}\right) & \left(\frac{1}{1+\alpha}\right) \end{bmatrix}$$

Figure 9c

First poor quality pre-processing transform matrix 902

$$A_{high,1} = \begin{bmatrix} \left(\frac{1}{1.5}\right) & 0 & \left(\frac{0.5}{1.5}\right) & 0 & 0 & 0 \\ 0 & \left(\frac{1}{1.5}\right) & \left(\frac{0.5}{1.5}\right) & 0 & 0 & 0 \\ \left(\frac{1}{3}\right) & \left(\frac{1}{3}\right) & \left(\frac{1}{3}\right) & 0 & 0 & 0 \\ 0 & 0 & 0 & 1 & 0 & 0 \\ 0 & 0 & 0 & 0 & 0.5 & 0.5 \\ 0 & 0 & 0 & 0 & 0.5 & 0.5 \end{bmatrix}$$

Figure 9d

Second intermediate quality pre-processing transform matrix 903

$$A_{inter,2} = \begin{bmatrix} \left(\frac{1}{1+0.5\cdot\alpha}\right) & 0 & \left(\frac{0.5\cdot\alpha}{1+0.5\cdot\alpha}\right) & 0 & 0 & 0 \\ 0 & \left(\frac{1}{1+0.5\cdot\alpha}\right) & \left(\frac{0.5\cdot\alpha}{1+0.5\cdot\alpha}\right) & 0 & 0 & 0 \\ 0.5\cdot\alpha & 0.5\cdot\alpha & 1-\alpha & 0 & 0 & 0 \\ 0 & 0 & 0 & 1 & 0 & 0 \\ 0 & 0 & 0 & 0 & \left(\frac{1}{1+\alpha}\right) & \left(\frac{\alpha}{1+\alpha}\right) \\ 0 & 0 & 0 & 0 & \left(\frac{\alpha}{1+\alpha}\right) & \left(\frac{1}{1+\alpha}\right) \end{bmatrix}$$

Figure 9e

Second poor quality pre-processing transform matrix 904

$$A_{high,2} = \begin{bmatrix} \left(\frac{1}{1.5}\right) & 0 & \left(\frac{0.5}{1.5}\right) & 0 & 0 & 0 \\ 0 & \left(\frac{1}{1.5}\right) & \left(\frac{0.5}{1.5}\right) & 0 & 0 & 0 \\ 0 & 0 & 0 & 0 & 0 & 0 \\ 0 & 0 & 0 & 1 & 0 & 0 \\ 0 & 0 & 0 & 0 & 0.5 & 0.5 \\ 0 & 0 & 0 & 0 & 0.5 & 0.5 \end{bmatrix}$$

1300
Start
1310
None split ?
yes
1312
Send flag bit
no
1320
All split same ?
yes
1322
Send flag bit and tile sizes
no
1330
Mark all sample positions as ungrouped
Scan for ungrouped sample position in channel/time pattern
1340
Group like windows in a tile
1350
Send tile configur-ation information
1360
Mark sample positions in tile as grouped
1370
1380
no
Done ?
yes
End

2600

$$\begin{bmatrix} 1 & 0 & 0 & 0 & \cdots & 0 & 0 & 0 & 0 \\ 0 & 1 & 0 & 0 & \cdots & 0 & 0 & 0 & 0 \\ 0 & 0 & \cos\omega_k & 0 & \cdots & \sin\omega_k & 0 & 0 & 0 \\ 0 & 0 & 0 & 1 & \cdots & 0 & 0 & 0 & 0 \\ \cdots & \cdots & \cdots & \cdots & \cdots & \cdots & \cdots & \cdots & \cdots \\ 0 & 0 & -\sin\omega_k & 0 & \cdots & \cos\omega_k & 0 & 0 & 0 \\ 0 & 0 & 0 & 0 & \cdots & 0 & 1 & 0 & 0 \\ 0 & 0 & 0 & 0 & \cdots & 0 & 0 & 1 & 0 \\ 0 & 0 & 0 & 0 & \cdots & 0 & 0 & 0 & 1 \end{bmatrix}$$

Figure 27a $$\Theta_1 = \begin{bmatrix} \cos\varpi_1 & \sin\varpi_1 & 0 & 0 & 0 & 0 & 0 & \cdots & 0 \\ -\sin\varpi_1 & \cos\varpi_1 & 0 & 0 & 0 & 0 & 0 & \cdots & 0 \\ 0 & 0 & 1 & 0 & 0 & 0 & 0 & \cdots & 0 \\ 0 & 0 & 0 & 1 & 0 & 0 & 0 & \cdots & 0 \\ 0 & 0 & 0 & 0 & 1 & 0 & 0 & \cdots & 0 \\ 0 & 0 & 0 & 0 & 0 & 1 & 0 & \cdots & 0 \\ 0 & 0 & 0 & 0 & 0 & 0 & 1 & \cdots & 0 \\ \cdots & \cdots & \cdots & \cdots & \cdots & \cdots & \cdots & \cdots & 0 \\ 0 & 0 & 0 & 0 & 0 & 0 & 0 & \cdots & 1 \end{bmatrix}$$

2700

Figure 27b $$\Theta_2 = \begin{bmatrix} \cos\varpi_2 & 0 & \sin\varpi_2 & 0 & 0 & 0 & 0 & \cdots & 0 \\ 0 & 1 & 0 & 0 & 0 & 0 & 0 & \cdots & 0 \\ -\sin\varpi_2 & 0 & \cos\varpi_2 & 0 & 0 & 0 & 0 & \cdots & 0 \\ 0 & 0 & 0 & 1 & 0 & 0 & 0 & \cdots & 0 \\ 0 & 0 & 0 & 0 & 1 & 0 & 0 & \cdots & 0 \\ 0 & 0 & 0 & 0 & 0 & 1 & 0 & \cdots & 0 \\ 0 & 0 & 0 & 0 & 0 & 0 & 1 & \cdots & 0 \\ \cdots & \cdots & \cdots & \cdots & \cdots & \cdots & \cdots & \cdots & 0 \\ 0 & 0 & 0 & 0 & 0 & 0 & 0 & \cdots & 1 \end{bmatrix}$$

2701

Figure 27c $$\Theta_3 = \begin{bmatrix} 1 & 0 & 0 & 0 & 0 & 0 & 0 & \cdots & 0 \\ 0 & \cos\varpi_3 & \sin\varpi_3 & 0 & 0 & 0 & 0 & \cdots & 0 \\ 0 & -\sin\varpi_3 & \cos\varpi_3 & 0 & 0 & 0 & 0 & \cdots & 0 \\ 0 & 0 & 0 & 1 & 0 & 0 & 0 & \cdots & 0 \\ 0 & 0 & 0 & 0 & 1 & 0 & 0 & \cdots & 0 \\ 0 & 0 & 0 & 0 & 0 & 1 & 0 & \cdots & 0 \\ 0 & 0 & 0 & 0 & 0 & 0 & 1 & \cdots & 0 \\ \cdots & \cdots & \cdots & \cdots & \cdots & \cdots & \cdots & \cdots & 0 \\ 0 & 0 & 0 & 0 & 0 & 0 & 0 & \cdots & 1 \end{bmatrix}$$

2702

Post-processing
transform matrix
4000

$$A_{P\text{-}Center} = \begin{bmatrix} 1 & 0 & 0 & 0 & 0 & 0 \\ 0 & 1 & 0 & 0 & 0 & 0 \\ 0.5 & 0.5 & 0 & 0 & 0 & 0 \\ 0 & 0 & 0 & 1 & 0 & 0 \\ 0 & 0 & 0 & 0 & 1 & 0 \\ 0 & 0 & 0 & 0 & 0 & 1 \end{bmatrix}$$

4200
Start
4210
#Channels > 1 ?
no
4212
Use identity matrix (no m/c transform)
yes
4220
iTmp = getBits(1)
4230
iTmp = 1 ?
no
4232
Use identity matrix (no m/c transform)
yes
4240
iTmp = getBits(1)
4250
iTmp = 0 ?
no
4252
Use pre-defined m/c transform matrix
yes
4260
iCoefsDone = 0
#CoefsToDo = #Channels²
4262
4270
iCoefsDone < #CoefsToDo ?
no
End
yes
4272
A[iCoefsDone] = SignExtend(getBits(4)) /-8
4274
iCoefsDone = iCoefsDone + 1

QUANTIZATION AND INVERSE QUANTIZATION FOR AUDIO

RELATED APPLICATION INFORMATION

This application claims the benefit of U.S. Provisional Patent Application Ser. No. 60/408,517, filed Sep. 4, 2002, the disclosure of which is incorporated herein by reference.

The following U.S. provisional patent applications relate to the present application: 1) U.S. Provisional Patent Application Ser. No. 60/408,432, entitled, "Unified Lossy and Lossless Audio Compression," filed Sep. 4, 2002, the disclosure of which is hereby incorporated by reference; and 2) U.S. Provisional Patent Application Ser. No. 60/408,538, entitled, "Entropy Coding by Adapting Coding Between Level and Run Length/Level Modes," filed Sep. 4, 2002, the disclosure of which is hereby incorporated by reference.

TECHNICAL FIELD

The present invention relates to processing audio information in encoding and decoding. Specifically, the present invention relates to quantization and inverse quantization in audio encoding and decoding.

BACKGROUND

With the introduction of compact disks, digital wireless telephone networks, and audio delivery over the Internet, digital audio has become commonplace. Engineers use a variety of techniques to process digital audio efficiently while still maintaining the quality of the digital audio. To understand these techniques, it helps to understand how audio information is represented and processed in a computer.

I. Representation of Audio Information in a Computer

A computer processes audio information as a series of numbers representing the audio information. For example, a single number can represent an audio sample, which is an amplitude value (i.e., loudness) at a particular time. Several factors affect the quality of the audio information, including sample depth, sampling rate, and channel mode.

Sample depth (or precision) indicates the range of numbers used to represent a sample. The more values possible for the sample, the higher the quality because the number can capture more subtle variations in amplitude. For example, an 8-bit sample has 256 possible values, while a 16-bit sample has 65,536 possible values. A 24-bit sample can capture normal loudness variations very finely, and can also capture unusually high loudness.

The sampling rate (usually measured as the number of samples per second) also affects quality. The higher the sampling rate, the higher the quality because more frequencies of sound can be represented. Some common sampling rates are 8,000, 11,025, 22,050, 32,000, 44,100, 48,000, and 96,000 samples/second.

Mono and stereo are two common channel modes for audio. In mono mode, audio information is present in one channel. In stereo mode, audio information is present in two channels usually labeled the left and right channels. Other modes with more channels such as 5.1 channel, 7.1 channel, or 9.1 channel surround sound (the "1" indicates a subwoofer or low-frequency effects channel) are also possible. Table 1 shows several formats of audio with different quality levels, along with corresponding raw bitrate costs.

TABLE 1

Bitrates for different quality audio information

| Quality | Sample Depth (bits/sample) | Sampling Rate (samples/second) | Mode | Raw Bitrate (bits/second) |
|---|---|---|---|---|
| Internet telephony | 8 | 8,000 | mono | 64,000 |
| Telephone | 8 | 11,025 | mono | 88,200 |
| CD audio | 16 | 44,100 | stereo | 1,411,200 |

Surround sound audio typically has even higher raw bitrate. As Table 1 shows, the cost of high quality audio information is high bitrate. High quality audio information consumes large amounts of computer storage and transmission capacity. Companies and consumers increasingly depend on computers, however, to create, distribute, and play back high quality multi-channel audio content.

II. Processing Audio Information in a Computer

Many computers and computer networks lack the resources to process raw digital audio. Compression (also called encoding or coding) decreases the cost of storing and transmitting audio information by converting the information into a lower bitrate form. Compression can be lossless (in which quality does not suffer) or lossy (in which quality suffers but bitrate reduction from subsequent lossless compression is more dramatic). Decompression (also called decoding) extracts a reconstructed version of the original information from the compressed form.

A. Standard Perceptual Audio Encoders and Decoders

Generally, the goal of audio compression is to digitally represent audio signals to provide maximum signal quality with the least possible amount of bits. A conventional audio encoder/decoder ["codec"] system uses subband/transform coding, quantization, rate control, and variable length coding to achieve its compression. The quantization and other lossy compression techniques introduce potentially audible noise into an audio signal. The audibility of the noise depends on how much noise there is and how much of the noise the listener perceives. The first factor relates mainly to objective quality, while the second factor depends on human perception of sound.

FIG. 1 shows a generalized diagram of a transform-based, perceptual audio encoder (100) according to the prior art. FIG. 2 shows a generalized diagram of a corresponding audio decoder (200) according to the prior art. Though the codec system shown in FIGS. 1 and 2 is generalized, it has characteristics found in several real world codec systems, including versions of Microsoft Corporation's Windows Media Audio ["WMA"] encoder and decoder. Other codec systems are provided or specified by the Motion Picture Experts Group, Audio Layer 3 ["MP3"] standard, the Motion Picture Experts Group 2, Advanced Audio Coding ["AAC"] standard, and Dolby AC3. For additional information about the codec systems, see the respective standards or technical publications.

1. Perceptual Audio Encoder

Overall, the encoder (100) receives a time series of input audio samples (105), compresses the audio samples (105), and multiplexes information produced by the various modules of the encoder (100) to output a bitstream (195). The encoder (100) includes a frequency transformer (110), a multi-channel transformer (120), a perception modeler (130), a weighter (140), a quantizer (150), an entropy encoder (160), a controller (170), and a bitstream multiplexer ["MUX"] (180).

The frequency transformer (110) receives the audio samples (105) and converts them into data in the frequency domain. For example, the frequency transformer (110) splits the audio samples (105) into blocks, which can have variable size to allow variable temporal resolution. Small blocks allow for greater preservation of time detail at short but active transition segments in the input audio samples (105), but sacrifice some frequency resolution. In contrast, large blocks have better frequency resolution and worse time resolution, and usually allow for greater compression efficiency at longer and less active segments. Blocks can overlap to reduce perceptible discontinuities between blocks that could otherwise be introduced by later quantization. For multi-channel audio, the frequency transformer (110) uses the same pattern of windows for each channel in a particular frame. The frequency transformer (110) outputs blocks of frequency coefficient data to the multi-channel transformer (120) and outputs side information such as block sizes to the MUX (180).

For multi-channel audio data, the multiple channels of frequency coefficient data produced by the frequency transformer (110) often correlate. To exploit this correlation, the multi-channel transformer (120) can convert the multiple original, independently coded channels into jointly coded channels. For example, if the input is stereo mode, the multi-channel transformer (120) can convert the left and right channels into sum and difference channels:

$$X_{Sum}[k] = \frac{X_{Left}[k] + X_{Right}[k]}{2}, \quad (1)$$

$$X_{Diff}[k] = \frac{X_{Left}[k] - X_{Right}[k]}{2}. \quad (2)$$

Or, the multi-channel transformer (120) can pass the left and right channels through as independently coded channels. The decision to use independently or jointly coded channels is predetermined or made adaptively during encoding. For example, the encoder (100) determines whether to code stereo channels jointly or independently with an open loop selection decision that considers the (a) energy separation between coding channels with and without the multi-channel transform and (b) the disparity in excitation patterns between the left and right input channels. Such a decision can be made on a window-by-window basis or only once per frame to simplify the decision. The multi-channel transformer (120) produces side information to the MUX (180) indicating the channel mode used.

The encoder (100) can apply multi-channel rematrixing to a block of audio data after a multi-channel transform. For low bitrate, multi-channel audio data in jointly coded channels, the encoder (100) selectively suppresses information in certain channels (e.g., the difference channel) to improve the quality of the remaining channel(s) (e.g., the sum channel). For example, the encoder (100) scales the difference channel by a scaling factor ρ:

$$\tilde{X}_{Diff}[k]=\rho\cdot X_{Diff}[k] \quad (3),$$

where the value of ρ is based on: (a) current average levels of a perceptual audio quality measure such as Noise to Excitation Ratio ["NER"], (b) current fullness of a virtual buffer, (c) bitrate and sampling rate settings of the encoder (100), and (d) the channel separation in the left and right input channels.

The perception modeler (130) processes audio data according to a model of the human auditory system to improve the perceived quality of the reconstructed audio signal for a given bitrate. For example, an auditory model typically considers the range of human hearing and critical bands. The human nervous system integrates sub-ranges of frequencies. For this reason, an auditory model may organize and process audio information by critical bands. Different auditory models use a different number of critical bands (e.g., 25, 32, 55, or 109) and/or different cut-off frequencies for the critical bands. Bark bands are a well-known example of critical bands. Aside from range and critical bands, interactions between audio signals can dramatically affect perception. An audio signal that is clearly audible if presented alone can be completely inaudible in the presence of another audio signal, called the masker or the masking signal. The human ear is relatively insensitive to distortion or other loss in fidelity (i.e., noise) in the masked signal, so the masked signal can include more distortion without degrading perceived audio quality. In addition, an auditory model can consider a variety of other factors relating to physical or neural aspects of human perception of sound.

The perception modeler (130) outputs information that the weighter (140) uses to shape noise in the audio data to reduce the audibility of the noise. For example, using any of various techniques, the weighter (140) generates weighting factors (sometimes called scaling factors) for quantization matrices (sometimes called masks) based upon the received information. The weighting factors in a quantization matrix include a weight for each of multiple quantization bands in the audio data, where the quantization bands are frequency ranges of frequency coefficients. The number of quantization bands can be the same as or less than the number of critical bands. Thus, the weighting factors indicate proportions at which noise is spread across the quantization bands, with the goal of minimizing the audibility of the noise by putting more noise in bands where it is less audible, and vice versa. The weighting factors can vary in amplitudes and number of quantization bands from block to block. The weighter (140) then applies the weighting factors to the data received from the multi-channel transformer (120).

In one implementation, the weighter (140) generates a set of weighting factors for each window of each channel of multi-channel audio, or shares a single set of weighting factors for parallel windows of jointly coded channels. The weighter (140) outputs weighted blocks of coefficient data to the quantizer (150) and outputs side information such as the sets of weighting factors to the MUX (180).

A set of weighting factors can be compressed for more efficient representation using direct compression. In the direct compression technique, the encoder (100) uniformly quantizes each element of a quantization matrix. The encoder then differentially codes the quantized elements relative to preceding elements in the matrix, and Huffman codes the differentially coded elements. In some cases (e.g., when all of the coefficients of particular quantization bands have been quantized or truncated to a value of 0), the decoder (200) does not require weighting factors for all quantization bands. In such cases, the encoder (100) gives values to one or more unneeded weighting factors that are identical to the value of the next needed weighting factor in a series, which makes differential coding of elements of the quantization matrix more efficient.

Or, for low bitrate applications, the encoder (100) can parametrically compress a quantization matrix to represent the quantization matrix as a set of parameters, for example, using Linear Predictive Coding ["LPC"] of pseudo-autocorrelation parameters computed from the quantization matrix.

The quantizer (150) quantizes the output of the weighter (140), producing quantized coefficient data to the entropy encoder (160) and side information including quantization step size to the MUX (180). Quantization maps ranges of input values to single values, introducing irreversible loss of information, but also allowing the encoder (100) to regulate the quality and bitrate of the output bitstream (195) in conjunction with the controller (170). In FIG. 1, the quantizer (150) is an adaptive, uniform, scalar quantizer. The quantizer (150) applies the same quantization step size to each frequency coefficient, but the quantization step size itself can change from one iteration of a quantization loop to the next to affect the bitrate of the entropy encoder (160) output. Other kinds of quantization are non-uniform, vector quantization, and/or non-adaptive quantization.

The entropy encoder (160) losslessly compresses quantized coefficient data received from the quantizer (150). The entropy encoder (160) can compute the number of bits spent encoding audio information and pass this information to the rate/quality controller (170).

The controller (170) works with the quantizer (150) to regulate the bitrate and/or quality of the output of the encoder (100). The controller (170) receives information from other modules of the encoder (100) and processes the received information to determine a desired quantization step size given current conditions. The controller (170) outputs the quantization step size to the quantizer (150) with the goal of satisfying bitrate and quality constraints.

The encoder (100) can apply noise substitution and/or band truncation to a block of audio data. At low and mid-bitrates, the audio encoder (100) can use noise substitution to convey information in certain bands. In band truncation, if the measured quality for a block indicates poor quality, the encoder (100) can completely eliminate the coefficients in certain (usually higher frequency) bands to improve the overall quality in the remaining bands.

The MUX (180) multiplexes the side information received from the other modules of the audio encoder (100) along with the entropy encoded data received from the entropy encoder (160). The MUX (180) outputs the information in a format that an audio decoder recognizes. The MUX (180) includes a virtual buffer that stores the bitstream (195) to be output by the encoder (100) in order to smooth over short-term fluctuations in bitrate due to complexity changes in the audio.

2. Perceptual Audio Decoder

Overall, the decoder (200) receives a bitstream (205) of compressed audio information including entropy encoded data as well as side information, from which the decoder (200) reconstructs audio samples (295). The audio decoder (200) includes a bitstream demultiplexer ["DEMUX"] (210), an entropy decoder (220), an inverse quantizer (230), a noise generator (240), an inverse weighter (250), an inverse multi-channel transformer (260), and an inverse frequency transformer (270).

The DEMUX (210) parses information in the bitstream (205) and sends information to the modules of the decoder (200). The DEMUX (210) includes one or more buffers to compensate for short-term variations in bitrate due to fluctuations in complexity of the audio, network jitter, and/or other factors.

The entropy decoder (220) losslessly decompresses entropy codes received from the DEMUX (210), producing quantized frequency coefficient data. The entropy decoder (220) typically applies the inverse of the entropy encoding technique used in the encoder.

The inverse quantizer (230) receives a quantization step size from the DEMUX (210) and receives quantized frequency coefficient data from the entropy decoder (220). The inverse quantizer (230) applies the quantization step size to the quantized frequency coefficient data to partially reconstruct the frequency coefficient data.

From the DEMUX (210), the noise generator (240) receives information indicating which bands in a block of data are noise substituted as well as any parameters for the form of the noise. The noise generator (240) generates the patterns for the indicated bands, and passes the information to the inverse weighter (250).

The inverse weighter (250) receives the weighting factors from the DEMUX (210), patterns for any noise-substituted bands from the noise generator (240), and the partially reconstructed frequency coefficient data from the inverse quantizer (230). As necessary, the inverse weighter (250) decompresses the weighting factors, for example, entropy decoding, inverse differentially coding, and inverse quantizing the elements of the quantization matrix. The inverse weighter (250) applies the weighting factors to the partially reconstructed frequency coefficient data for bands that have not been noise substituted. The inverse weighter (250) then adds in the noise patterns received from the noise generator (240) for the noise-substituted bands.

The inverse multi-channel transformer (260) receives the reconstructed frequency coefficient data from the inverse weighter (250) and channel mode information from the DEMUX (210). If multi-channel audio is in independently coded channels, the inverse multi-channel transformer (260) passes the channels through. If multi-channel data is in jointly coded channels, the inverse multi-channel transformer (260) converts the data into independently coded channels.

The inverse frequency transformer (270) receives the frequency coefficient data output by the multi-channel transformer (260) as well as side information such as block sizes from the DEMUX (210). The inverse frequency transformer (270) applies the inverse of the frequency transform used in the encoder and outputs blocks of reconstructed audio samples (295).

B. Disadvantages of Standard P rc ptual Audio Encoders and Decoders

Although perceptual encoders and decoders as described above have good overall performance for many applications, they have several drawbacks, especially for compression and decompression of multi-channel audio. The drawbacks limit the quality of reconstructed multi-channel audio in some cases, for example, when the available bitrate is small relative to the number of input audio channels.

1. Inflexibility in Frame Partitioning for Multi-Channel Audio

In various respects, the frame partitioning performed by the encoder (100) of FIG. 1 is inflexible.

As previously noted, the frequency transformer (110) breaks a frame of input audio samples (105) into one or more overlapping windows for frequency transformation, where larger windows provide better frequency resolution and redundancy removal, and smaller windows provide better time resolution. The better time resolution helps control audible pre-echo artifacts introduced when the signal transitions from low energy to high energy, but using smaller windows reduces compressibility, so the encoder must balance these considerations when selecting window sizes. For multi-channel audio, the frequency transformer (110) partitions the channels of a frame identically (i.e., identical window configurations in the channels), which can be inefficient in some cases, as illustrated in FIGS. 3*a*-3*c*.

FIG. 3*a* shows the waveforms (300) of an example stereo audio signal. The signal in channel 0 includes transient activity, whereas the signal in channel 1 is relatively stationary. The encoder (100) detects the signal transition in channel 0 and, to reduce pre-echo, divides the frame into smaller overlapping, modulated windows (301) as shown in FIG. 3*b*. For the sake of simplicity, FIG. 3*c* shows the overlapped window configuration (302) in boxes, with dotted lines delimiting frame boundaries. Later figures also follow this convention.

A drawback of forcing all channels to have an identical window configuration is that a stationary signal in one or more channels (e.g., channel 1 in FIGS. 3*a*-3*c*) may be broken into smaller windows, lowering coding gains. Alternatively, the encoder (100) might force all channels to use larger windows, introducing pre-echo into one or more channels that have transients. This problem is exacerbated when more than two channels are to be coded.

AAC allows pair-wise grouping of channels for multi-channel transforms. Among left, right, center, back left, and back right channels, for example, the left and right channels might be grouped for stereo coding, and the back left and back right channels might be grouped for stereo coding. Different groups can have different window configurations, but both channels of a particular group have the same window configuration if stereo coding is used. This limits the flexibility of partitioning for multi-channel transforms in the AAC system, as does the use of only pair-wise groupings.

2. Inflexibility in Multi-Channel Transforms

The encoder (100) of FIG. 1 exploits some inter-channel redundancy, but is inflexible in various respects in terms of multi-channel transforms. The encoder (100) allows two kinds of transforms: (a) an identity transform (which is equivalent to no transform at all) or (b) sum-difference coding of stereo pairs. These limitations constrain multi-channel coding of more than two channels. Even in AAC, which can work with more than two channels, a multi-channel transform is limited to only a pair of channels at a time.

Several groups have experimented with multi-channel transformations for surround sound channels. For example, see Yang et al., "An Inter-Channel Redundancy Removal Approach for High-Quality Multichannel Audio Compression," AES 109$^{th}$ Convention, Los Angeles, September 2000 ["Yang"], and Wang et al., "A Multichannel Audio Coding Algorithm for Inter-Channel Redundancy Removal," AES 110$^{th}$ Convention, Amsterdam, Netherlands, May 2001 ["Wang"]. The Yang system uses a Karhunen-Loeve Transform ["KLT"] across channels to decorrelate the channels for good compression factors. The Wang system uses an integer-to-integer Discrete Cosine Transform ["DC"]. Both systems give some good results, but still have several limitations.

First, using a KLT on audio samples (whether across the time domain or frequency domain as in the Yang system) does not control the distortion introduced in reconstruction. The KLT in the Yang system is not used successfully for perceptual audio coding of multi-channel audio. The Yang system does not control the amount of leakage from one (e.g., heavily quantized) coded channel across to multiple reconstructed channels in the inverse multi-channel transform. This shortcoming is pointed out in Kuo et al, "A Study of Why Cross Channel Prediction Is Not Applicable to Perceptual Audio Coding," IEEE Signal Proc. Letters, vol. 8, no. 9, September 2001. In other words, quantization that is "inaudible" in one coded channel may become audible when spread in multiple reconstructed channels, since inverse weighting is performed before the inverse multi-channel transform. The Wang system overcomes this problem by placing the multi-channel transform after weighting and quantization in the encoder (and placing the inverse multi-channel transform before inverse quantization and inverse weighting in the decoder). The Wang system, however, has various other shortcomings. Performing the quantization prior to multi-channel transformation means that the multi-channel transformation must be integer-to-integer, limiting the number of transformations possible and limiting redundancy removal across channels.

Second, the Yang system is limited to KLT transforms. While KLT transforms adapt to the audio data being compressed, the flexibility of the Yang system to use different kinds of transforms is limited. Similarly, the Wang system uses integer-to-integer DCT for multi-channel transforms, which is not as good as conventional DCTs in terms of energy compaction, and the flexibility of the Wang system to use different kinds of transforms is limited.

Third, in the Yang and Wang systems, there is no mechanism to control which channels get transformed together, nor is there a mechanism to selectively group different channels at different times for multi-channel transformation. Such control helps limit the leakage of content across totally incompatible channels. Moreover, even channels that are compatible overall may be incompatible over some periods.

Fourth, in the Yang system, the multi-channel transformer lacks control over whether to apply the multi-channel transform at the frequency band level. Even among channels that are compatible overall, the channels might not be compatible at some frequencies or in some frequency bands. Similarly, the multi-channel transform of the encoder (100) of FIG. 1 lacks control at the sub-channel level; it does not control which bands of frequency coefficient data are multi-channel transformed, which ignores the inefficiencies that may result when less than all frequency bands of the input channels correlate.

Fifth, even when source channels are compatible, there is often a need to control the number of channels transformed together, so as to limit data overflow and reduce memory accesses while implementing the transform. In particular, the KLT of the Yang system is computationally complex. On the other hand, reducing the transform size also potentially reduces the coding gain compared to bigger transforms.

Sixth, sending information specifying multi-channel transformations can be costly in terms of bitrate. This is particularly true for the KLT of the Yang system, as the transform coefficients for the covariance matrix sent are real numbers.

Seventh, for low bitrate multi-channel audio, the quality of the reconstructed channels is very limited. Aside from the requirements of coding for low bitrate, this is in part due to the inability of the system to selectively and gracefully cut down the number of channels for which information is actually encoded.

3. Inefficiencies in Quantization and Weighting

In the encoder (100) of FIG. 1, the weighter (140) shapes distortion across bands in audio data and the quantizer (150) sets quantization step sizes to change the amplitude of the distortion for a frame and thereby balance quality versus bitrate. While the encoder (100) achieves a good balance of quality and bitrate in most applications, the encoder (100) still has several drawbacks.

First, the encoder (100) lacks direct control over quality at the channel level. The weighting factors shape overall distortion across quantization bands for an individual channel. The uniform, scalar quantization step size affects the amplitude of the distortion across all frequency bands and channels for a frame. Short of imposing very high or very low quality on all channels, the encoder (100) lacks direct control over setting equal or at least comparable quality in the reconstructed output for all channels.

Second, when weighting factors are lossy compressed, the encoder (100) lacks control over the resolution of quantization of the weighting factors. For direct compression of a quantization matrix, the encoder (100) uniformly quantizes elements of the quantization matrix, then uses differential coding and Huffman coding. The uniform quantization of mask elements does not adapt to changes in available bitrate or signal complexity. As a result, in some cases quantization matrices are encoded with more resolution than is needed given the overall low quality of the reconstructed audio, and in other cases quantization matrices are encoded with less resolution than should be used given the high quality of the reconstructed audio.

Third, the direct compression of quantization matrices in the encoder (100) fails to exploit temporal redundancies in the quantization matrices. The direct compression removes redundancy within a particular quantization matrix, but ignores temporal redundancy in a series of quantization matrices.

C. Down-Mixing Audio Channels

Aside from multi-channel audio encoding and decoding, Dolby Pro-Logic and several other systems perform down-mixing of multi-channel audio to facilitate compatibility with speaker configurations with different numbers of speakers. In the Dolby Pro-Logic down-mixing, for example, four channels are mixed down to two channels, with each of the two channels having some combination of the audio data in the original four channels. The two channels can be output on stereo-channel equipment, or the four channels can be reconstructed from the two-channels for output on four-channel equipment.

While down-mixing of this nature solves some compatibility problems, it is limited to certain set configurations, for example, four to two channel down-mixing. Moreover, the mixing formulas are pre-determined and do not allow changes over time to adapt to the signal.

SUMMARY

In summary, the detailed description is directed to strategies for quantization and inverse quantization in audio encoding and decoding. For example, an audio encoder uses one or more quantization (e.g., weighting) techniques to improve the quality and/or bitrate of audio data. This improves the overall listening experience and makes computer systems a more compelling platform for creating, distributing, and playing back high-quality audio. The strategies described herein include various techniques and tools, which can be used in combination or independently.

According to a first aspect of the strategies described herein, an audio encoder quantizes audio data in multiple channels, applying multiple channel-specific quantization factors for the multiple channels. For example, the channel-specific quantization factors are quantizer step modifiers, which give the encoder more control over balancing reconstruction quality between channels.

According to a second aspect of the strategies described herein, an audio encoder quantizes audio data, applying multiple quantization matrices. The encoder varies resolution of the quantization matrices. This allows, for example, the encoder to change the resolution of the elements of the quantization matrices to use more resolution if overall quality is good and use less resolution if overall quality is poor.

According to a third aspect of the strategies described herein, an audio encoder compresses one or more quantization matrices using temporal prediction. For example, the encoder computes a prediction for a current matrix relative to another matrix, then computes a residual from the current matrix and the prediction. In this way, the encoder reduces bitrate associated with the quantization matrices.

For the aspects described above in terms of an audio encoder, an audio decoder performs corresponding inverse processing and decoding.

The various features and advantages of the invention will be made apparent from the following detailed description of embodiments that proceeds with reference to the accompanying drawings.

BRIEF DESCRIPTION OF THE DRAWINGS

FIG. 1 is a block diagram of an audio encoder according to the prior art.

FIG. 2 is a block diagram of an audio decoder according to the prior art.

FIGS. 3*a*-3*c* are charts showing window configurations for a frame of stereo audio data according to the prior art.

FIGS. 9*a*-9*e* are charts showing example matrices for multi-channel pre-processing.

FIGS. 11*a* and 11*b* are charts showing example tile configurations for multi-channel audio.

FIGS. 27*a*-27*c* are charts showing example rotation matrices for Givens rotations for representing a multi-channel transform matrix.

DETAILED DESCRIPTION

Figure 4:
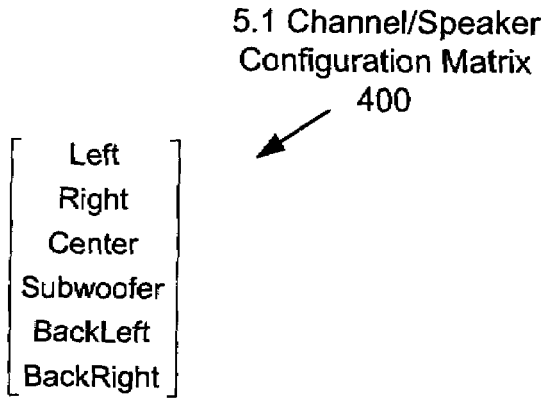
FIG. 4 is a chart showing six channels in a 5.1 channel/speaker configuration.

Described embodiments of the present invention are directed to techniques and tools for processing audio information in encoding and decoding. In described embodiments, an audio encoder uses several techniques to process audio during encoding. An audio decoder uses several techniques to process audio during decoding. While the techniques are described in places herein as part of a single, integrated system, the techniques can be applied separately, potentially in combination with other techniques. In alternative embodiments, an audio processing tool other than an encoder or decoder implements one or more of the techniques.

In some embodiments, an encoder performs multi-channel pre-processing. For low bitrate coding, for example, the encoder optionally re-matrixes time domain audio samples to artificially increase inter-channel correlation. This makes subsequent compression of the affected channels more efficient by reducing coding complexity. The pre-processing decreases channel separation, but can improve overall quality.

In some embodiments, an encoder and decoder work with multi-channel audio configured into tiles of windows. For example, the encoder partitions frames of multi-channel audio on a per-channel basis, such that each channel can have a window configuration independent of the other channels. The encoder then groups windows of the partitioned channels into tiles for multi-channel transformations. This allows the encoder to isolate transients that appear in a particular channel of a frame with small windows (reducing pre-echo artifacts), but use large windows for frequency resolution and temporal redundancy reduction in other channels of the frame.

In some embodiments, an encoder performs one or more flexible multi-channel transform techniques. A decoder performs the corresponding inverse multi-channel transform techniques. In first techniques, the encoder performs a multi-channel transform after perceptual weighting in the encoder, which reduces leakage of audible quantization noise across channels upon reconstruction. In second techniques, an encoder flexibly groups channels for multi-channel transforms to selectively include channels at different times. In third techniques, an encoder flexibly includes or excludes particular frequencies bands in multi-channel transforms, so as to selectively include compatible bands. In fourth techniques, an encoder reduces the bitrate associated with transform matrices by selectively using pre-defined matrices or using Givens rotations to parameterize custom transform matrices. In fifth techniques, an encoder performs flexible hierarchical multi-channel transforms.

In some embodiments, an encoder performs one or more improved quantization or weighting techniques. A corresponding decoder performs the corresponding inverse quantization or inverse weighting techniques. In first techniques, an encoder computes and applies per-channel quantization step modifiers, which gives the encoder more control over balancing reconstruction quality between channels. In second techniques, an encoder uses a flexible quantization step size for quantization matrix elements, which allows the encoder to change the resolution of the elements of quantization matrices. In third techniques, an encoder uses temporal prediction in compression of quantization matrices to reduce bitrate.

In some embodiments, a decoder performs multi-channel post-processing. For example, the decoder optionally re-matrixes time domain audio samples to create phantom channels at playback, perform special effects, fold down channels for playback on fewer speakers, or for any other purpose.

In the described embodiments, multi-channel audio includes six channels of a standard 5.1 channel/speaker configuration as shown in the matrix (400) of FIG. 4. The "5" channels are the left, right, center, back left, and back right channels, and are conventionally spatially oriented for surround sound. The "1" channel is the sub-woofer or low-frequency effects channel. For the sake of clarity, the order of the channels shown in the matrix (400) is also used for matrices and equations in the rest of the specification. Alternative embodiments use multi-channel audio having a different ordering, number (e.g., 7.1, 9.1, 2), and/or configuration of channels.

In described embodiments, the audio encoder and decoder perform various techniques. Although the operations for these techniques are typically described in a particular, sequential order for the sake of presentation, it should be understood that this manner of description encompasses minor rearrangements in the order of operations, unless a particular ordering is required. For example, operations described sequentially may in some cases be rearranged or performed concurrently. Moreover, for the sake of simplicity, flowcharts typically do not show the various ways in which particular techniques can be used in conjunction with other techniques.

I. Computing Environment

Figure 5:
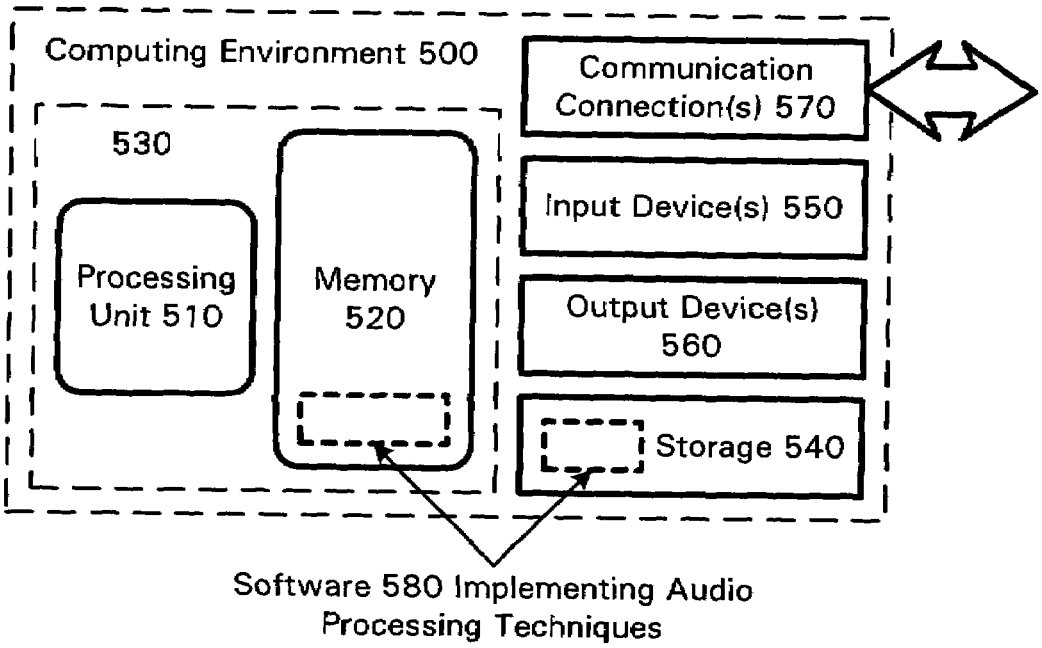
FIG. 5 is a block diagram of a suitable computing environment in which described embodiments may be implemented.

FIG. 5 illustrates a generalized example of a suitable computing environment (500) in which described embodiments may be implemented. The computing environment (500) is not intended to suggest any limitation as to scope of use or functionality of the invention, as the present invention may be implemented in diverse general-purpose or special-purpose computing environments.

With reference to FIG. 5, the computing environment (500) includes at least one processing unit (510) and memory (520). In FIG. 5, this most basic configuration (530) is included within a dashed line. The processing unit (510) executes computer-executable instructions and may be a real or a virtual processor. In a multi-processing system, multiple processing units execute computer-executable instructions to increase processing power. The memory (520) may be volatile memory (e.g., registers, cache, RAM), non-volatile memory (e.g., ROM, EEPROM, flash memory, etc.), or some combination of the two. The memory (520) stores software (580) implementing audio processing techniques according to one or more of the described embodiments.

A computing environment may have additional features. For example, the computing environment (500) includes storage (540), one or more input devices (550), one or more output devices (560), and one or more communication connections (570). An interconnection mechanism (not shown) such as a bus, controller, or network interconnects the components of the computing environment (500). Typically, operating system software (not shown) provides an operating environment for other software executing in the computing environment (500), and coordinates activities of the components of the computing environment (500).

The storage (540) may be removable or non-removable, and includes magnetic disks, magnetic tapes or cassettes, CD-ROMs, CD-RWs, DVDs, or any other medium which can be used to store information and which can be accessed within the computing environment (500). The storage (540) stores instructions for the software (580) implementing audio processing techniques according to one or more of the described embodiments.

The input device(s) (550) may be a touch input device such as a keyboard, mouse, pen, or trackball, a voice input device, a scanning device, network adapter, or another device that provides input to the computing environment (500). For audio, the input device(s) (550) may be a sound card or similar device that accepts audio input in analog or digital form, or a CD-ROM/DVD reader that provides audio samples to the computing environment. The output device(s) (560) may be a display, printer, speaker, CD/DVD-writer, network adapter, or another device that provides output from the computing environment (500).

The communication connection(s) (570) enable communication over a communication medium to another computing entity. The communication medium conveys information such as computer-executable instructions, compressed audio information, or other data in a modulated data signal. A modulated data signal is a signal that has one or more of its characteristics set or changed in such a manner as to encode information in the signal. By way of example, and not limitation, communication media include wired or wireless techniques implemented with an electrical, optical, RF, infrared, acoustic, or other carrier.

The invention can be described in the general context of computer-readable media. Computer-readable media are any available media that can be accessed within a computing environment. By way of example, and not limitation, with the computing environment (500), computer-readable media include memory (520), storage (540), communication media, and combinations of any of the above.

The invention can be described in the general context of computer-executable instructions, such as those included in program modules, being executed in a computing environment on a target real or virtual processor. Generally, program modules include routines, programs, libraries, objects, classes, components, data structures, etc. that perform particular tasks or implement particular abstract data types. The functionality of the program modules may be combined or split between program modules as desired in various embodiments. Computer-executable instructions for program modules may be executed within a local or distributed computing environment.

For the sake of presentation, the detailed description uses terms like "determine," "generate," "adjust," and "apply" to describe computer operations in a computing environment. These terms are high-level abstractions for operations performed by a computer, and should not be confused with acts performed by a human being. The actual computer operations corresponding to these terms vary depending on implementation.

II. Generalized Audio Encoder and Decoder

Figure 6:
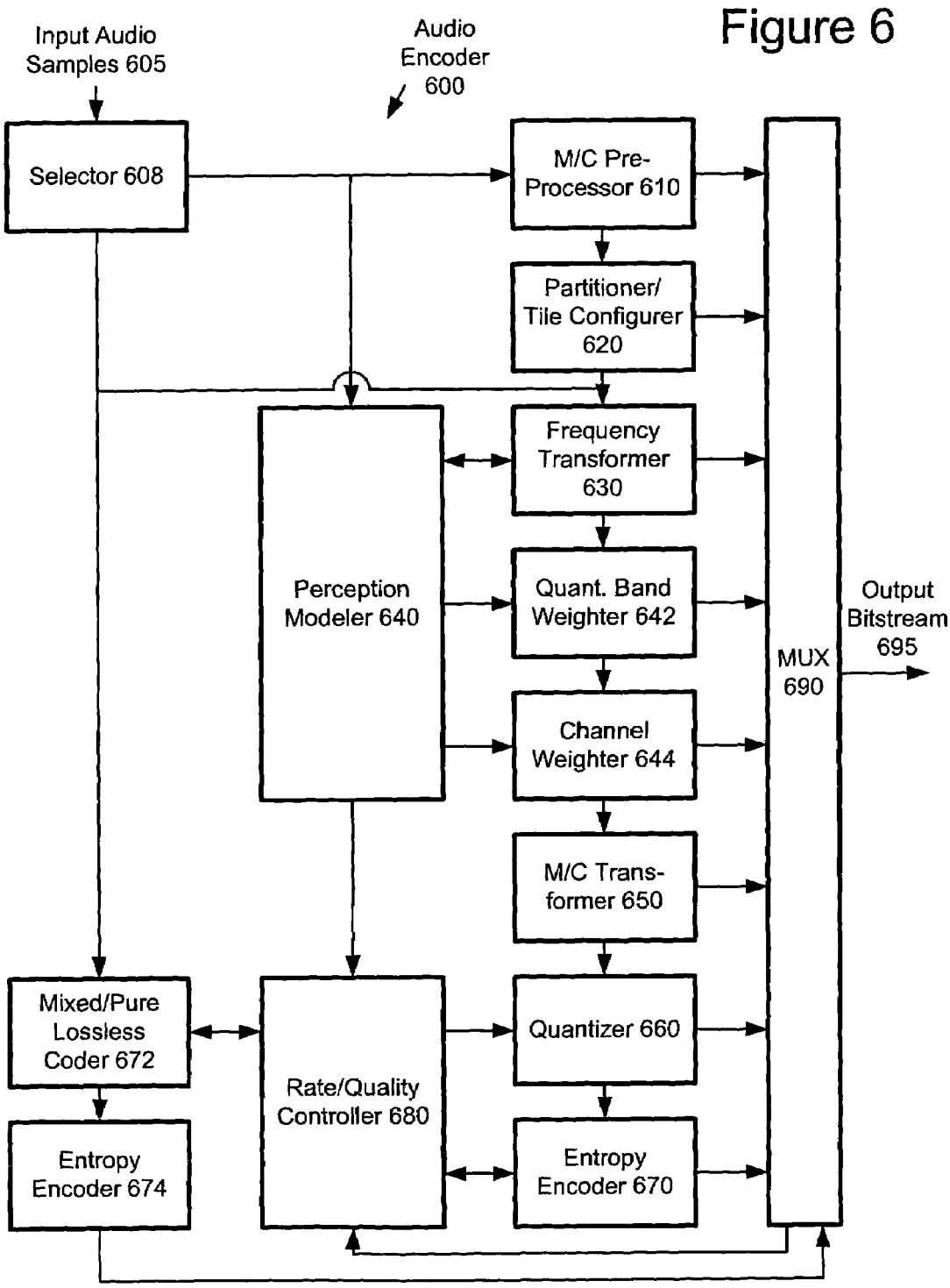
FIG. 6 is a block diagram of an audio encoder in which described embodiments may be implemented.
Figure 7:
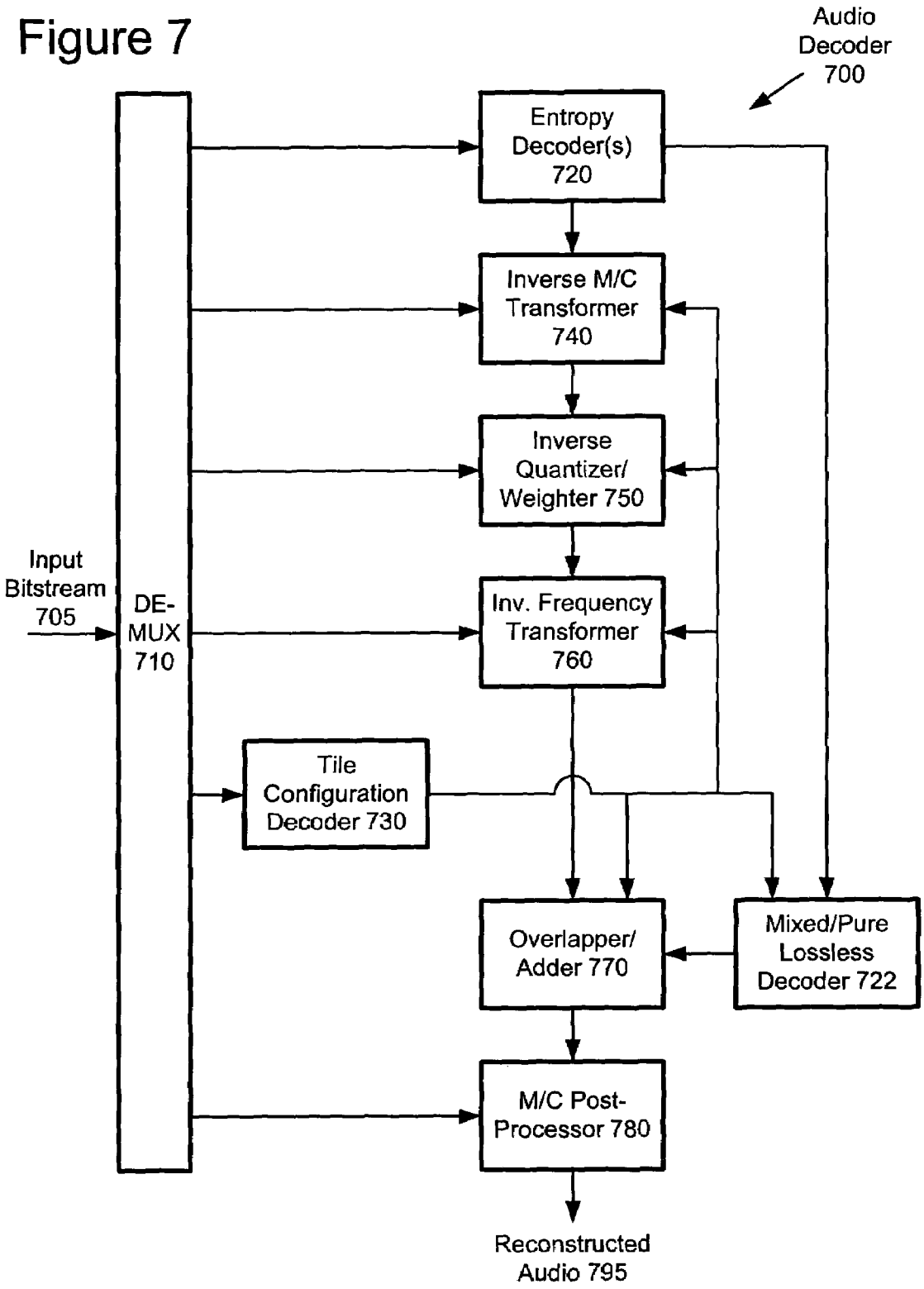
FIG. 7 is a block diagram of an audio decoder in which described embodiments may be implemented.

FIG. 6 is a block diagram of a generalized audio encoder (600) in which described embodiments may be implemented. FIG. 7 is a block diagram of a generalized audio decoder (700) in which described embodiments may be implemented.

The relationships shown between modules within the encoder and decoder indicate flows of information in the encoder and decoder; other relationships are not shown for the sake of simplicity. Depending on implementation and the type of compression desired, modules of the encoder or decoder can be added, omitted, split into multiple modules, combined with other modules, and/or replaced with like modules. In alternative embodiments, encoders or decoders with different modules and/or other configurations process audio data.

A. Generalized Audio Encoder

The generalized audio encoder (600) includes a selector (608), a multi-channel pre-processor (610), a partitioner/tile configurer (620), a frequency transformer (630), a perception modeler (640), a quantization band weighter (642), a channel weighter (644), a multi-channel transformer (650), a quantizer (660), an entropy encoder (670), a controller (680), a mixed/pure lossless coder (672) and associated entropy encoder (674), and a bitstream multiplexer ["MUX"] (690).

The encoder (600) receives a time series of input audio samples (605) at some sampling depth and rate in pulse code modulated ["PCM"] format. For most of the described embodiments, the input audio samples (605) are for multi-channel audio (e.g., stereo, surround), but the input audio samples (605) can instead be mono. The encoder (600) compresses the audio samples (605) and multiplexes information produced by the various modules of the encoder (600) to output a bitstream (695) in a format such as a Windows Media Audio ["WMA"] format or Advanced Streaming Format ["ASF"]. Alternatively, the encoder (600) works with other input and/or output formats.

The selector (608) selects between multiple encoding modes for the audio samples (605). In FIG. 6, the selector (608) switches between a mixed/pure lossless coding mode and a lossy coding mode. The lossless coding mode includes the mixed/pure lossless coder (672) and is typically used for high quality (and high bitrate) compression. The lossy coding mode includes components such as the weighter (642) and quantizer (660) and is typically used for adjustable quality (and controlled bitrate) compression. The selection decision at the selector (608) depends upon user input or other criteria. In certain circumstances (e.g., when lossy compression fails to deliver adequate quality or overproduces bits), the encoder (600) may switch from lossy coding over to mixed/pure lossless coding for a frame or set of frames.

For lossy coding of multi-channel audio data, the multi-channel pre-processor (610) optionally re-matrixes the time-domain audio samples (605). In some embodiments, the multi-channel pre-processor (610) selectively re-matrixes the audio samples (605) to drop one or more coded channels or increase inter-channel correlation in the encoder (600), yet allow reconstruction (in some form) in the decoder (700). This gives the encoder additional control over quality at the channel level. The multi-channel pre-processor (610) may send side information such as instructions for multi-channel post-processing to the MUX (690). For additional detail about the operation of the multi-channel pre-processor in some embodiments, see the section entitled "Multi-Channel Pre-Processing." Alternatively, the encoder (600) performs another form of multi-channel pre-processing.

The partitioner/tile configurer (620) partitions a frame of audio input samples (605) into sub-frame blocks (i.e., windows) with time-varying size and window shaping functions. The sizes and windows for the sub-frame blocks depend upon detection of transient signals in the frame, coding mode, as well as other factors.

If the encoder (600) switches from lossy coding to mixed/pure lossless coding, sub-frame blocks need not overlap or have a windowing function in theory (i.e., non-overlapping, rectangular-window blocks), but transitions between lossy coded frames and other frames may require special treatment. The partitioner/tile configurer (620) outputs blocks of partitioned data to the mixed/pure lossless coder (672) and outputs side information such as block sizes to the MUX (690). For additional detail about partitioning and windowing for mixed or pure losslessly coded frames, see the related application entitled "Unified Lossy and Lossless Audio Compression."

When the encoder (600) uses lossy coding, variable-size windows allow variable temporal resolution. Small blocks allow for greater preservation of time detail at short but active transition segments. Large blocks have better frequency resolution and worse time resolution, and usually allow for greater compression efficiency at longer and less active segments, in part because frame header and side information is proportionally less than in small blocks, and in part because it allows for better redundancy removal. Blocks can overlap to reduce perceptible discontinuities between blocks that could otherwise be introduced by later quantization. The partitioner/tile configurer (620) outputs blocks of partitioned data to the frequency transformer (630) and outputs side information such as block sizes to the MUX (690). For additional information about transient detection and partitioning criteria in some embodiments, see U.S. patent application Ser. No. 10/016,918, entitled "Adaptive Window-Size Selection in Transform Coding," filed Dec. 14, 2001, hereby incorporated by reference. Alternatively, the partitioner/tile configurer (620) uses other partitioning criteria or block sizes when partitioning a frame into windows.

In some embodiments, the partitioner/tile configurer (620) partitions frames of multi-channel audio on a per-channel basis. The partitioner/tile configurer (620) independently partitions each channel in the frame, if quality/bitrate allows. This allows, for example, the partitioner/tile configurer (620) to isolate transients that appear in a particular channel with smaller windows, but use larger windows for frequency resolution or compression efficiency in other channels. This can improve compression efficiency by isolating transients on a per channel basis, but additional information specifying the partitions in individual channels is needed in many cases. Windows of the same size that are co-located in time may qualify for further redundancy reduction through multi-channel transformation. Thus, the partitioner/tile configurer (620) groups windows of the same size that are co-located in time as a tile. For additional detail about tiling in some embodiments, see the section entitled "Tile Configuration."

The frequency transformer (630) receives audio samples and converts them into data in the frequency domain. The frequency transformer (630) outputs blocks of frequency coefficient data to the weighter (642) and outputs side information such as block sizes to the MUX (690). The frequency transformer (630) outputs both the frequency coefficients and the side information to the perception modeler (640). In some embodiments, the frequency transformer (630) applies a time-varying Modulated Lapped Transform ["MLT"] to the sub-frame blocks, which operates like a DCT modulated by the sine window function(s) of the sub-frame blocks. Alternative embodiments use other varieties of MLT, or a DCT or other type of modulated or non-modulated, overlapped or non-overlapped frequency transform, or use subband or wavelet coding.

The perception modeler (640) models properties of the human auditory system to improve the perceived quality of the reconstructed audio signal for a given bitrate. Generally, the perception modeler (640) processes the audio data according to an auditory model, then provides information to the weighter (642) which can be used to generate weighting factors for the audio data. The perception modeler (640) uses any of various auditory models and passes excitation pattern information or other information to the weighter (642).

The quantization band weighter (642) generates weighting factors for quantization matrices based upon the information received from the perception modeler (640) and applies the weighting factors to the data received from the frequency transformer (630). The weighting factors for a quantization matrix include a weight for each of multiple quantization bands in the audio data. The quantization bands can be the same or different in number or position from the critical bands used elsewhere in the encoder (600), and the weighting factors can vary in amplitudes and number of quantization bands from block to block. The quantization band weighter (642) outputs weighted blocks of coefficient data to the channel weighter (644) and outputs side information such as the set of weighting factors to the MUX (690). The set of weighting factors can be compressed for more efficient representation. If the weighting factors are lossy compressed, the reconstructed weighting factors are typically used to weight the blocks of coefficient data. For additional detail about computation and compression of weighting factors in some embodiments, see the section entitled "Quantization and Weighting." Alternatively, the encoder (600) uses another form of weighting or skips weighting.

The channel weighter (644) generates channel-specific weight factors (which are scalars) for channels based on the information received from the perception modeler (640) and also on the quality of locally reconstructed signal. The scalar weights (also called quantization step modifiers) allow the encoder (600) to give the reconstructed channels approximately uniform quality. The channel weight factors can vary in amplitudes from channel to channel and block to block, or at some other level. The channel weighter (644) outputs weighted blocks of coefficient data to the multi-channel transformer (650) and outputs side information such as the set of channel weight factors to the MUX (690). The channel weighter (644) and quantization band weighter (642) in the flow diagram can be swapped or combined together. For additional detail about computation and compression of weighting factors in some embodiments, see the section entitled "Quantization and Weighting." Alternatively, the encoder (600) uses another form of weighting or skips weighting.

For multi-channel audio data, the multiple channels of noise-shaped frequency coefficient data produced by the channel weighter (644) often correlate, so the multi-channel transformer (650) may apply a multi-channel transform. For example, the multi-channel transformer (650) selectively and flexibly applies the multi-channel transform to some but not all of the channels and/or quantization bands in the tile. This gives the multi-channel transformer (650) more precise control over application of the transform to relatively correlated parts of the tile. To reduce computational complexity, the multi-channel transformer (650) may use a hierarchical transform rather than a one-level transform. To reduce the bitrate associated with the transform matrix, the multi-channel transformer (650) selectively uses pre-defined matrices (e.g., identity/no transform, Hadamard, DCT Type II) or custom matrices, and applies efficient compression to the custom matrices. Finally, since the multi-channel transform is downstream from the weighter (642), the perceptibility of noise (e.g., due to subsequent quantization) that leaks between channels after the inverse multi-channel transform in the decoder (700) is controlled by inverse weighting. For additional detail about multi-channel transforms in some embodiments, see the section entitled "Flexible Multi-Channel Transforms." Alternatively, the encoder (600) uses other forms of multi-channel transforms or no transforms at all. The multi-channel transformer (650) produces side information to the MUX (690) indicating, for example, the multi-channel transforms used and multi-channel transformed parts of tiles.

The quantizer (660) quantizes the output of the multi-channel transformer (650), producing quantized coefficient data to the entropy encoder (670) and side information including quantization step sizes to the MUX (690). In FIG. 6, the quantizer (660) is an adaptive, uniform, scalar quantizer that computes a quantization factor per tile. The tile quantization factor can change from one iteration of a quantization loop to the next to affect the bitrate of the entropy encoder (660) output, and the per-channel quantization step modifiers can be used to balance reconstruction quality between channels. For additional detail about quantization in some embodiments, see the section entitled "Quantization and Weighting." In alternative embodiments, the quantizer is a non-uniform quantizer, a vector quantizer, and/or a non-adaptive quantizer, or uses a different form of adaptive, uniform, scalar quantization. In other alternative embodiments, the quantizer (660), quantization band weighter (642), channel weighter (644), and multi-channel transformer (650) are fused and the fused module determines various weights all at once.

The entropy encoder (670) losslessly compresses quantized coefficient data received from the quantizer (660). In some embodiments, the entropy encoder (670) uses adaptive entropy encoding as described in the related application entitled, "Entropy Coding by Adapting Coding Between Level and Run Length/Level Modes." Alternatively, the entropy encoder (670) uses some other form or combination of multi-level run length coding, variable-to-variable length coding, run length coding, Huffman coding, dictionary coding, arithmetic coding, LZ coding, or some other entropy encoding technique. The entropy encoder (670) can compute the number of bits spent encoding audio information and pass this information to the rate/quality controller (680).

The controller (680) works with the quantizer (660) to regulate the bitrate and/or quality of the output of the encoder (600). The controller (680) receives information from other modules of the encoder (600) and processes the received information to determine desired quantization factors given current conditions. The controller (670) outputs the quantization factors to the quantizer (660) with the goal of satisfying quality and/or bitrate constraints.

The mixed/pure lossless encoder (672) and associated entropy encoder (674) compress audio data for the mixed/pure lossless coding mode. The encoder (600) uses the mixed/pure lossless coding mode for an entire sequence or switches between coding modes on a frame-by-frame, block-by-block, tile-by-tile, or other basis. For additional detail about the mixed/pure lossless coding mode, see the related application entitled "Unified Lossy and Lossless Audio Compression." Alternatively, the encoder (600) uses other techniques for mixed and/or pure lossless encoding.

The MUX (690) multiplexes the side information received from the other modules of the audio encoder (600) along with the entropy encoded data received from the entropy encoders (670, 674). The MUX (690) outputs the information in a WMA format or another format that an audio decoder recognizes. The MUX (690) includes a virtual buffer that stores the bitstream (695) to be output by the encoder (600). The virtual buffer then outputs data at a relatively constant bitrate, while quality may change due to complexity changes in the input. The current fullness and other characteristics of the buffer can be used by the controller (680) to regulate quality and/or bitrate. Alternatively, the output bitrate can vary over time, and the quality is kept relatively constant. Or, the output bitrate is only constrained to be less than a particular bitrate, which is either constant or time varying.

B. Generalized Audio Decoder

With reference to FIG. 7, the generalized audio decoder (700) includes a bitstream demultiplexer ["DEMUX"] (710), one or more entropy decoders (720), a mixed/pure lossless decoder (722), a tile configuration decoder (730), an inverse multi-channel transformer (740), a inverse quantizer/weighter (750), an inverse frequency transformer (760), an overlapper/adder (770), and a multi-channel post-processor (780). The decoder (700) is somewhat simpler than the encoder (700) because the decoder (700) does not include modules for rate/quality control or perception modeling.

The decoder (700) receives a bitstream (705) of compressed audio information in a WMA format or another format. The bitstream (705) includes entropy encoded data as well as side information from which the decoder (700) reconstructs audio samples (795).

The DEMUX (710) parses information in the bitstream (705) and sends information to the modules of the decoder (700). The DEMUX (710) includes one or more buffers to compensate for short-term variations in bitrate due to fluctuations in complexity of the audio, network jitter, and/or other factors.

The one or more entropy decoders (720) losslessly decompress entropy codes received from the DEMUX (710). The entropy decoder (720) typically applies the inverse of the entropy encoding technique used in the encoder (600). For the sake of simplicity, one entropy decoder module is shown in FIG. 7, although different entropy decoders may be used for lossy and lossless coding modes, or even within modes. Also, for the sake of simplicity, FIG. 7 does not show mode selection logic. When decoding data compressed in lossy coding mode, the entropy decoder (720) produces quantized frequency coefficient data.

The mixed/pure lossless decoder (722) and associated entropy decoder(s) (720) decompress losslessly encoded audio data for the mixed/pure lossless coding mode. For additional detail about decompression for the mixed/pure lossless decoding mode, see the related application entitled "Unified Lossy and Lossless Audio Compression." Alternatively, decoder (700) uses other techniques for mixed and/or pure lossless decoding.

The tile configuration decoder (730) receives and, if necessary, decodes information indicating the patterns of tiles for frames from the DEMUX (790). The tile pattern information may be entropy encoded or otherwise parameterized. The tile configuration decoder (730) then passes tile pattern information to various other modules of the decoder (700). For additional detail about tile configuration decoding in some embodiments, see the section entitled "Tile Configuration." Alternatively, the decoder (700) uses other techniques to parameterize window patterns in frames.

The inverse multi-channel transformer (740) receives the quantized frequency coefficient data from the entropy decoder (720) as well as tile pattern information from the tile configuration decoder (730) and side information from the DEMUX (710) indicating, for example, the multi-channel transform used and transformed parts of tiles. Using this information, the inverse multi-channel transformer (740) decompresses the transform matrix as necessary, and selectively and flexibly applies one or more inverse multi-channel transforms to the audio data. The placement of the inverse multi-channel transformer (740) relative to the inverse quantizer/weighter (750) helps shape quantization noise that may leak across channels. For additional detail about inverse multi-channel transforms in some embodiments, see the section entitled "Flexible Multi-Channel Transforms."

The inverse quantizer/weighter (750) receives tile and channel quantization factors as well as quantization matrices from the DEMUX (710) and receives quantized frequency coefficient data from the inverse multi-channel transformer (740). The inverse quantizer/weighter (750) decompresses the received quantization factor/matrix information as necessary, then performs the inverse quantization and weighting. For additional detail about inverse quantization and weighting in some embodiments, see the section entitled "Quantization and Weighting. In alternative embodiments, the inverse quantizer/weighter applies the inverse of some other quantization techniques used in the encoder.

The inverse frequency transformer (760) receives the frequency coefficient data output by the inverse quantizer/weighter (750) as well as side information from the DEMUX (710) and tile pattern information from the tile configuration decoder (730). The inverse frequency transformer (770) applies the inverse of the frequency transform used in the encoder and outputs blocks to the overlapper/adder (770).

In addition to receiving tile pattern information from the tile configuration decoder (730), the overlapper/adder (770) receives decoded information from the inverse frequency transformer (760) and/or mixed/pure lossless decoder (722). The overlapper/adder (770) overlaps and adds audio data as necessary and interleaves frames or other sequences of audio data encoded with different modes. For additional detail about overlapping, adding, and interleaving mixed or pure losslessly coded frames, see the related application entitled "Unified Lossy and Lossless Audio Compression." Alternatively, the decoder (700) uses other techniques for overlapping, adding, and interleaving frames.

The multi-channel post-processor (780) optionally re-matrixes the time-domain audio samples output by the overlapper/adder (770). The multi-channel post-processor selectively re-matrixes audio data to create phantom channels for playback, perform special effects such as spatial rotation of channels among speakers, fold down channels for playback on fewer speakers, or for any other purpose. For bitstream-controlled post-processing, the post-processing transform matrices vary over time and are signaled or included in the bitstream (705). For additional detail about the operation of the multi-channel post-processor in some embodiments, see the section entitled "Multi-Channel Post-Processing." Alternatively, the decoder (700) performs another form of multi-channel post-processing.

III. Multi-Channel Pre-Processing

In some embodiments, an encoder such as the encoder (600) of FIG. 6 performs multi-channel pre-processing on input audio samples in the time-domain.

In general, when there are N source audio channels as input, the number of coded channels produced by the encoder is also N. The coded channels may correspond one-to-one with the source channels, or the coded channels may be multi-channel transform-coded channels. When the coding complexity of the source makes compression difficult or when the encoder buffer is full, however, the encoder may alter or drop (i.e., not code) one or more of the original input audio channels. This can be done to reduce coding complexity and improve the overall perceived quality of the audio. For quality-driven pre-processing, the encoder performs the multi-channel pre-processing in reaction to measured audio quality so as to smoothly control overall audio quality and channel separation.

For example, the encoder may alter the multi-channel audio image to make one or more channels less critical so that the channels are dropped at the encoder yet reconstructed at the decoder as "phantom" channels. Outright deletion of channels can have a dramatic effect on quality, so it is done only when coding complexity is very high or the buffer is so full that good quality reproduction cannot be achieved through other means.

The encoder can indicate to the decoder what action to take when the number of coded channels is less than the number of channels for output. Then, a multi-channel post-processing transform can be used in the decoder to create phantom channels, as described below in the section entitled "Multi-Channel Post-Processing." Or, the encoder can signal to the decoder to perform multi-channel post-processing for another purpose.

Figure 8:
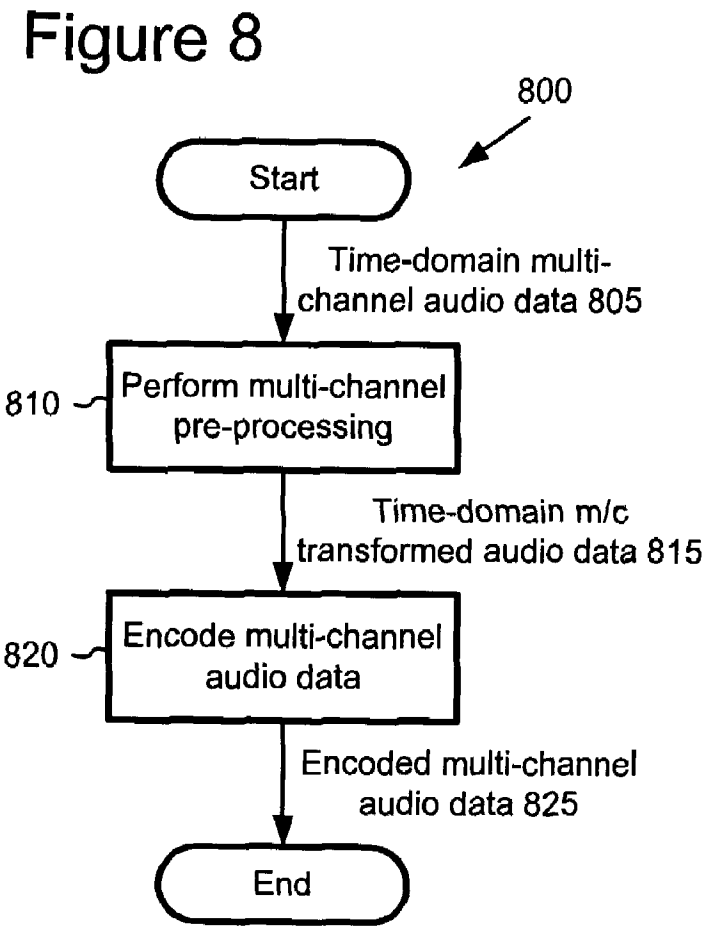
FIG. 8 is a flowchart showing a generalized technique for multi-channel pre-processing.

FIG. 8 shows a generalized technique (800) for multi-channel pre-processing. The encoder performs (810) multi-channel pre-processing on time-domain multi-channel audio data (805), producing transformed audio data (815) in the time domain. For example, the pre-processing involves a general N to N transform, where N is the number of channels. Theencoder multiplies N samples with a matrix A.

$$y_{pre}=A_{pre}x_{pre} \tag{4}$$

where $x_{pre}$ and $y_{pre}$ are the N channel input to and the output from the pre-processing, and $A_{pre}$ is a general NxN transform matrix with real (i.e., continuous) valued elements. The matrix $A_{pre}$ can be chosen to artificially increase the inter-channel correlation in $y_{pre}$ compared to $x_{pre}$. This reduces complexity for the rest of the encoder, but at the cost of lost channel separation.

The output $y_{pre}$ is then fed to the rest of the encoder, which encodes (820) the data using techniques shown in FIG. 6 or other compression techniques, producing encoded multi-channel audio data (825).

The syntax used by the encoder and decoder allows description of general or pre-defined post-processing multi-channel transform matrices, which can vary or be turned on/off on a frame-to-frame basis. The encoder uses this flexibility to limit stereo/surround image impairments, trading off channel separation for better overall quality in certain circumstances by artificially increasing inter-channel correlation. Alternatively, the decoder and encoder use another syntax for multi-channel pre- and post-processing, for example, one that allows changes in transform matrices on a basis other than frame-to-frame.

FIGS. 9*a*-9*e* show multi-channel pre-processing transform matrices (900-904) used to artificially increase inter-channel correlation under certain circumstances in the encoder. The encoder switches between pre-processing matrices to change how much inter-channel correlation is artificially increased between the left, right, and center channels, and between the back left and back right channels, in a 5.1 channel playback environment.

In one implementation, at low bitrates, the encoder evaluates the quality of reconstructed audio over some period of time and, depending on the result, selects one of the pre-processing matrices. The quality measure evaluated by the encoder is Noise to Excitation Ratio ["NER"], which is the ratio of the energy in the noise pattern for a reconstructed audio clip to the energy in the original digital audio clip. Low NER values indicate good quality, and high NER values indicate poor quality. The encoder evaluates the NER for one or more previously encoded frames. For additional information about NER and other quality measures, see U.S. patent application Ser. No. 10/017,861, entitled "Techniques for Measurement of Perceptual Audio Quality," filed Dec. 14, 2001, hereby incorporated by reference. Alternatively, the encoder uses another quality measure, buffer fullness, and/or some other criteria to select a pre-processing transform matrix, or the encoder evaluates a different period of multi-channel audio.

Returning to the examples shown in FIGS. 9*a*-9*e*, at low bitrates, the encoder slowly changes the pre-processing transform matrix based on the NER n of a particular stretch of audio clip. The encoder compares the value of n to threshold values $n_{low}$ and $n_{high}$, which are implementation-dependent. In one implementation, $n_{low}$ and $n_{high}$ have the pre-determined values $n_{low}=0.05$ and $n_{high}=0.1$. Alternatively, $n_{low}$ and $n_{high}$ have different values or values that change over time in reaction to bitrate or other criteria, or the encoder switches between a different number of matrices.

A low value of n (e.g., $n \leqq n_{low}$) indicates good quality coding. So, the encoder uses the identity matrix $A_{low}$ (900) shown in FIG. 9*a*, effectively turning off the pre-processing.

On the other hand, a high value of n (e.g., $n \geqq n_{high}$) indicates poor quality coding. So, the encoder uses the matrix $A_{high,1}$ (902) shown in FIG. 9*c*. The matrix $A_{high,1}$ (902) introduces severe surround image distortion, but at the same time imposes very high correlation between the left, right, and center channels, which improves subsequent coding efficiency by reducing complexity. The multi-channel transformed center channel is the average of the original left, right, and center channels. The matrix $A_{high,1}$ (902) also compromises the channel separation between the rear channels—the input back left and back right channels are averaged.

An intermediate value of n (e.g., $n_{low}<n<n_{high}$) indicates intermediate quality coding. So, the encoder may use the intermediate matrix $A_{int\ er,1}$ (901) shown in FIG. 9*b*. In the intermediate matrix $A_{int\ er,1}$ (901), the factor $\alpha$ measures the relative position of n between $n_{low}$ and $n_{high}$.

$$\alpha = \frac{n - n_{low}}{n_{high} - n_{low}}. \tag{5}$$

The intermediate matrix $A_{int\ er,1}$ (901) gradually transitions from the identity matrix $A_{low}$ (900) to the low quality matrix $A_{high,1}$ (902).

For the matrices $A_{int\ er,1}$ (901) and $A_{high,1}$ (902) shown in FIGS. 9*b* and 9*c*, the encoder later exploits redundancy between the channels for which the encoder artificially increased inter-channel correlation, and the encoder need not instruct the decoder to perform any multi-channel post-processing for those channels.

When the decoder has the ability to perform multi-channel post-processing, the encoder can delegate reconstruction of the center channel to the decoder. If so, when the NER value n indicates poor quality coding, the encoder uses the matrix $A_{high,2}$ (904) shown in 9*e*, with which the input center channel leaks into left and right channels. In the output, the center channel is zero, reducing the coding complexity.

$$\begin{bmatrix} \left(\frac{a}{1.5}+\frac{5\cdot c}{1.5}\right) \\ \left(\frac{b}{1.5}+\frac{.5\cdot c}{1.5}\right) \\ 0 \\ d \\ \frac{e+f}{2} \\ \frac{e+f}{2} \end{bmatrix} = A_{high,2}\cdot\begin{bmatrix} a \\ b \\ c \\ d \\ e \\ f \end{bmatrix}$$

When the encoder uses the pre-processing transform matrix $A_{high,2}$ (904), the encoder (through the bitstream) instructs the decoder to create a phantom center by averaging the decoded left and right channels. Later multi-channel transformations in the encoder may exploit redundancy between the averaged back left and back right channels (without post-processing), or the encoder may instruct the decoder to perform some multi-channel post-processing for the back left and right channels.

When the NER value n indicates intermediate quality coding, the encoder may use the intermediate matrix $A_{int\ er,2}$ (903) shown in FIG. 9*d* to transition between the matrices shown in FIGS. 9*a* and 9*e*.

Figure 10:
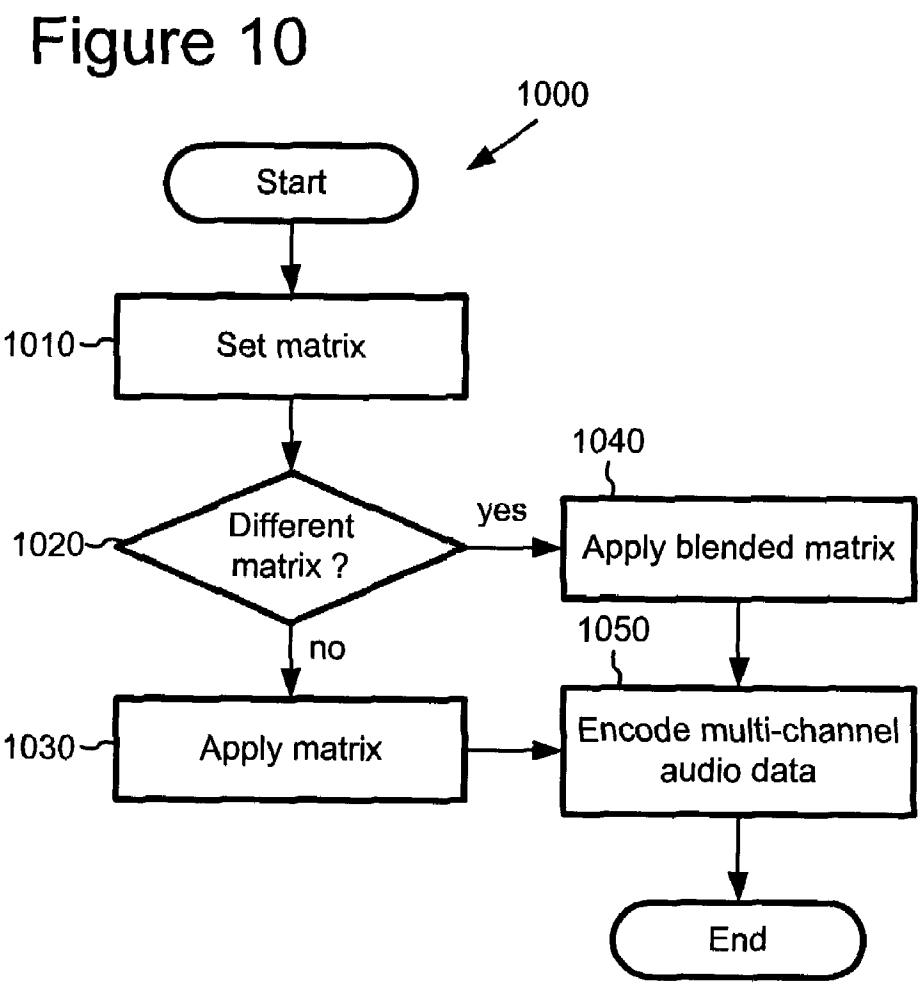
FIG. 10 is a flowchart showing a technique for multi-channel pre-processing in which the transform matrix potentially changes on a frame-by-frame basis.

FIG. 10 shows a technique (1000) for multi-channel pre-processing in which the transform matrix potentially changes on a frame-by-frame basis. Changing the transform matrix can lead to audible noise (e.g., pops) in the final output if not handled carefully. To avoid introducing the popping noise, the encoder gradually transitions from one transform matrix to another between frames.

The encoder first sets (1010) the pre-processing transform matrix, as described above. The encoder then determines (1020) if the matrix for the current frame is the different than the matrix for the previous frame (if there was a previous frame). If the current matrix is the same or there is no previous matrix, the encoder applies (1030) the matrix to the input audio samples for the current frame. Otherwise, the encoder applies (1040) a blended transform matrix to the input audio samples for the current frame. The blending function depends on implementation. In one implementation, at sample i in the current frame, the encoder uses a short-term blended matrix $A_{pre,i}$.

$$A_{pre,i} = \frac{NumSamples - i}{NumSamples} A_{pre,prev} + \frac{i}{NumSamples} A_{pre,current}, \quad (6)$$

where $A_{pre,prev}$ and $A_{pre,current}$ are the pre-processing matrices for the previous and current frames, respectively, and NumSamples is the number of samples in the current frame. Alternatively, the encoder uses another blending function to smooth discontinuities in the pre-processing transform matrices.

Then, the encoder encodes (1050) the multi-channel audio data for the frame, using techniques shown in FIG. 6 or other compression techniques. The encoder repeats the technique (1000) on a frame-by-frame basis. Alternatively, the encoder changes multi-channel pre-processing on some other basis.

IV. Tile Configuration

In some embodiments, an encoder such as the encoder (600) of FIG. 6 groups windows of multi-channel audio into tiles for subsequent encoding. This gives the encoder flexibility to use different window configurations for different channels in a frame, while also allowing multi-channel transforms on various combinations of channels for the frame. A decoder such as the decoder (700) of FIG. 7 works with tiles during decoding.

Each channel can have a window configuration independent of the other channels. Windows that have identical start and stop times are considered to be part of a tile. A tile can have one or more channels, and the encoder performs multi-channel transforms for channels in a tile.

FIG. 11*a* shows an example tile configuration (1100) for a frame of stereo audio. In FIG. 11*a*, each tile includes a single window. No window in either channel of the stereo audio both starts and stops at the same time as a window in the other channel.

Figure 11B:
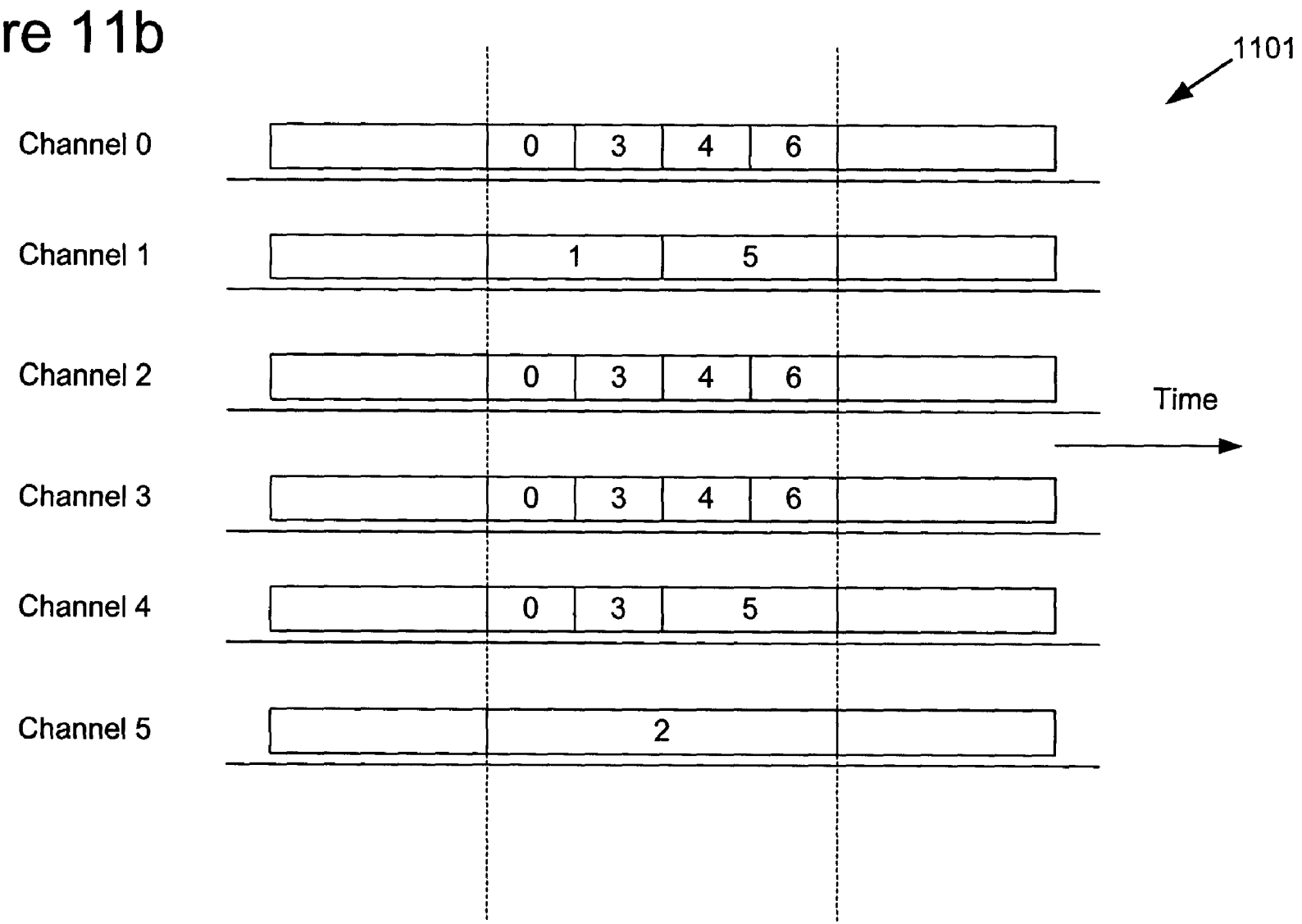

FIG. 11*b* shows an example tile configuration (1101) for a frame of 5.1 channel audio. The tile configuration (1101) includes seven tiles, numbered 0 through 6. Tile 0 includes samples from channels 0, 2, 3, and 4 and spans the first quarter of the frame. Tile 1 includes samples from channel 1 and spans the first half of the frame. Tile 2 includes samples from channel 5 and spans the entire frame. Tile 3 is like tile 0, but spans the second quarter of the frame. Tiles 4 and 6 include samples in channels 0, 2, and 3, and span the third and fourth quarters, respectively, of the frame. Finally, tile 5 includes samples from channels 1 and 4 and spans the last half of the frame. As shown in FIG. 11*b*, a particular tile can include windows in non-contiguous channels.

Figure 12:
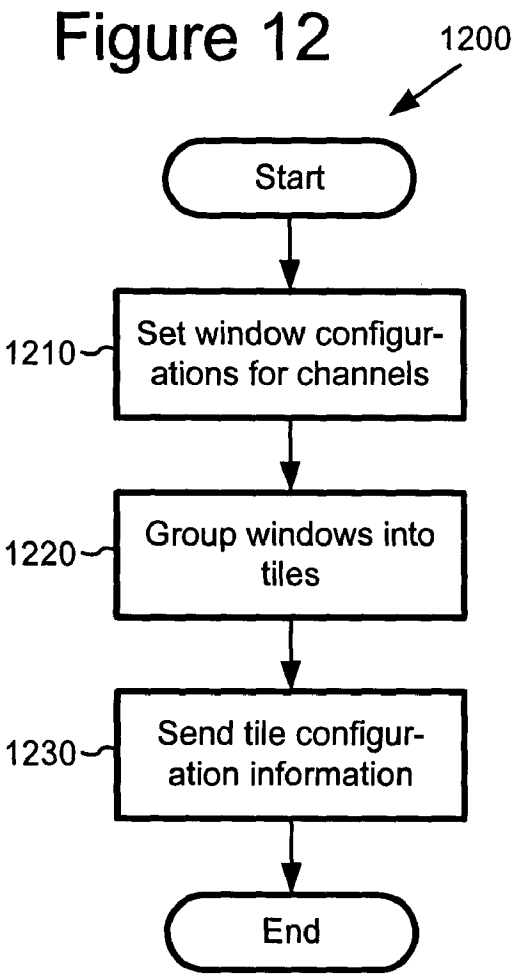
FIG. 12 is a flowchart showing a generalized technique for configuring tiles of multi-channel audio.

FIG. 12 shows a generalized technique (1200) for configuring tiles of a frame of multi-channel audio. The encoder sets (1210) the window configurations for the channels in the frame, partitioning each channel into variable-size windows to trade-off time resolution and frequency resolution. For example, a partitioner/tile configurer of the encoder partitions each channel independently of the other channels in the frame.

The encoder then groups (1220) windows from the different channels into tiles for the frame. For example, the encoder puts windows from different channels into a single tile if the windows have identical start positions and identical end positions. Alternatively, the encoder uses criteria other than or in addition to startlend positions to determine which sections of different channels to group together into a tile.

In one implementation, the encoder performs the tile grouping (1220) after (and independently from) the setting (1210) of the window configurations for a frame. In other implementations, the encoder concurrently sets (1210) window configurations and groups (1220) windows into tiles, for example, to favor time correlation (using longer windows) or channel correlation (putting more channels into single tiles), or to control the number of tiles by coercing windows to fit into a particular set of tiles.

The encoder then sends (1230) tile configuration information for the frame for output with the encoded audio data. For example, the partitioner/tile configurer of the encoder sends tile size and channel member information for the tiles to a MUX. Alternatively, the encoder sends other information specifying the tile configurations. In one implementation, the encoder sends (1230) the tile configuration information after the tile grouping (1220). In other implementations, the encoder performs these actions concurrently.

Figure 13:
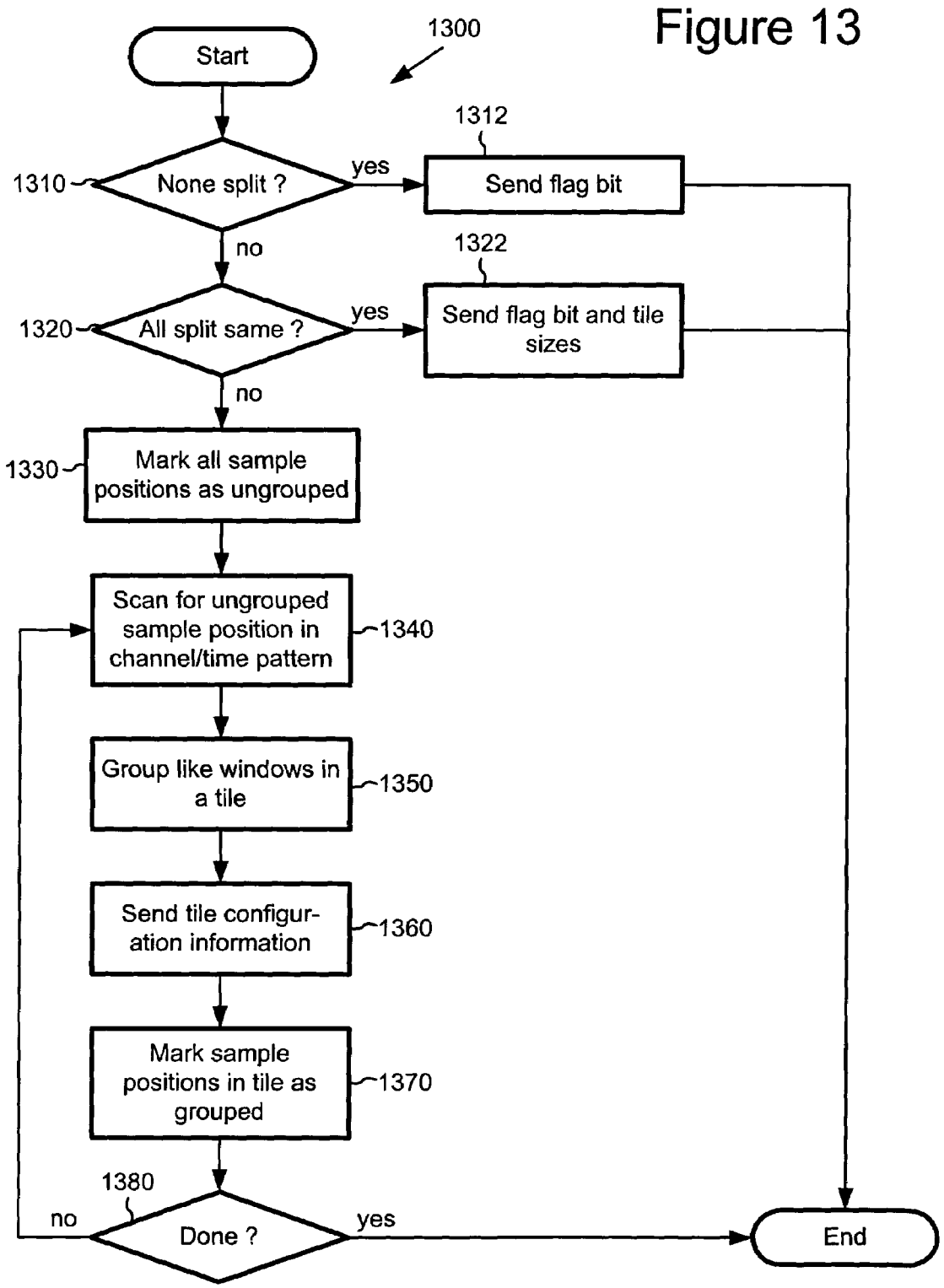
FIG. 13 is a flowchart showing a technique for concurrently configuring tiles and sending tile information for multi-channel audio according to a particular bitstream syntax.

FIG. 13 shows a technique (1300) for configuring tiles and sending tile configuration information for a frame of multi-channel audio according to a particular bitstream syntax. FIG. 13 shows the technique (1300) performed by the encoder to put information into the bitstream; the decoder performs a corresponding technique (reading flags, getting configuration information for particular tiles, etc.) to retrieve tile configuration information for the frame according to the bitstream syntax. Alternatively, the decoder and encoder use another syntax for one or more of the options shown in FIG. 13, for example, one that uses different flags or different ordering.

The encoder initially checks (1310) if none of the channels in the frame are split into windows. If so, the encoder sends (1312) a flag bit (indicating that no channels are split), then exits. Thus, a single bit indicates if a given frame is one single tile or has multiple tiles.

On the other hand, if at least one channel is split into windows, the encoder checks (1320) whether all channels of the frame have the same window configuration. If so, the encoder sends (1322) a flag bit (indicating that all channels have the same window configuration—each tile in the frame has all channels) and a sequence of tile sizes, then exits. Thus, the single bit indicates if the channels all have the same configuration (as in a conventional encoder bitstream) or have a flexible tile configuration.

If at least some channels have different window configurations, the encoder scans through the sample positions of the frame to identify windows that have both the same start position and the same end position. But first, the encoder marks (1330) all sample positions in the frame as ungrouped. The encoder then scans (1340) for the next ungrouped sample position in the frame according to a channel/time scan pattern. In one implementation, the encoder scans through all channels at a particular time looking for ungrouped sample positions, then repeats for the next sample position in time, etc. In other implementations, the encoder uses another scan pattern.

For the detected ungrouped sample position, the encoder groups (1350) like windows together in a tile. In particular, the encoder groups windows that start at the start position of the window including the detected ungrouped sample position, and that also end at the same position as the window including the detected ungrouped sample position. In the frame shown in FIG. 11*b*, for example, the encoder would first detect the sample position at the beginning of channel 0. The encoder would group the quarter-frame length windows from channels 0, 2, 3, and 4 together in a tile since these windows each have the same start position and same end position as the other windows in the tile.

The encoder then sends (1360) tile configuration information specifying the tile for output with the encoded audio data. The tile configuration information includes the tile size and a map indicating which channels with ungrouped sample positions in the frame at that point are in the tile. The channel map includes one bit per channel possible for the tile. Based on the sequence of tile information, the decoder determines where a tile starts and ends in a frame. The encoder reduces bitrate for the channel map by taking into account which channels can be present in the tile. For example, the information for tile 0 in FIG. 11*b* includes the tile size and a binary pattern "101110" to indicate that channels 0, 2, 3, and 4 are part of the tile. After that point, only sample positions in channels 1 and 5 are ungrouped. So, the information for tile 1 includes the tile size and the binary pattern "10" to indicate that channel 1 is part of the tile but channel 5 is not. This saves four bits in the binary pattern. The tile information for tile 2 then includes only the tile size (and not the channel map), since channel 5 is the only channel that can have a window starting in tile 2. The tile information for tile 3 includes the tile size and the binary pattern "1111" since the channels 1 and 5 have grouped positions in the range for tile 3. Alternatively, the encoder and decoder use another technique to signal channel patterns in the syntax.

The encoder then marks (1370) the sample positions for the windows in the tile as grouped and determines (1380) whether to continue or not. If there are no more ungrouped sample positions in the frame, the encoder exits. Otherwise, the encoder scans (1340) for the next ungrouped sample position in the frame according to the channel/time scan pattern.

V. Flexibl Multi-Channel Transforms

In some embodiments, an encoder such as the encoder (600) of FIG. 6 performs flexible multi-channel transforms that effectively take advantage of inter-channel correlation. A decoder such as the decoder (700) of FIG. 7 performs corresponding inverse multi-channel transforms.

Specifically, the encoder and decoder do one or more of the following to improve multi-channel transformations in different situations.

1. The encoder performs the multi-channel transform after perceptual weighting, and the decoder performs the corresponding inverse multi-channel transform before inverse weighting. This reduces unmasking of quantization noise across channels after the inverse multi-channel transform.
2. The encoder and decoder group channels for multi-channel transforms to limit which channels get transformed together.
3. The encoder and decoder selectively turn multi-channel transforms on/off at the frequency band level to control which bands are transformed together.
4. The encoder and decoder use hierarchical multi-channel transforms to limit computational complexity (especially in the decoder).
5. The encoder and decoder use pre-defined multi-channel transform matrices to reduce the bitrate used to specify the transform matrices.
6. The encoder and decoder use quantized Givens rotation-based factorization parameters to specify multi-channel transform matrices for bit efficiency.

A. Multi-Channel Transform on Weighted Multi-Channel Audio

In some embodiments, the encoder positions the multi-channel transform after perceptual weighting (and the decoder positions the inverse multi-channel transform before the inverse weighting) such that the cross-channel leaked signal is controlled, measurable, and has a spectrum like the original signal.

Figure 14:
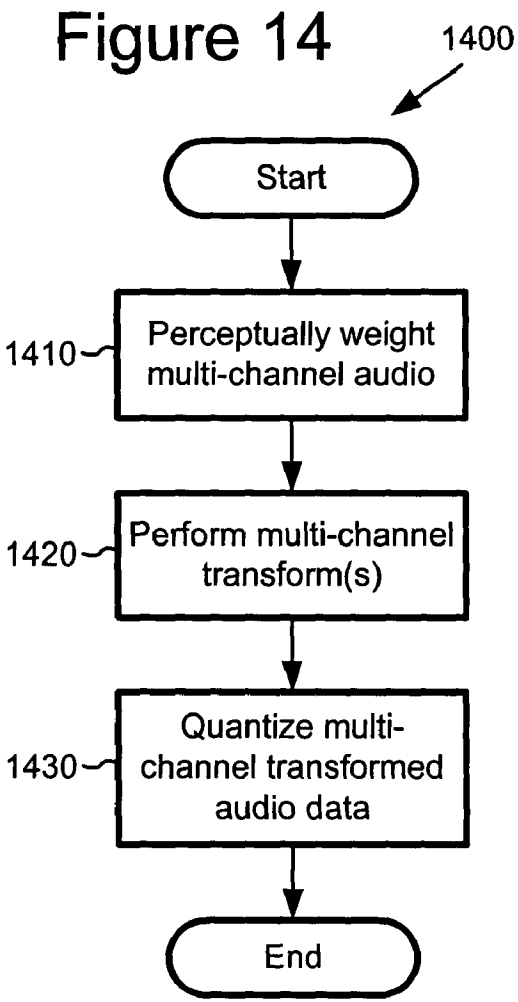
FIG. 14 is a flowchart showing a generalized technique for performing a multi-channel transform after perceptual weighting.

FIG. 14 shows a technique (1400) for performing one or more multi-channel transforms after perceptual weighting in the encoder. The encoder perceptually weights (1410) multi-channel audio, for example, applying weighting factors to multi-channel audio in the frequency domain. In some implementations, the encoder applies both weighting factors and per-channel quantization step modifiers to the multi-channel audio data before the multi-channel transform(s).

The encoder then performs (1420) one or more multi-channel transforms on the weighted audio data, for example, as described below. Finally, the encoder quantizes (1430) the multi-channel transformed audio data.

Figure 15:
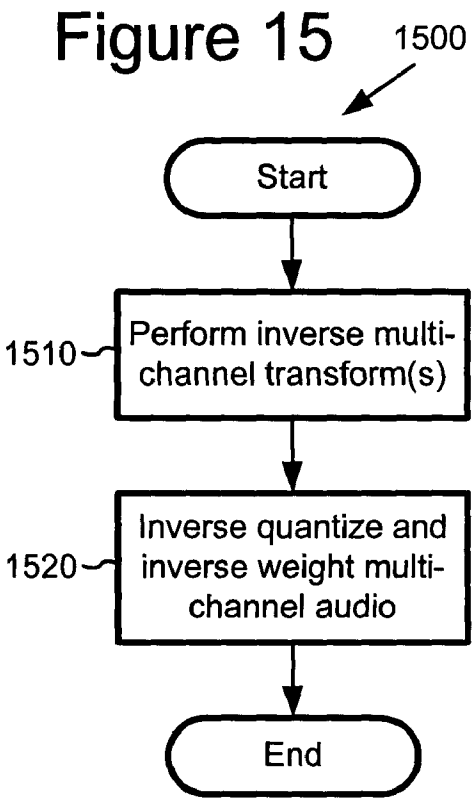
FIG. 15 is a flowchart showing a generalized technique for performing an inverse multi-channel transform before inverse perceptual weighting.

FIG. 15 shows a technique (1500) for performing an inverse-multi-channel transform before inverse weighting in the decoder. The decoder performs (1510) one or more inverse multi-channel transforms on quantized audio data, for example, as described below. In particular, the decoder collects samples from multiple channels at a particular frequency index into a vector $x_{mc}$ and performs the inverse multi-channel transform $A_{mc}$ to generate the output $y_{mc}$.

$$y_{mc}=A_{mc}\cdot x_{mc} \quad (7).$$

Subsequently, the decoder inverse quantizes and inverse weights (1520) the multi-channel audio, coloring the output of the inverse multi-channel transform with mask(s). Thus, leakage that occurs across channels (due to quantization) is spectrally shaped so that the leaked signal's audibility is measurable and controllable, and the leakage of other channels in a given reconstructed channel is spectrally shaped like the original uncorrupted signal of the given channel. (In some implementations, per-channel quantization step modifiers also allow the encoder to make reconstructed signal quality approximately the same across all reconstructed channels.)

B. Channel Groups

In some embodiments, the encoder and decoder group channels for multi-channel transforms to limit which channels get transformed together. For example, in embodiments that use tile configuration, the encoder determines which channels within a tile correlate and groups the correlated channels. Alternatively, an encoder and decoder do not use tile configuration, but still group channels for frames or at some other level.

Figure 16:
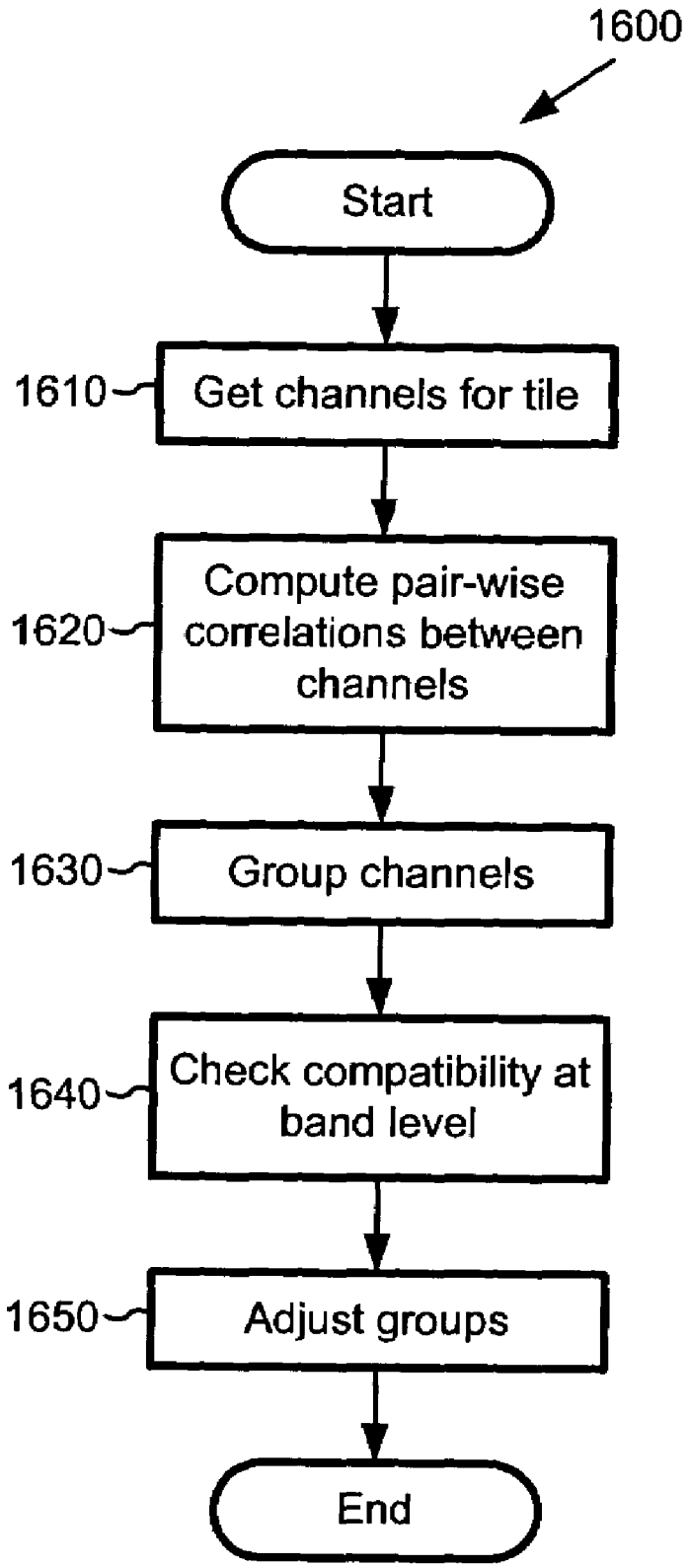
FIG. 16 is a flowchart showing a technique for grouping channels in a tile for multi-channel transformation in one implementation.

FIG. 16 shows a technique (1600) for grouping channels of a tile for multi-channel transformation in one implementation. In the technique (1600), the encoder considers pair-wise correlations between the signals of channels as well as correlations between bands in some cases. Alternatively, an encoder considers other and/or additional factors when grouping channels for multi-channel transformation.

First, the encoder gets (1610) the channels for a tile. For example, in the tile configuration shown in FIG. 11*b*, tile 3 has four channels in it: 0, 2, 3, and 4.

The encoder computes (1620) pair-wise correlations between the signals in channels, and then groups (1630) channels accordingly. Suppose that for tile 3 of FIG. 11*b*, channels 0 and 2 are pair-wise correlated, but neither of those channels is pair-wise correlated with channel 3 or channel 4, and channel 3 is not pair-wise correlated with channel 4. The encoder groups (1630) channels 0 and 2 together, puts channel 3 in a separate group, and puts channel 4 in still another group.

A channel that is not pair-wise correlated with any of the channels in a group may still be compatible with that group. So, for the channels that are incompatible with a group, the encoder optionally checks (1640) compatibility at band level and adjusts (1650) the one or more groups of channels accordingly. In particular, this identifies channels that are compatible with a group in some bands, but incompatible in some other bands. For example, suppose that channel 4 of tile 3 in FIG. 11*b* is actually compatible with channels 0 and 2 at most bands, but that incompatibility in a few bands skews the pair-wise correlation results. The encoder adjusts (1650) the groups to put channels 0, 2, and 4 together, leaving channel 3 in its own group. The encoder may also perform such testing when some channels are "overall" correlated, but have incompatible bands. Turning off the transform at those incompatible bands improves the correlation among the bands that actually get multi-channel transform coded, and hence improves coding efficiency.

A channel in a given tile belongs to one channel group. The channels in a channel group need not be contiguous. A single tile may include multiple channel groups, and each channel group may have a different associated multi-channel transform. After deciding which channels are compatible, the encoder puts channel group information into the bitstream.

Figure 17:
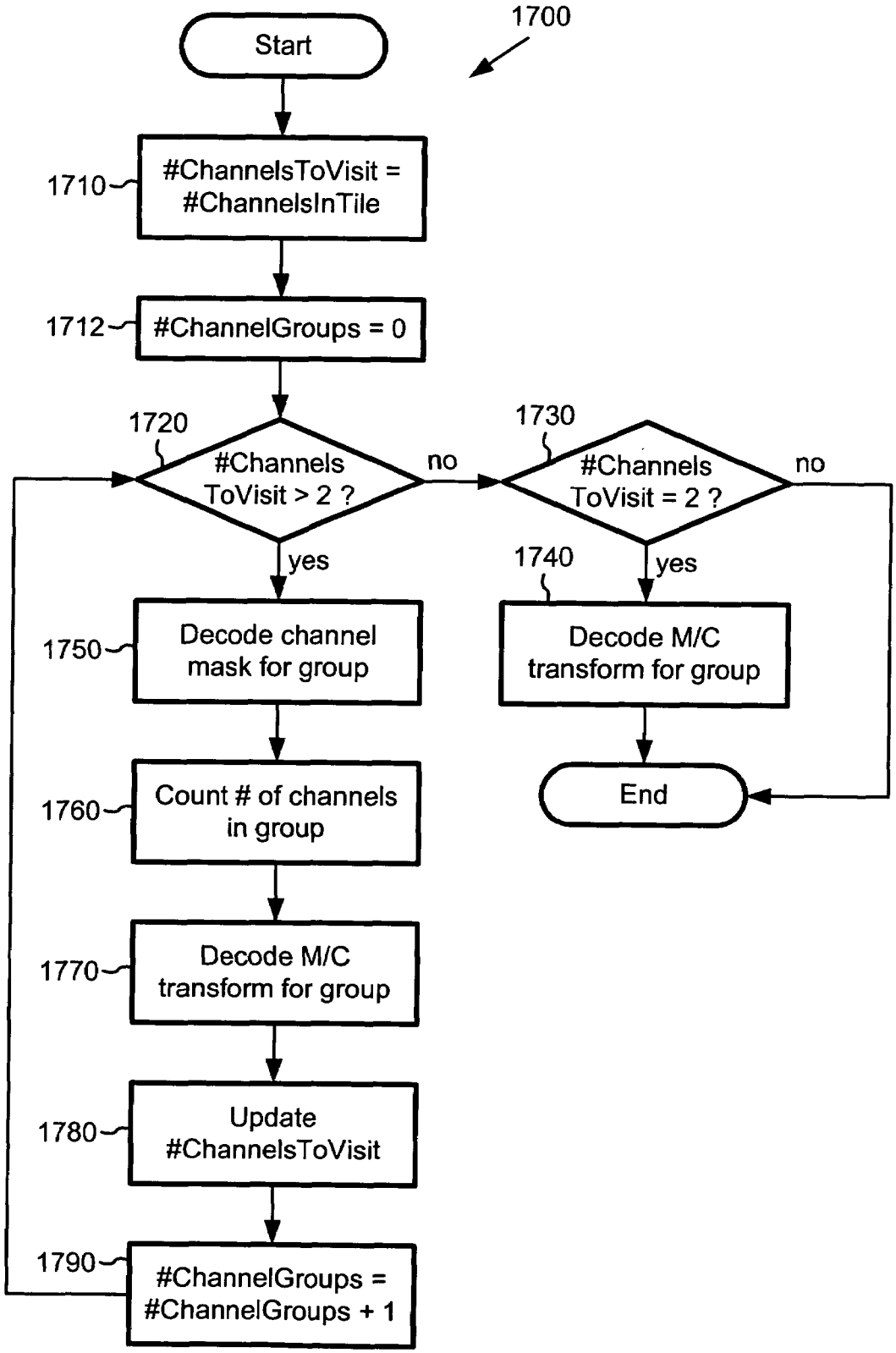
FIG. 17 is a flowchart showing a technique for retrieving channel group information and multi-channel transform information for a tile from a bitstream according to a particular bitstream syntax.

FIG. 17 shows a technique (1700) for retrieving channel group information and multi-channel transform information for a tile from a bitstream according to a particular bitstream syntax, irrespective of how the encoder computes channel groups. FIG. 17 shows the technique (1700) performed by the decoder to retrieve information from the bitstream; the encoder performs a corresponding technique to format channel group information and multi-channel transform information for the tile according to the bitstream syntax. Alternatively, the decoder and encoder use another syntax for one or more of the options shown in FIG. 17.

First, the decoder initializes several variables used in the technique (1700). The decoder sets (1710) #ChannelsToVisit equal to the number of channels in the tile #ChannelsInTile and sets (1712) the number of channel groups #ChannelGroups to 0.

The decoder checks (1720) whether #ChannelsToVisit is greater than 2. If not, the decoder checks (1730) whether #ChannelsToVisit equals 2. If so, the decoder decodes (1740) the multi-channel transform for the group of two channels, for example, using a technique described below. The syntax allows each channel group to have a different multi-channel transform. On the other hand, if #ChannelsToVisit equal 1 or 0, the decoder exits without decoding a multi-channel transform.

If #ChannelsToVisit is greater than 2, the decoder decodes (1750) the channel mask for a group in the tile. Specifically, the decoder reads #ChannelsToVisit bits from the bitstream for the channel mask. Each bit in the channel mask indicates whether a particular channel is or is not in the channel group. For example, if the channel mask is "10110" then the tile includes 5 channels, and channels 0, 2, and 3 are in the channel group.

The decoder then counts (1760) the number of channels in the group and decodes (1770) the multi-channel transform for the group, for example, using a technique described below. The decoder updates (1780) #ChannelsToVisit by subtracting the counted number of channels in the current channel group, increments (1790) #ChannelGroups, and checks (1720) whether the number of channels left to visit #ChannelsToVisit is greater than 2.

Alternatively, in embodiments that do not use tile configurations, the decoder retrieves channel group information and multi-channel transform information for a frame or at some other level.

C. Band On/Off Control for Multi-Channel Transform

In some embodiments, the encoder and decoder selectively turn multi-channel transforms on/off at the frequency band level to control which bands are transformed together. In this way, the encoder and decoder selectively exclude bands that are not compatible in multi-channel transforms. When the multi-channel transform is turned off for a particular band, the encoder and decoder uses the identity transform for that band, passing through the data at that band without altering it.

The frequency bands are critical bands or quantization bands. The number of frequency bands relates to the sampling frequency of the audio data and the tile size. In general, the higher the sampling frequency or larger the tile size, the greater the number of frequency bands.

In some implementations, the encoder selectively turns multi-channel transforms on/off at the frequency band level for channels of a channel group of a tile. The encoder can turn bands on/off as the encoder groups channels for a tile or after the channel grouping for the tile. Alternatively, an encoder and decoder do not use tile configuration, but still turn multi-channel transforms on/off at frequency bands for a frame or at some other level.

Figure 18:
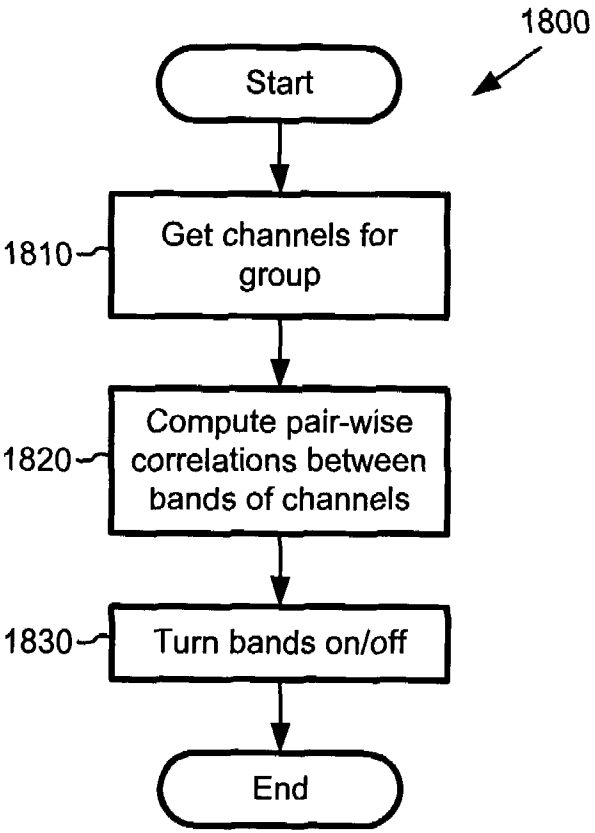
FIG. 18 is a flowchart showing a technique for selectively including frequency bands of a channel group in a multi-channel transform in one implementation.

FIG. 18 shows a technique (1800) for selectively including frequency bands of channels of a channel group in a multi-channel transform in one implementation. In the technique (1800), the encoder considers pair-wise correlations between the signals of the channels at a band to determine whether to enable or disable the multi-channel transform for the band. Alternatively, an encoder considers other and/or additional factors when selectively turning frequency bands on or off for a multi-channel transform.

First, the encoder gets (1810) the channels for a channel group, for example, as described with reference to FIG. 16. The encoder then computes (1820) pair-wise correlations between the signals in the channels for different frequency bands. For example, if the channel group includes two channels, the encoder computes a pair-wise correlation at each frequency band. Or, if the channel group includes more than two channels, the encoder computes pair-wise correlations between some or all of the respective channel pairs at each frequency band.

The encoder then turns (1830) bands on or off for the multi-channel transform for the channel group. For example, if the channel group includes two channels, the encoder enables the multi-channel transform for a band if the pair-wise correlation at the band satisfies a particular threshold. Or, if the channel group includes more than two channels, the encoder enables the multi-channel transform for a band if each or a majority of the pair-wise correlations at the band satisfies a particular threshold. In alternative embodiments, instead of turning a particular frequency band on or off for all channels, the encoder turns the band on for some channels and off for other channels.

After deciding which bands are included in multi-channel transforms, the encoder puts band on/off information into the bitstream.

Figure 19:
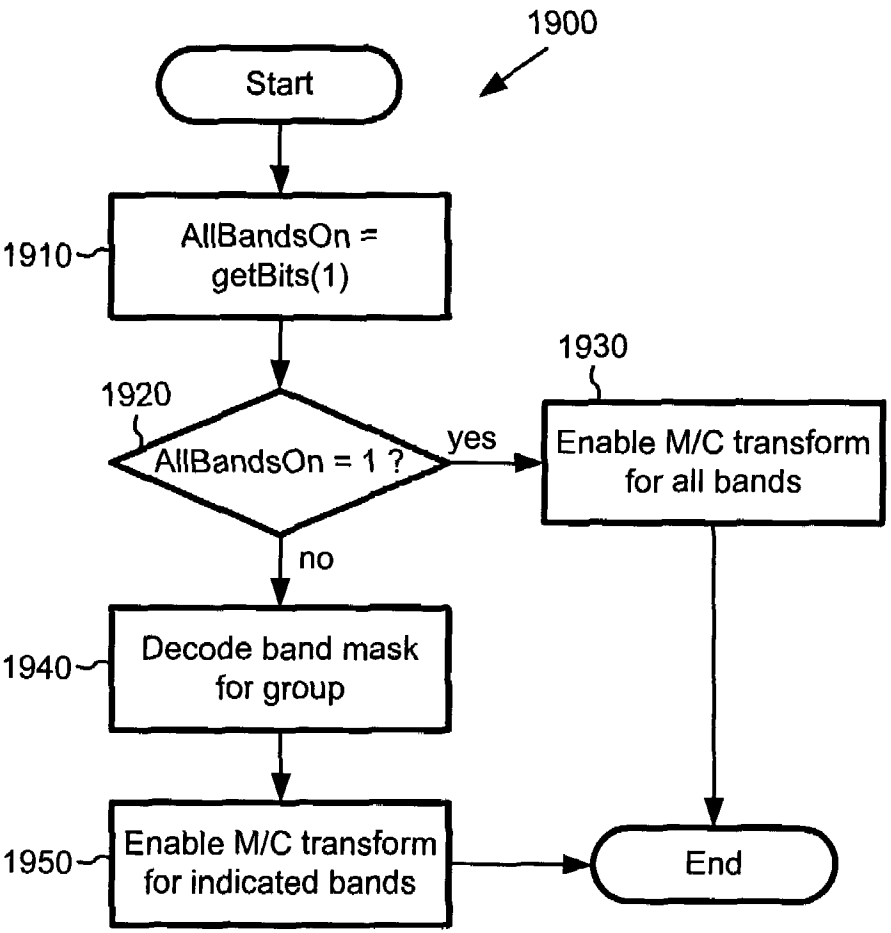
FIG. 19 is a flowchart showing a technique for retrieving band on/off information for a multi-channel transform for a channel group of a tile from a bitstream according to a particular bitstream syntax.

FIG. 19 shows a technique (1900) for retrieving band on/off information for a multi-channel transform for a channel group of a tile from a bitstream according to a particular bitstream syntax, irrespective of how the encoder decides whether to turn bands on or off. FIG. 19 shows the technique (1900) performed by the decoder to retrieve information from the bitstream; the encoder performs a corresponding technique to format band on/off information for the channel group according to the bitstream syntax. Alternatively, the decoder and encoder use another syntax for one or more of the options shown in FIG. 19.

In some implementations, the decoder performs the technique (1900) as part of the decoding of the multi-channel transform (1740 or 1770) of the technique (1700). Alternatively, the decoder performs the technique (1900) separately.

The decoder gets (1910) a bit and checks (1920) the bit to determine whether all bands are enabled for the channel group. If so, the decoder enables (1930) the multi-channel transform for all bands of the channel group.

On the other hand, if the bit indicates all bands are not enabled for the channel group, the decoder decodes (1940) the band mask for the channel group. Specifically, the decoder reads a number of bits from bitstream, where the number is the number of bands for the channel group. Each bit in the band mask indicates whether a particular band is on or off for the channel group. For example, if the band mask is "11111110110000" then the channel group includes 15 bands, and bands 0, 1, 2, 3, 4, 5, 6, 7, 9, and 10 are turned on for the multi-channel transform. The decoder then enables (1950) the multi-channel transform for the indicated bands.

Alternatively, in embodiments that do not use tile configurations, the decoder retrieves band on/off information for a frame or at some other level.

D. Hierarchical Multi-Channel Transforms

In some embodiments, the encoder and decoder use hierarchical multi-channel transforms to limit computational complexity, especially in the decoder. With the hierarchical transform, an encoder splits an overall transformation into multiple stages, reducing the computational complexity of individual stages and in some cases reducing the amount of information needed to specify the multi-channel transform(s). Using this cascaded structure, the encoder emulates the larger overall transform with smaller transforms, up to some accuracy. The decoder performs a corresponding hierarchical inverse transform.

In some implementations, each stage of the hierarchical transform is identical in structure and, in the bitstream, each stage is described independent of the one or more other stages. In particular, each stage has its own channel groups and one multi-channel transform matrix per channel group. In alternative implementations, different stages have different structures, the encoder and decoder use a different bitstream syntax, and/or the stages use another configuration for channels and transforms.

Figure 20:
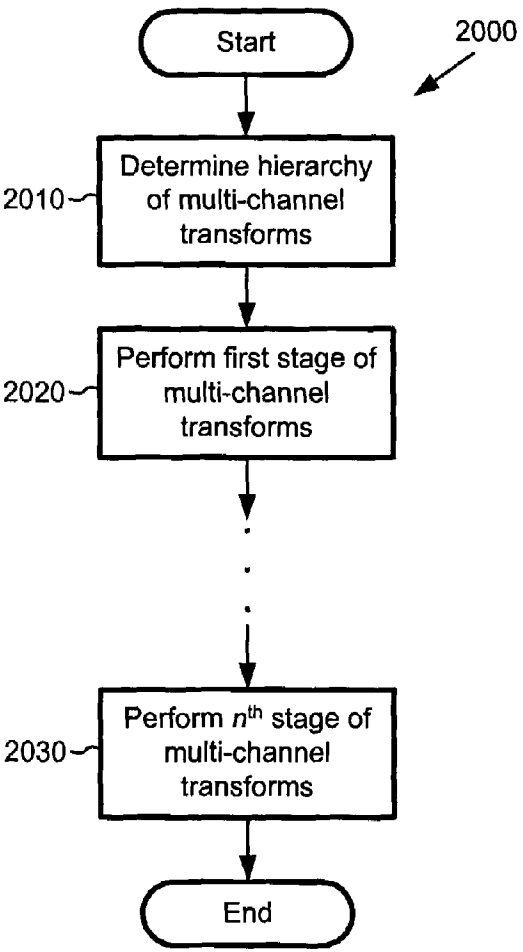
FIG. 20 is a flowchart showing a generalized technique for emulating a multi-channel transform using a hierarchy of simpler multi-channel transforms.

FIG. 20 shows a generalized technique (2000) for emulating a multi-channel transform using a hierarchy of simpler multi-channel transforms. FIG. 20 shows an n stage hierarchy, where n is the number of multi-channel transform stages. For example, in one implementation, n is 2. Alternatively, n is more than 2.

The encoder determines (2010) a hierarchy of multi-channel transforms for an overall transform. The encoder decides the transform sizes (i.e., channel group size) based on the complexity of the decoder that will perform the inverse transforms. Or the encoder considers target decoder profile/decoder level or some other criteria.

Figure 21:
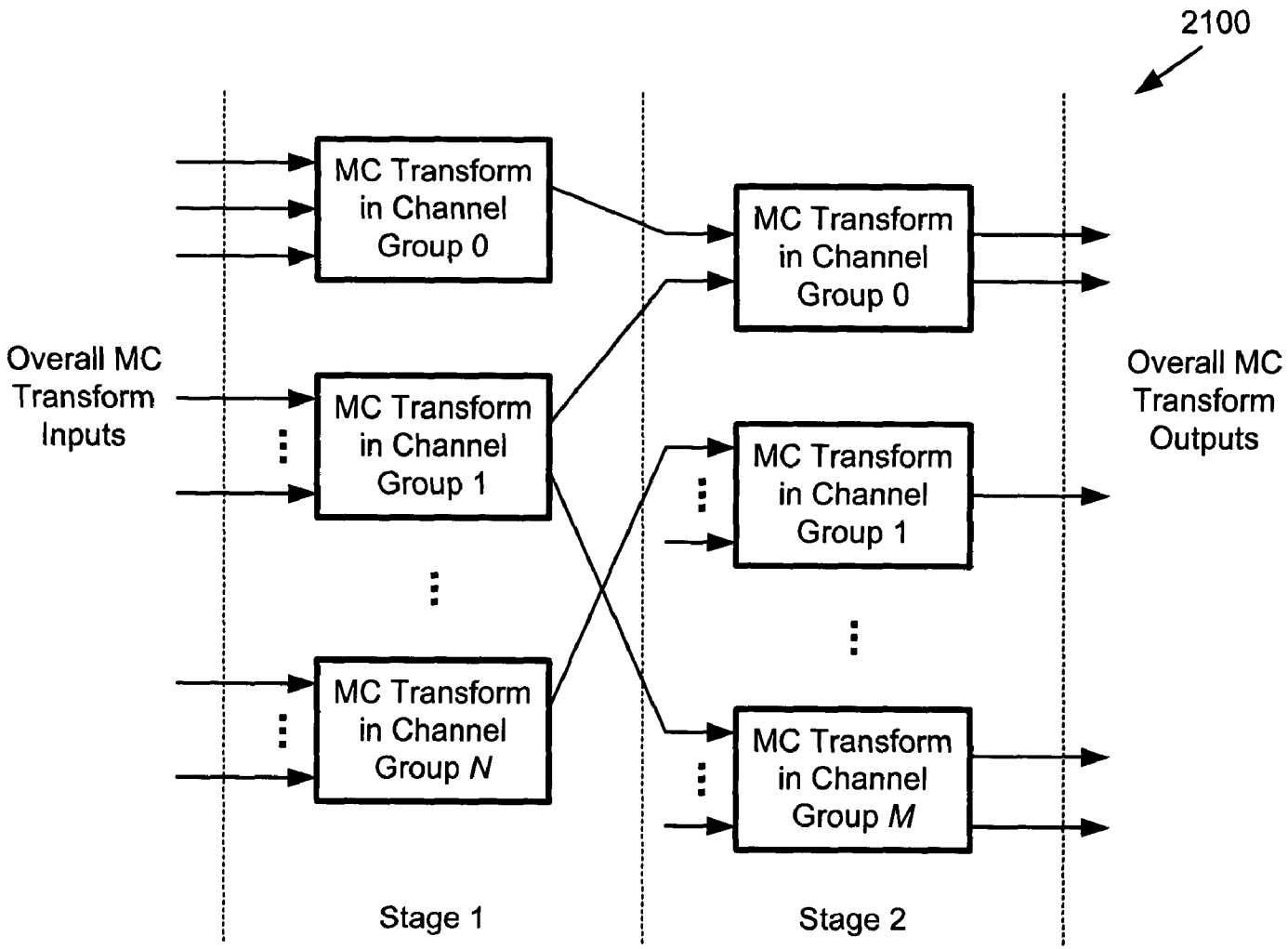
FIG. 21 is a chart showing an example hierarchy of multi-channel transforms.

FIG. 21 is a chart showing an example hierarchy (2100) of multi-channel transforms. The hierarchy (2100) includes 2 stages. The first stage includes N+1 channel groups and transforms, numbered from 0 to N; the second stage includes M+1 channel groups and transforms, numbered from 0 to M. Each channel group includes 1 or more channels. For each of the N+1 transforms of the first stage, the input channels are some combination of the channels input to the multi-channel transformer. Not all input channels must be transformed in the first stage. One or more input channels may pass through the first stage unaltered (e.g., the encoder may include such channels in an channel group that uses an identity matrix.) For each of the M+1 transforms of the second stage, the input channels are some combination of the output channels from the first stage, including channels that may have passed through the first stage unaltered.

Returning to FIG. 20, the encoder performs (2020) the first stage of multi-channel transforms, performs the next stage of multi-channel transforms, finally performing (2030) the $n^{th}$ stage of multi-channel transforms. A decoder performs corresponding inverse multi-channel transforms during decoding.

In some implementations, the channel groups are the same at multiple stages of the hierarchy, but the multi-channel transforms are different. In such cases, and in certain other cases as well, the encoder may combine frequency band on/off information for the multiple multi-channel transforms. For example, suppose there are two multi-channel transforms and the same three channels in the channel group for each. The encoder may specify no transform/identity transform at both stages for band 0, only multi-channel transform stage 1 for band 1 (no stage 2 transform), only multi-channel transform stage 2 for band 2 (no stage 1 transform), both stages of multi-channel transforms for band 3, no transform at both stages for band 4, etc.

Figure 22:
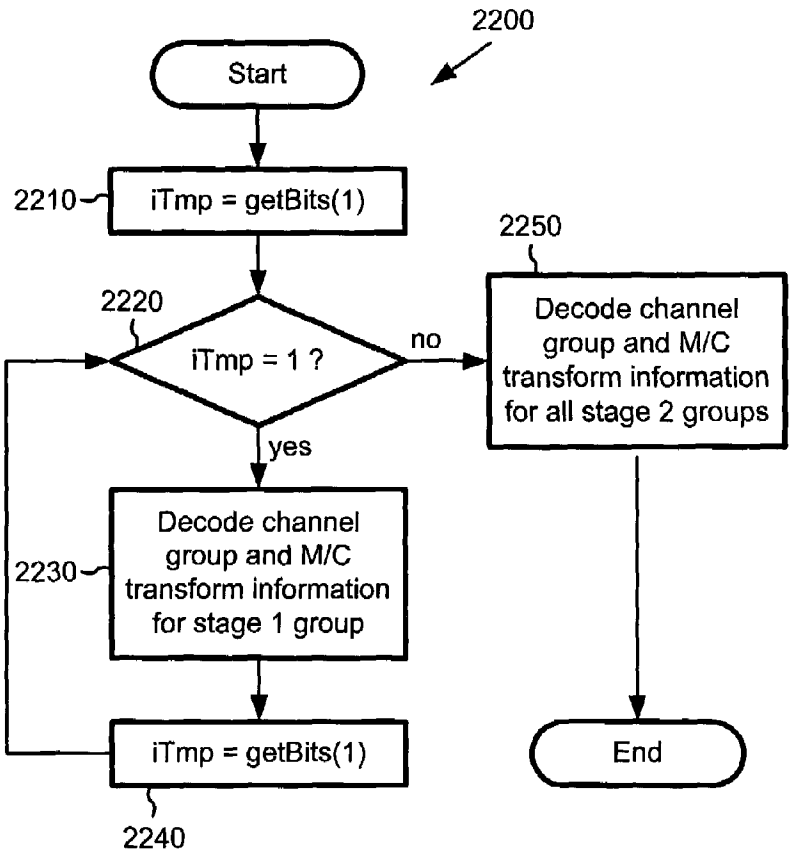
FIG. 22 is a flowchart showing a technique for retrieving information for a hierarchy of multi-channel transforms for channel groups from a bitstream according to a particular bitstream syntax.

FIG. 22 shows a technique (2200) for retrieving information for a hierarchy of multi-channel transforms for channel groups from a bitstream according to a particular bitstream syntax. FIG. 22 shows the technique (2200) performed by the decoder to parse the bitstream; the encoder performs a corresponding technique to format the hierarchy of multi-channel transforms according to the bitstream syntax. Alternatively, the decoder and encoder use another syntax, for example, one that includes additional flags and signaling bits for more than two stages.

The decoder first sets (2210) a temporary value iTmp equal to the next bit in the bitstream. The decoder then checks (2220) the value of the temporary value, which signals whether or not the decoder should decode (2230) channel group and multi-channel transform information for a stage 1 group.

After the decoder decodes (2230) channel group and multi-channel transform information for a stage 1 group, the decoder sets (2240) iTmp equal to the next bit in the bitstream. The decoder again checks (2220) the value of iTmp, which signals whether or not the bitstream includes channel group and multi-channel transform information for any more stage 1 groups. Only the channel groups with non-identity transforms are specified in the stage 1 portion of the bitstream; channels that are not described in the stage 1 part of the bitstream are assumed to be part of a channel group that uses an identity transform.

If the bistream includes no more channel group and multi-channel transform information for stage 1 groups, the decoder decodes (2250) channel group and multi-channel transform information for all stage 2 groups.

E. Pre-Defined or Custom Multi-Channel Transforms

In some embodiments, the encoder and decoder use pre-defined multi-channel transform matrices to reduce the bitrate used to specify transform matrices. The encoder selects from among multiple available pre-defined matrix types and signals the selected matrix in the bitstream with a small number (e.g., 1, 2) of bits. Some types of matrices require no additional signaling in the bitstream, but other types of matrices require additional specification. The decoder retrieves the information indicating the matrix type and (if necessary) the additional information specifying the matrix.

In some implementations, the encoder and decoder use the following pre-defined matrix types: identity, Hadamard, DCT type II, or arbitrary unitary. Alternatively, the encoder and decoder use different and/or additional pre-defined matrix types.

FIG. 9*a* shows an example of an identity matrix for 6 channels in another context. The encoder efficiently specifies an identity matrix in the bitstream using flag bits, assuming the number of dimensions for the identity matrix are known to both the encoder and decoder from other information (e.g., the number of channels in a group).

A Hadamard matrix has the following form.

$$A_{Hadamard} = \rho \begin{bmatrix} 0.5 & -0.5 \\ 0.5 & 0.5 \end{bmatrix}, \tag{8}$$

where ρ is a normalizing scalar ($\sqrt{2}$). The encoder efficiently specifies a Hadamard matrix for stereo data in the bitstream using flag bits.

A DCT type II matrix has the following form.

$$A_{DCT,II} = \begin{bmatrix} a_{0,0} & a_{0,1} & \cdots & a_{0,N-1} \\ a_{1,0} & a_{1,1} & \cdots & a_{1,N-1} \\ \cdots & \cdots & \cdots & \cdots \\ a_{N-1,0} & a_{N-1,1} & \cdots & a_{N-1,N-1} \end{bmatrix}, \tag{9}$$

where $$a_{n,m} = k_m \cdot \cos\left(\frac{m \cdot (n + 0.5)\pi}{N}\right), \tag{10}$$

and where $$k_m = \begin{cases} \sqrt{\frac{1}{N}} & m = 0 \\ \sqrt{\frac{2}{N}} & m > 0 \end{cases}. \tag{11}$$

For additional information about DCT type II matrices, see Rao et al., *Discrete Cosine Transform*, Academic Press (1990). The DCT type II matrix can have any size (i.e., work for any size channel group). The encoder efficiently specifies a DCT type II matrix in the bitstream using flag bits, assuming the number of dimensions for the DCT type II matrix are known to both the encoder and decoder from other information (e.g., the number of channels in a group).

A square matrix $A_{square}$ is unitary if its transposition is its inverse.

$$A_{square} \cdot A_{square}^{T} = A_{square}^{T} \cdot A_{square} = I \tag{12}$$

where I is the identity matrix. The encoder uses arbitrary unitary matrices to specify KLT transforms for effective redundancy removal. The encoder efficiently specifies an arbitrary unitary matrix in the bitstream using flag bits and a parameterization of the matrix. In some implementations, the encoder parameterizes the matrix using quantized Givens factorizing rotations, as described below. Alternatively, the encoder uses another parameterization.

Figure 23:
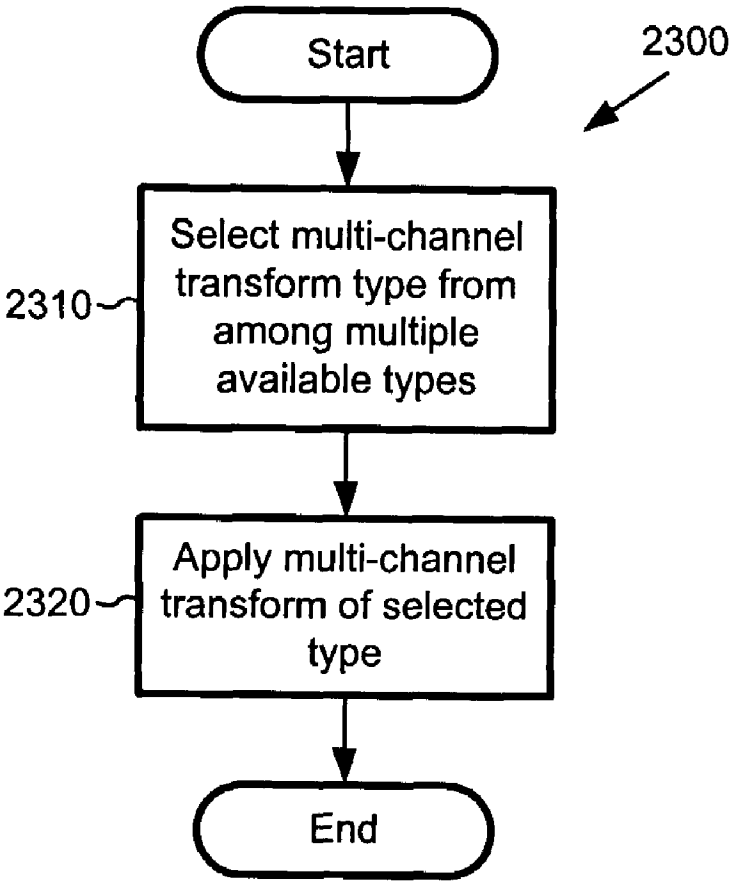
FIG. 23 is a flowchart showing a generalized technique for selecting a multi-channel transform type from among plural available types.

FIG. 23 shows a technique (2300) for selecting a multi-channel transform type from among plural available types. The encoder selects a transform type on a channel group-by-channel group basis or at some other level.

The encoder selects (2310) a multi-channel transform type from among multiple available types. For example, the available types include identity, Hadamard, DCT type II, and arbitrary unitary. Alternatively, the types include different and/or additional matrix types. The encoder uses an identity, Hadamard, or DCT type II matrix (rather than an arbitrary unitary matrix) if possible or if needed in order to reduce the bits needed to specify the transform matrix. For example, the encoder uses an identity, Hadamard, or DCT type II matrix if redundancy removal is comparable or close enough (by some criteria) to redundancy removal with the arbitrary unitary matrix. Or, the encoder uses an identity, Hadamard, or DCT type II matrix if the encoder must reduce bitrate. In a general situation, however, the encoder uses an arbitrary unitary matrix for the best compression efficiency.

The encoder then applies (2320) a multi-channel transform of the selected type to the multi-channel audio data.

Figure 24:
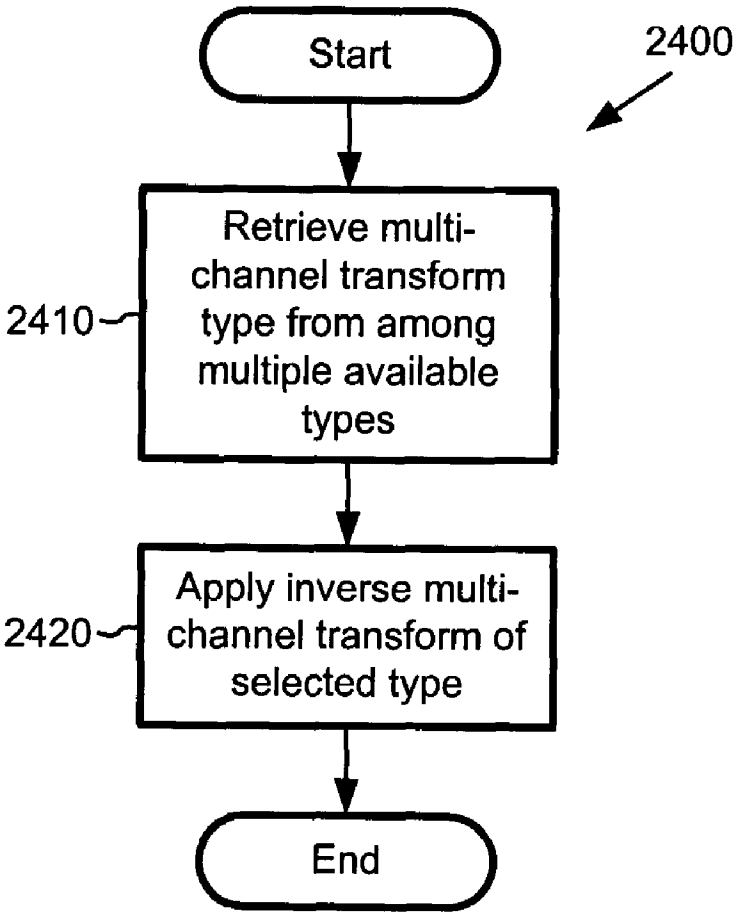
FIG. 24 is a flowchart showing a generalized technique for retrieving a multi-channel transform type from among plural available types and performing an inverse multi-channel transform.

FIG. 24 shows a technique (2400) for retrieving a multi-channel transform type from among plural available types and performing an inverse multi-channel transform. The decoder retrieves transform type information on a channel group-by-channel group basis or at some other level.

The decoder retrieves (2410) a multi-channel transform type from among multiple available types. For example, the available types include identity, Hadamard, DCT type II, and arbitrary unitary. Alternatively, the types include different and/or additional matrix types. If necessary, the decoder retrieves additional information specifying the matrix.

After reconstructing the matrix, the decoder applies (2420) an inverse multi-channel transform of the selected type to the multi-channel audio data.

Figure 25:
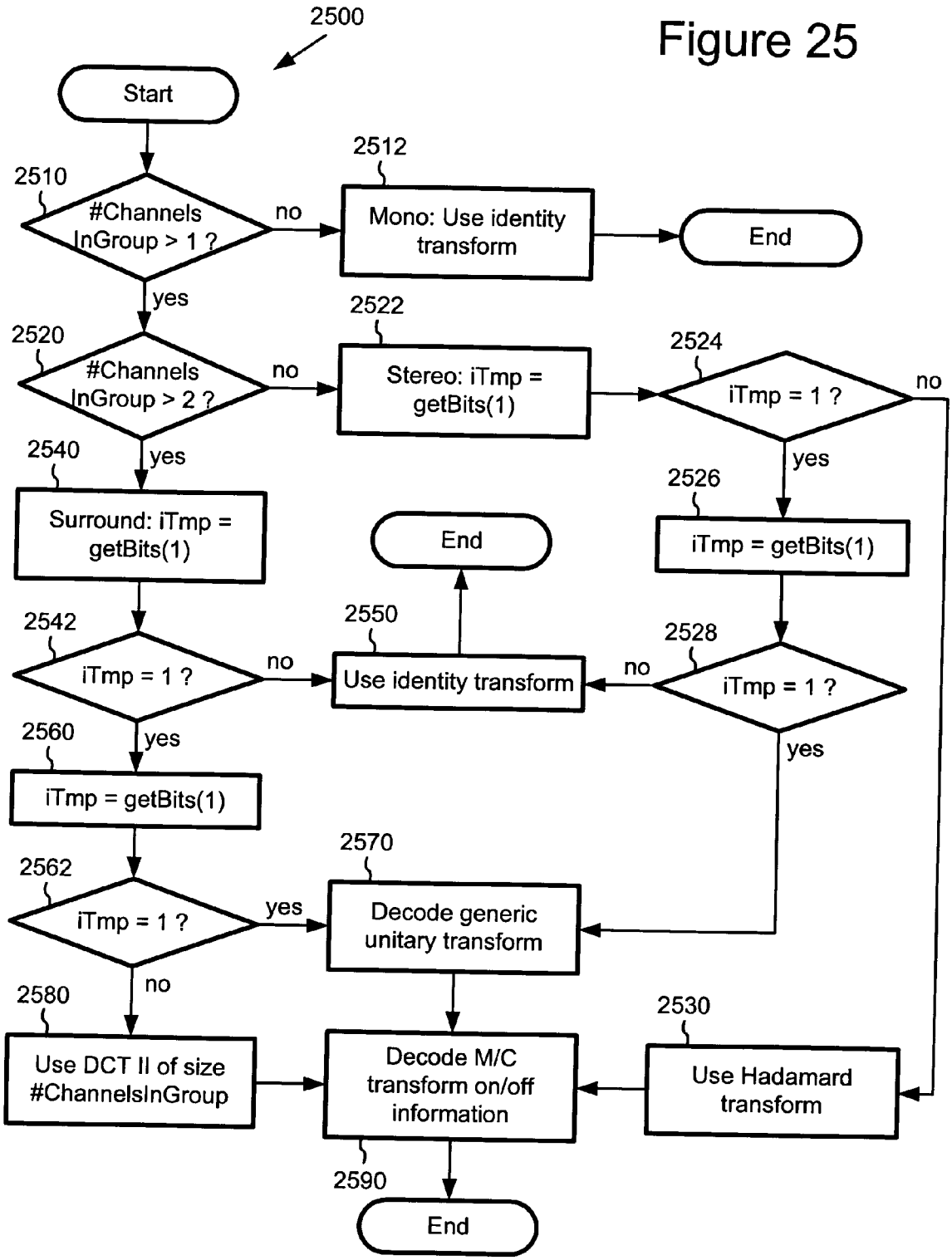
FIG. 25 is a flowchart showing a technique for retrieving multi-channel transform information for a channel group from a bitstream according to a particular bitstream syntax.

FIG. 25 shows a technique (2500) for retrieving multi-channel transform information for a channel group from a bitstream according to a particular bitstream syntax. FIG. 25 shows the technique (2500) performed by the decoder to parse the bitstream; the encoder performs a corresponding technique to format the multi-channel transform information according to the bitstream syntax. Alternatively, the decoder and encoder use another syntax, for example, one that uses different flag bits, different ordering, or different transform types.

Initially, the decoder checks (2510) whether the number of channels in the group #ChannelsInGroup is greater than 1. If not, the channel group is for mono audio, and the decoder uses (2512) an identity transform for the group.

If #ChannelsInGroup is greater than 1, the decoder checks (2520) whether #ChannelsInGroup is greater than 2. If not, the channel group is for stereo audio, and the decoder sets (2522) a temporary value iTmp equal to the next bit in the bitstream. The decoder then checks (2524) the value of the temporary value, which signals whether the decoder should use (2530) a Hadamard transform for the channel group. If not, the decoder sets (2526) iTmp equal to the next bit in the bitstream and checks (2528) the value of iTmp, which signals whether the decoder should use (2550) an identity transform for the channel group. If not, the decoder decodes (2570) a generic unitary transform for the channel group.

If #ChannelsInGroup is greater than 2, the channel group is for surround sound audio, and the decoder sets (2540) a temporary value iTmp equal to the next bit in the bitstream. The decoder checks (2542) the value of the temporary value, which signals whether the decoder should use (2550) an identity transform of size #ChannelsInGroup for the channel group. If not, the decoder sets (2560) iTmp equal to the next bit in the bitstream and checks (2562) the value of iTmp. The bit signals whether the decoder should decode (2570) a generic unitary transform for the channel group or use (2580) a DCT type II transform of size #ChannelsInGroup for the channel group.

When the decoder uses a Hadamard, DCT type II, or generic unitary transform matrix for the channel group, the decoder decodes (2590) multi-channel transform band on/off information for the matrix, then exits.

F. Givens Rotation Representation of Transform Matrices

In some embodiments, the encoder and decoder use quantized Givens rotation-based factorization parameters to specify an arbitrary unitary transform matrix for bit efficiency.

Figures 26, 28:
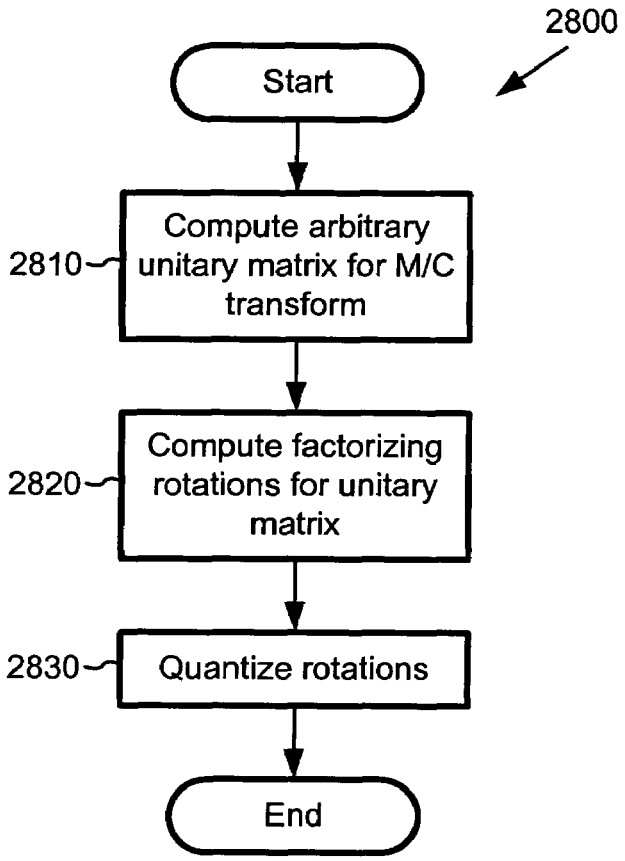
FIG. 26 is a chart showing the general form of a rotation matrix for Givens rotations for representing a multi-channel transform matrix.
FIG. 28 is a flowchart showing a generalized technique for representing a multi-channel transform matrix using quantized Givens factorizing rotations.

In general, a unitary transform matrix can be represented using Givens factorizing rotations. Using this factorization, a unitary transform matrix can be represented as:

$$A_{unitary} = \Theta_{0,N-2} \cdots \Theta_{0,1}\Theta_{0,0}\Theta_{1,N-3} \cdots \Theta_{1,1}\Theta_{1,0} \cdots \Theta_{N-2,0} \begin{bmatrix} \alpha_0 & 0 & \cdots & 0 \\ 0 & \alpha_1 & \cdots & 0 \\ \cdots & \cdots & \cdots & \cdots \\ 0 & 0 & \cdots & \alpha_{N-1} \end{bmatrix} \tag{13}$$

where $\alpha_i$ is +1 or −1 (sign of rotation), and each Θ is of the form of the rotation matrix (2600) shown in FIG. 26. The rotation matrix (2600) is almost like an identity matrix, but has four sine/cosine terms with varying positions. FIGS. 27*a*-27*c* show example rotation matrices for Givens rotations for representing a multi-channel transform matrix The two cosine terms are always on the diagonal, the two sine terms are in same row/column as the cosine terms. Each Θ has one rotation angle, and its value can have a range $$-\frac{\pi}{2} \le \omega_k < \frac{\pi}{2}.$$

The number of such rotation matrices Θ needed to completely describe an NxN unitary matrix $A_{unitary}$ is:

$$\frac{N(N-1)}{2}. \tag{14}$$

For additional information about Givens factorizing rotations, see Vaidyanathan, *Multirate Systems and Filter Banks*, Chapter 14.6, "Factorization of Unitary Matrices," Prentice Hall (1993), hereby incorporated by reference.

In some embodiments, the encoder quantizes the rotation angles for the Givens factorization to reduce bitrate. FIG. 28 shows a technique (2800) for representing a multi-channel transform matrix using quantized Givens factorizing rotations. Alternatively, an encoder or processing tool uses quantized Givens factorizing rotations to represent a unitary matrix for some purpose other than multi-channel transformation of audio channels.

The encoder first computes (2810) an arbitrary unitary matrix for a multi-channel transform. The encoder then computes (2820) the Givens factorizing rotations for the unitary matrix.

To reduce bitrate, the encoder quantizes (2830) the rotation angles. In one implementation, the encoder uniformly quantizes each rotation angle to one of 64 ($2^6$=64) possible values. The rotation signs are indicated with one bit each, so the encoder uses the following number of bits to represent the NxN unitary matrix.

$$6\cdot\frac{N(N-1)}{2}+N=3N^2-2N. \quad (15)$$

This level of quantization allows the encoder to represent the NxN unitary matrix for multi-channel transform with a very good degree of precision. Alternatively, the encoder uses some other level and/or type of quantization.

Figure 29:
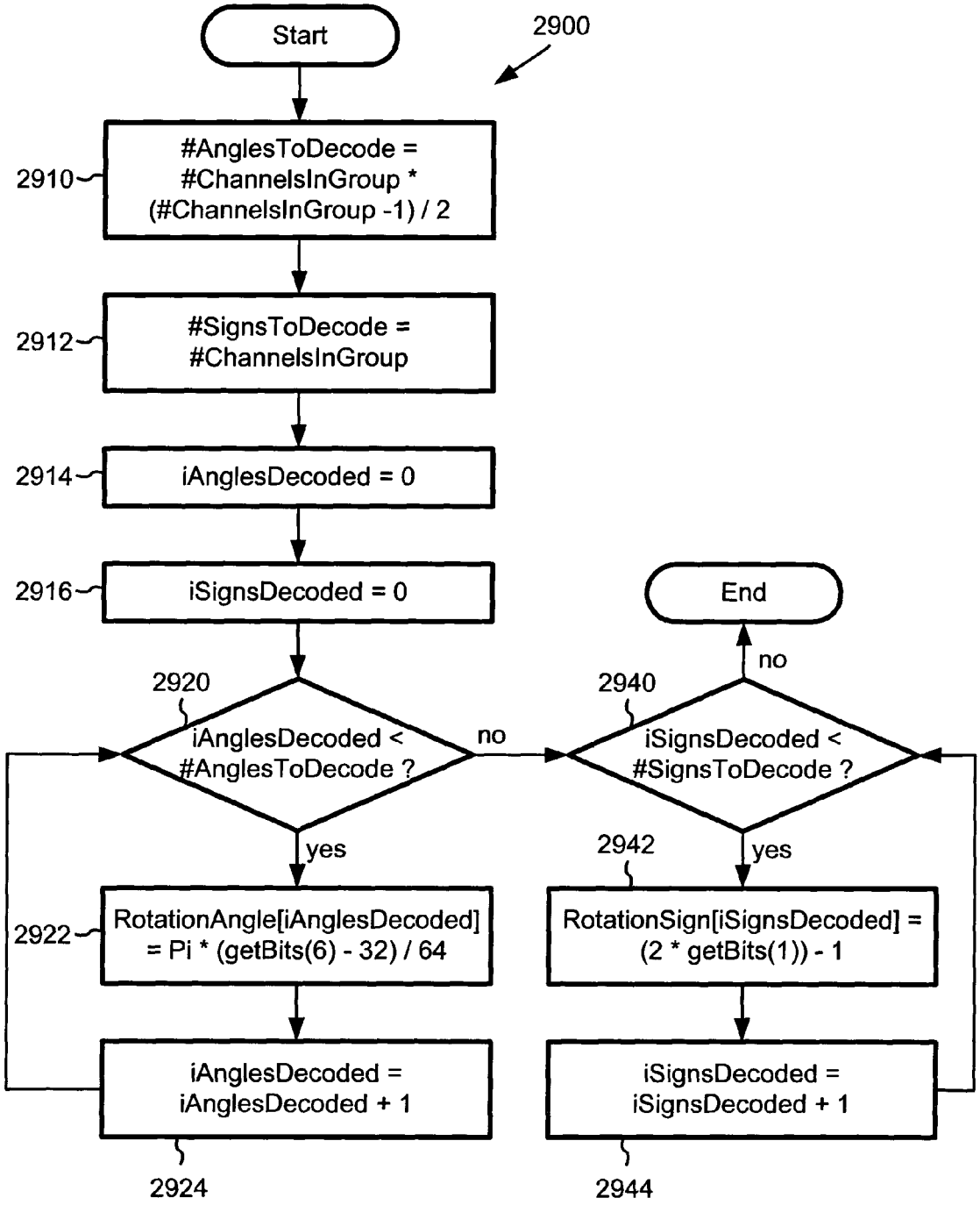
FIG. 29 is a flowchart showing a technique for retrieving information for a generic unitary transform for a channel group from a bitstream according to a particular bitstream syntax.

FIG. 29 shows a technique (2900) for retrieving information for a generic unitary transform for a channel group from a bitstream according to a particular bitstream syntax. FIG. 29 shows the technique (2900) performed by the decoder to parse the bitstream; the encoder performs a corresponding technique to format the information for the generic unitary transform according to the bitstream syntax. Alternatively, the decoder and encoder use another syntax, for example, one that uses different ordering or resolution for rotation angles.

First, the decoder initializes several variables used in the rest of the decoding. Specifically, the decoder sets (2910) the number of angles to decode #AnglesToDecode based upon the number of channels in the channel group #ChannelsInGroup as shown in Equation 14. The decoder also sets (2912) the number of signs to decode #SignsToDecode based upon #ChannelsInGroup. The decoder also resets (2914, 2916) an angles decoded counter iAnglesDecoded and a signs decoded counter iSignsDecoded.

The decoder checks (2920) whether there are any angles to decode and, if so, sets (2922) the value for the next rotation angle, reconstructing the rotation angle from the 6 bit quantized value.

$$\text{RotationAngle[iAnglesDecoded]}=\pi*(\text{getBits}(6)-32)/64 \quad (16).$$

The decoder then increments (2924) the angles decoded counter and checks (2920) whether there are any additional angles to decode.

When there are no more angles to decode, the decoder checks (2940) whether there are any additional signs to decode and, if so, sets (2942) the value for the next sign, reconstructing the sign from the 1 bit value.

$$\text{RotationSign[iSignsDecoded]}=(2*\text{getBits}(1))-1 \quad (17).$$

The decoder then increments (2944) the signs decoded counter and checks (2940) whether there are any additional signs to decode. When there are no more signs to decode, the decoder exits.

VI. Quantization and Weighting

In some embodiments, an encoder such as the encoder (600) of FIG. 6 performs quantization and weighting on audio data using various techniques described below. For multi-channel audio configured into tiles, the encoder computes and applies quantization matrices for channels of tiles, per-channel quantization step modifiers, and overall quantization tile factors. This allows the encoder to shape noise according to an auditory model, balance noise between channels, and control overall distortion.

A corresponding decoder such as the decoder (700) of FIG. 7 performs inverse quantization and inverse weighting. For multi-channel audio configured into tiles, the decoder decodes and applies overall quantization tile factors, per-channel quantization step modifiers, and quantization matrices for channels of tiles. The inverse quantization and inverse weighting are fused into a single step.

A. Overall Tile Quantization Factor

In some embodiments, to control the quality and/or bitrate for the audio data of a tile, a quantizer in an encoder computes a quantization step size $Q_t$ for the tile. The quantizer may work in conjunction with a rate/quality controller to evaluate different quantization step sizes for the tile before selecting a tile quantization step size that satisfies the bitrate and/or quality constraints. For example, the quantizer and controller operate as described in U.S. patent application Ser. No. 10/017,694, entitled "Quality and Rate Control Strategy for Digital Audio," filed Dec. 14, 2001, hereby incorporated by reference.

Figure 30:
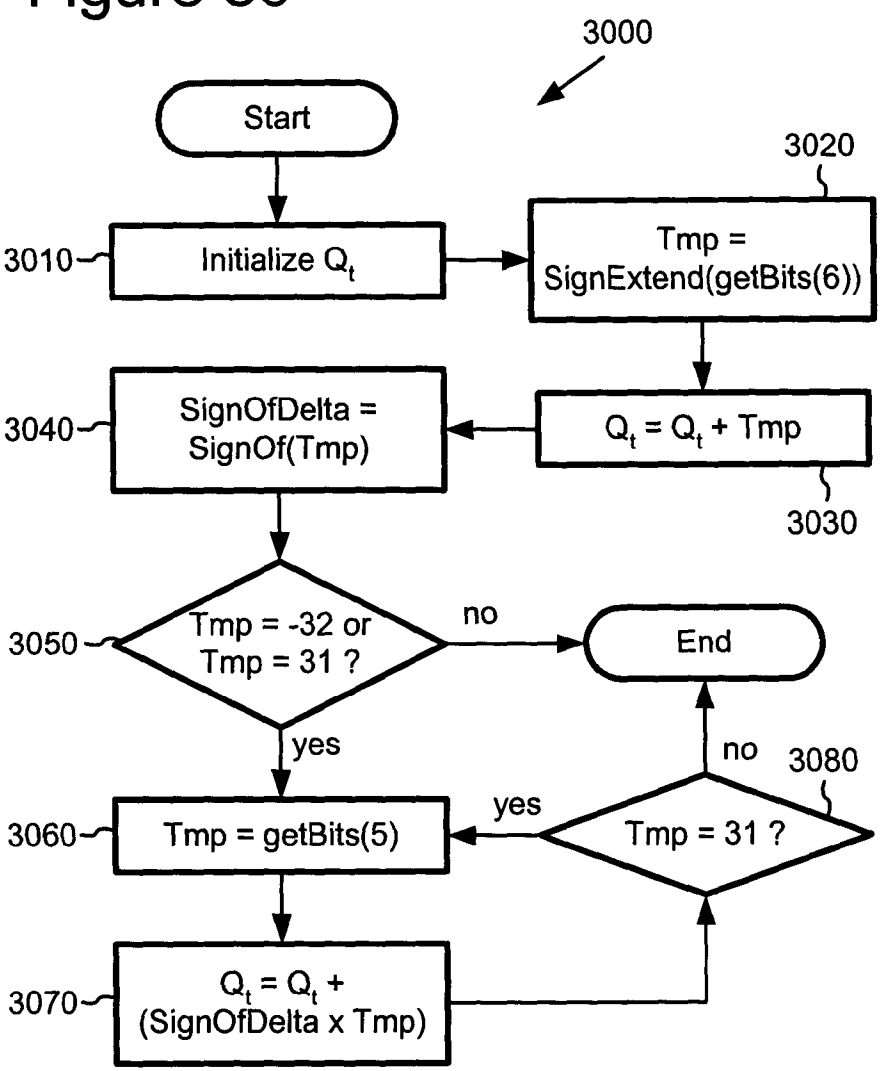
FIG. 30 is a flowchart showing a technique for retrieving an overall tile quantization factor for a tile from a bitstream according to a particular bitstream syntax.

FIG. 30 shows a technique (3000) for retrieving an overall tile quantization factor from a bitstream according to a particular bitstream syntax. FIG. 30 shows the technique (3000) performed by the decoder to parse the bitstream; the encoder performs a corresponding technique to format the tile quantization factor according to the bitstream syntax. Alternatively, the decoder and encoder use another syntax, for example, one that works with different ranges for the tile quantization factor, uses different logic to encode the tile factor, or encodes groups of tile factors.

First, the decoder initializes (3010) the quantization step size $Q_t$ for the tile. In one implementation, the decoder sets $Q_t$ to:

$$Q_t=90\cdot\text{ValidBitsPerSample}/16 \quad (18),$$

where ValidBitsPerSample is a number $16\leqq\text{ValidBitsPerSample}\leqq 24$ that is set for the decoder or the audio clip, or set at some other level.

Next, the decoder gets (3020) six bits indicating the first modification of $Q_t$ relative to the initialized value of $Q_t$, and stores the value $-32\leqq\text{Tmp}\leqq 31$ in the temporary variable Tmp. The function SignExtend( ) determines a signed value from an unsigned value. The decoder adds (3030) the value of Tmp to the initialized value of $Q_t$, then determines (3040) the sign of the variable Tmp, which is stored in the variable SignofDelta.

The decoder checks (3050) whether the value of Tmp equals −32 or 31. If not, the decoder exits. If the value of Tmp equals −32 or 31, the encoder may have signaled that $Q_t$ should be further modified. The direction (positive or negative) of the further modification(s) is indicated by SignofDelta, and the decoder gets (3060) the next five bits to determine the magnitude $0\leqq\text{Tmp}\leqq 31$ of the next modification. The decoder changes (3070) the current value of $Q_t$ in the direction of SignofDelta by the value of Tmp, then checks (3080) whether the value of Tmp is 31. If not, the decoder exits. If the value of Tmp is 31, the decoder gets (3060) the next five bits and continues from that point.

In embodiments that do not use tile configurations, the encoder computes an overall quantization step size for a frame or other portion of audio data.

B. Per-Channel Quantizati n Step M difiers

In some embodiments, an encoder computes a quantization step modifier for each channel in a tile: $Q_{c,0}, Q_{c,1}, \ldots, Q_{c\#ChannelInTile-1}$. The encoder usually computes these channel-specific quantization factors to balance reconstruction quality across all channels. Even in embodiments that do not use tile configurations, the encoder can still compute per-channel quantization factors for the channels in a frame or other unit of audio data. In contrast, previous quantization techniques such as those used in the encoder (100) of FIG.

1 use a quantization matrix element per band of a window in a channel, but have no overall modifier for the channel.

Figure 31:
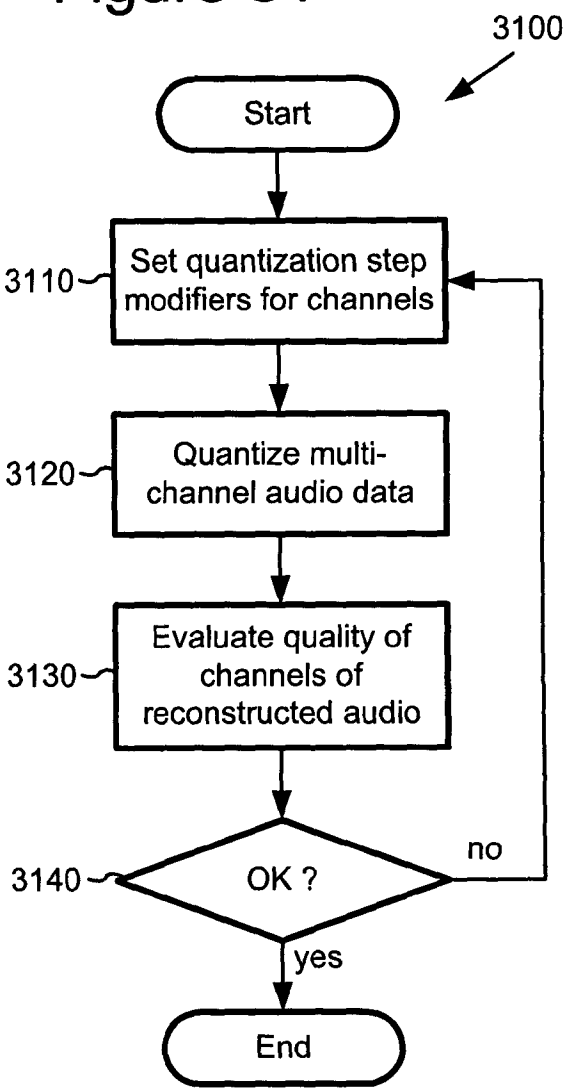
FIG. 31 is a flowchart showing a generalized technique for computing per-channel quantization step modifiers for multi-channel audio data.

FIG. 31 shows a generalized technique (3100) for computing per-channel quantization step modifiers for multi-channel audio data. The encoder uses several criteria to compute the quantization step modifiers. First, the encoder seeks approximately equal quality across all the channels of reconstructed audio data. Second, if speaker positions are known, the encoder favors speakers that are more important to perception in typical uses for the speaker configuration. Third, if speaker types are known, the encoder favors the better speakers in the speaker configuration. Alternatively, the encoder considers criteria other than or in addition to these criteria.

The encoder starts by setting (3110) quantization step modifiers for the channels. In one implementation, the encoder sets (3110) the modifiers based upon the energy in the respective channels. For example, for a channel with relatively more energy (i.e., louder) than the other channels, the quantization step modifiers for the other channels are made relatively higher. Alternatively, the encoder sets (3110) the modifiers based upon other or additional criteria in an "open loop" estimation process. Or, the encoder can set (3110) the modifiers to equal values initially (relying on "closed loop" evaluation of results to converge on the final values for the modifiers).

The encoder quantizes (3120) the multi-channel audio data using the quantization step modifiers as well as other quantization (including weighting) factors, if such other factors have not already been applied.

After subsequent reconstruction, the encoder evaluates (3130) the quality of the channels of reconstructed audio using NER or some other quality measure. The encoder checks (3140) whether the reconstructed audio satisfies the quality criteria (and/or other criteria) and, if so, exits. If not, the encoder sets (3110) new values for the quantization step modifiers, adjusting the modifiers in view of the evaluated results. Alternatively, for one-pass, open loop setting of the step modifiers, the encoder skips the evaluation (3130) and checking (3140).

Per-channel quantization step modifiers tend to change from window/tile to window/tile. The encoder codes the quantization step modifiers as literals or variable length codes, and then packs them into the bitstream with the audio data. Or, the encoder uses some other technique to process the quantization step modifiers.

Figure 32:
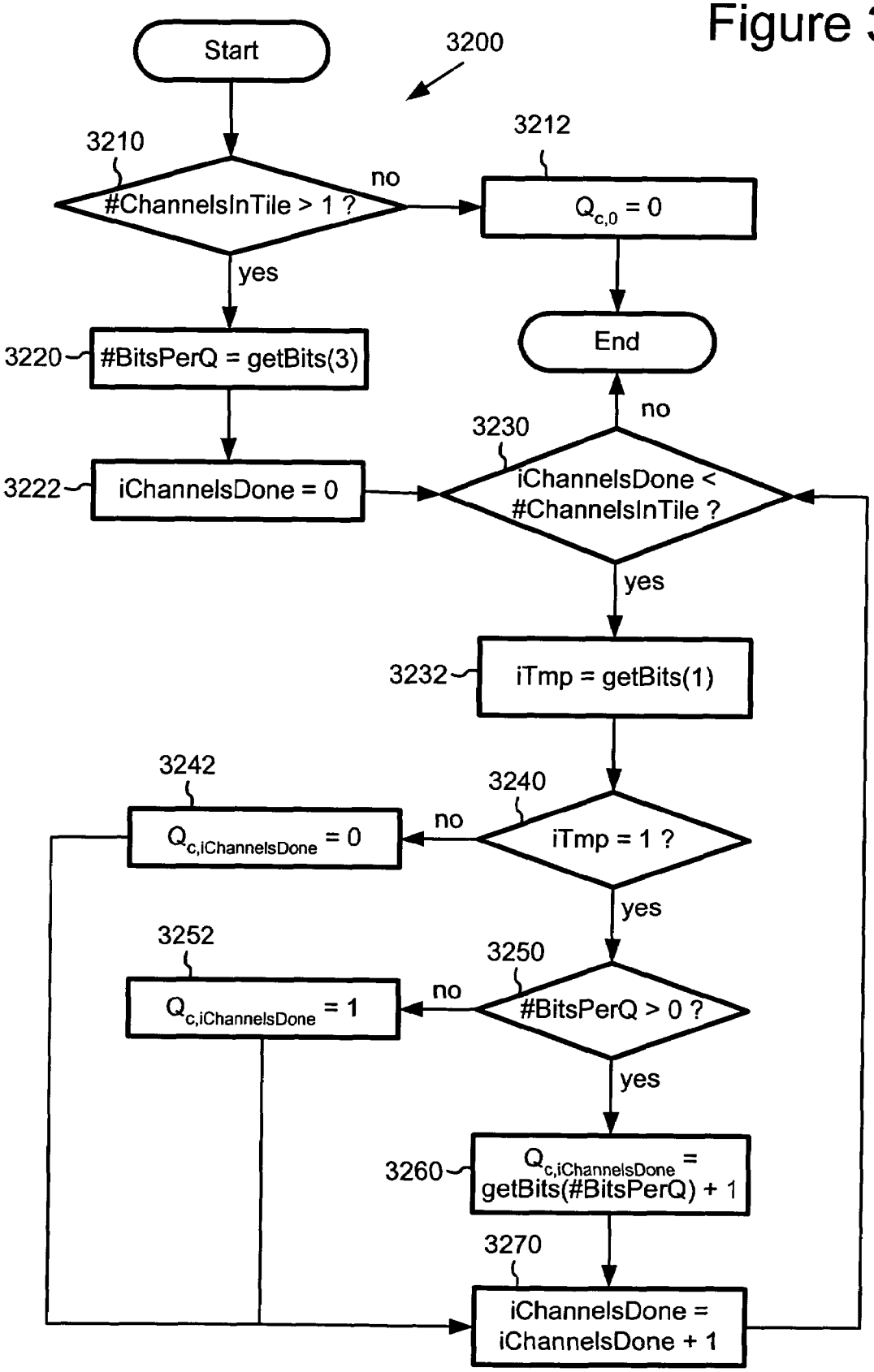
FIG. 32 is a flowchart showing a technique for retrieving per-channel quantization step modifiers from a bitstream according to a particular bitstream syntax.

FIG. 32 shows a technique (3200) for retrieving per-channel quantization step modifiers from a bitstream according to a particular bitstream syntax. FIG. 32 shows the technique (3200) performed by the decoder to parse the bitstream; the encoder performs a corresponding technique (setting flags, packing data for the quantization step modifiers, etc.) to format the quantization step modifiers according to the bitstream syntax. Alternatively, the decoder and encoder use another syntax, for example, one that works with different flags or logic to encode the quantization step modifiers.

FIG. 32 shows retrieval of per-channel quantization step modifiers for a tile. Alternatively, in embodiments that do not use tiles, the decoder retrieves per-channel step modifiers for frames or other units of audio data.

To start, the decoder checks (3210) whether the number of channels in the tile is greater than 1. If not, the audio data is mono. The decoder sets (3212) the quantization step modifier for the mono channel to 0 and exits.

For multi-channel audio, the decoder initializes several variables. The decoder gets (3220) bits indicating the number of bits per quantization step modifier (#BitsPerQ) for the tile. In one implementation, the decoder gets three bits. The decoder then sets (3222) a channel counter iChannelsDone to 0.

The decoder checks (3230) whether the channel counter is less than the number of channels in the tile. If not, all channel quantization step modifiers for the tile have been retrieved, and the decoder exits.

On the other hand, if the channel counter is less than the number of channels in the tile, the decoder gets (3232) a bit and checks (3240) the bit to determine whether the quantization step modifier for the current channel is 0. If so, the decoder sets (3242) the quantization step modifier for the current channel to 0.

If the quantization step modifier for the current channel is not 0, the decoder checks (3250) whether #BitsPerQ is greater than 0 to determine whether the quantization step modifier for the current channel is 1. If so, the decoder sets (3252) the quantization step modifier for the current channel to 1.

If #BitsPerQ is greater than 0, the decoder gets the next #BitsPerQ bits in the bitstream, adds 1 (since value of 0 triggers an earlier exit condition), and sets (3260) the quantization step modifier for the current channel to the result.

After the decoder sets the quantization step modifier for the current channel, the decoder increments (3270) the channel counter and checks (3230) whether the channel counter is less than the number of channels in the tile.

C. Quantization Matrix Encoding and Decoding

In some embodiments, an encoder computes a quantization matrix for each channel in a tile. The encoder improves upon previous quantization techniques such as those used in the encoder (100) of FIG. 1 in several ways. For lossy compression of quantization matrices, the encoder uses a flexible step size for quantization matrix elements, which allows the encoder to change the resolution of the elements of quantization matrices. Apart from this feature, the encoder takes advantage of temporal correlation in quantization matrix values during compression of quantization matrices.

As previously discussed, a quantization matrix serves as a step size array, one step value per bark frequency band (or otherwise partitioned quantization band) for each channel in a tile. The encoder uses quantization matrices to "color" the reconstructed audio signal to have spectral shape comparable to that of the original signal. The encoder usually determines quantization matrices based on psychoacoustics and compresses the quantization matrices to reduce bitrate. The compression of quantization matrices can be lossy.

The techniques described in this section are described with reference to quantization matrices for channels of tiles. For notation, let $Q_{m,iChannel,iBand}$ represent the quantization matrix element for channel iChannel for the band iBand. In embodiments that do not use tile configurations, the encoder can still use a flexible step size for quantization matrix elements and/or take advantage of temporal correlation in quantization matrix values during compression.

1. Flexible Quantization Step Size for Mask Information

Figure 33:
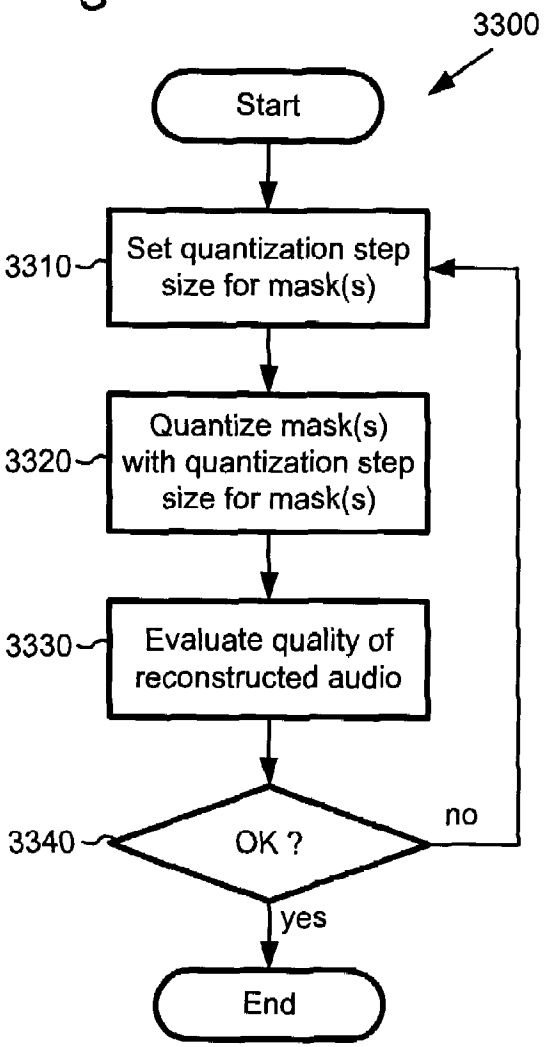
FIG. 33 is a flowchart showing a generalized technique for adaptively setting a quantization step size for quantization matrix elements.

FIG. 33 shows a generalized technique (3300) for adaptively setting a quantization step size for quantization matrix elements. This allows the encoder to quantize mask information coarsely or finely. In one implementation, the encoder sets the quantization step size for quantization matrix elements on a channel-by-channel basis for a tile (i.e., matrix-by-matrix basis when each channel of the tile has a matrix). Alternatively, the encoder sets the quantization step size for mask elements on a tile by-tile or frame-by-frame basis, for an entire audio sequence, or at some other level.

The encoder starts by setting (3310) a quantization step size for one or more mask(s). (The number of affected masks depends on the level at which the encoder assigns the flexible quantization step size.) In one implementation, the encoder evaluates the quality of reconstructed audio over some period of time and, depending on the result, selects the quantization step size to be 1, 2, 3, or 4 dB for mask information. The quality measure evaluated by the encoder is NER for one or more previously encoded frames. For example, if the overall quality is poor, the encoder may set (3310) a higher value for the quantization step size for mask information, since resolution in the quantization matrix is not an efficient use of bitrate. On the other hand, if the overall quality is good, the encoder may set (3310) a lower value for the quantization step size for mask information, since better resolution in the quantization matrix may efficiently improve perceived quality. Alternatively, the encoder uses another quality measure, evaluation over a different period, and/or other criteria in an open loop estimate for the quantization step size. The encoder can also use different or additional quantization step sizes for the mask information. Or, the encoder can skip the open loop estimate, instead relying on closed loop evaluation of results to converge on the final value for the step size.

The encoder quantizes (3320) the one or more quantization matrices using the quantization step size for mask elements, and weights and quantizes the multi-channel audio data.

After subsequent reconstruction, the encoder evaluates (3330) the quality of the reconstructed audio using NER or some other quality measure. The encoder checks (3340) whether the quality of the reconstructed audio justifies the current setting for the quantization step size for mask information. If not, the encoder may set (3310) a higher or lower value for the quantization step size for mask information. Otherwise, the encoder exits. Alternatively, for one-pass, open loop setting of the quantization step size for mask information, the encoder skips the evaluation (3330) and checking (3340).

After selection, the encoder indicates the quantization step size for mask information at the appropriate level in the bitstream.

Figure 34:
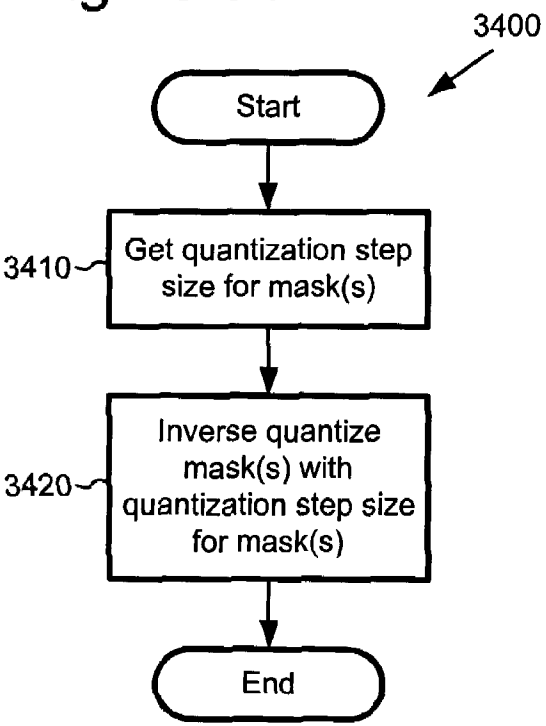
FIG. 34 is a flowchart showing a generalized technique for retrieving an adaptive quantization step size for quantization matrix elements.

FIG. 34 shows a generalized technique (3400) for retrieving an adaptive quantization step size for quantization matrix elements. The decoder can thus change the quantization step size for mask elements on a channel-by-channel basis for a tile, on a tile by-tile or frame-by-frame basis, for an entire audio sequence, or at some other level.

The decoder starts by getting (3410) a quantization step size for one or more mask(s). (The number of affected masks depends on the level at which the encoder assigned the flexible quantization step size.) In one implementation, the quantization step size is 1, 2, 3, or 4 dB for mask information. Alternatively, the encoder and decoder use different or additional quantization step sizes for the mask information.

The decoder then inverse quantizes (3420) the one or more quantization matrices using the quantization step size for mask information, and reconstructs the multi-channel audio data.

2. Temporal Prediction of Quantization Matrices

Figure 35:
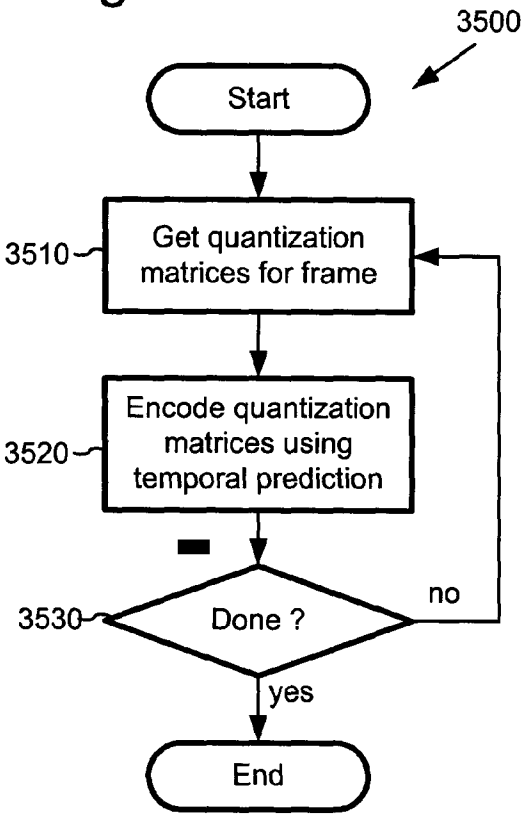

FIG. 35 shows a generalized technique (3500) for compressing quantization matrices using temporal prediction. With the technique (3500), the encoder takes advantage of temporal correlation in mask values. This reduces the bitrate associated with the quantization matrices.

Figure 36:
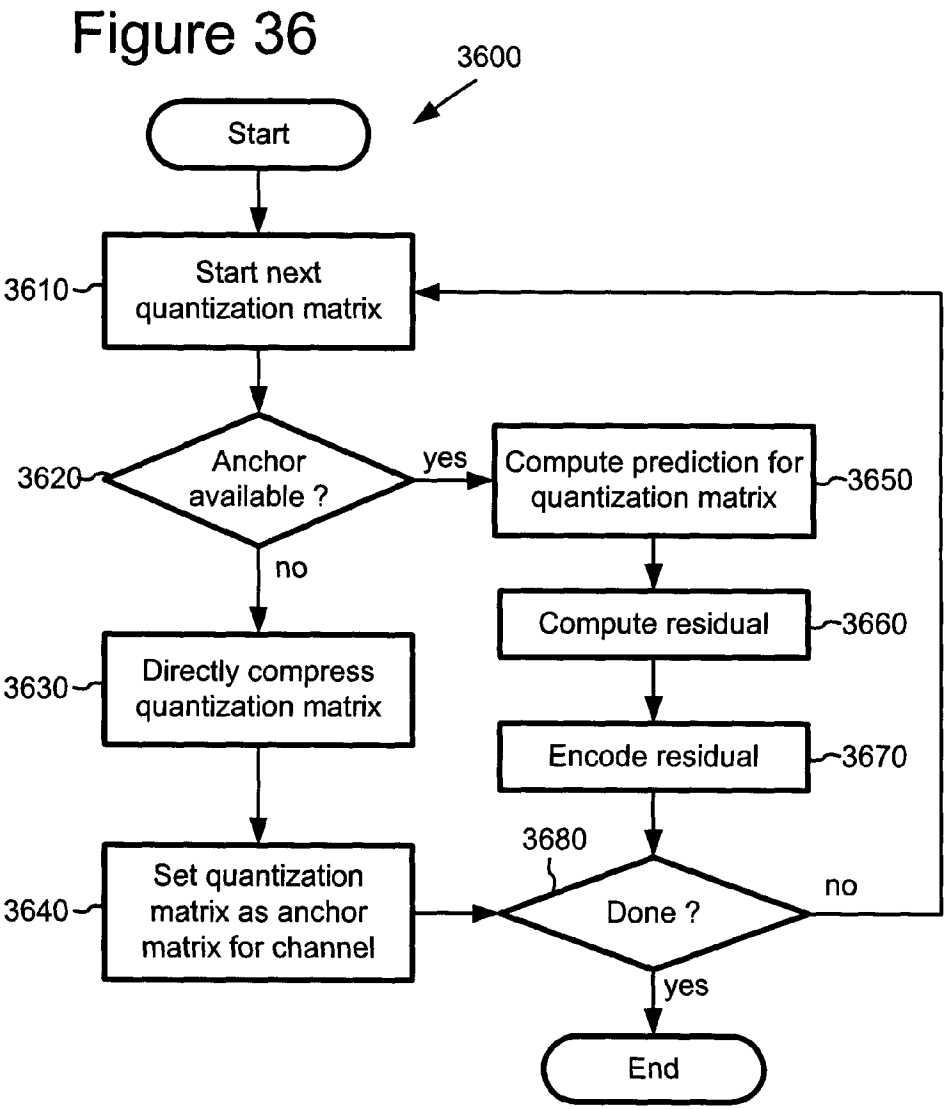
FIGS. 35 and 36 are flowcharts showing techniques for compressing quantization matrices using temporal prediction.

FIGS. 35 and 36 show temporal prediction for quantization matrices in a channel of a frame of audio data. Alternatively, an encoder compresses quantization matrices using temporal prediction between multiple frames, over some other sequence of audio, or for a different configuration of quantization matrices.

With reference to FIG. 35, the encoder gets (3510) quantization matrices for a frame. The quantization matrices in a channel tend to be the same from window to window, making them good candidates for predictive coding.

The encoder then encodes (3520) the quantization matrices using temporal prediction. For example, the encoder uses the technique (3600) shown in FIG. 36. Alternatively, the encoder uses another technique with temporal prediction.

The encoder determines (3530) whether there are any more matrices to compress and, if not, exits. Otherwise, the encoder gets the next quantization matrices. For example, the encoder checks whether matrices of the next frame are available for encoding.

FIG. 36 shows a more detailed technique (3600) for compressing quantization matrices in a channel using temporal prediction in one implementation. The temporal prediction uses a re-sampling process across tiles of differing window sizes and uses run-level coding on prediction residuals to reduce bitrate.

The encoder starts (3610) the compression for next quantization matrix to be compressed and checks (3620) whether an anchor matrix is available, which usually depends on whether the matrix is the first in its channel. If an anchor matrix is not available, the encoder directly compresses (3630) the quantization matrix. For example, the encoder differentially encodes the elements of the quantization matrix (where the difference for an element is relative to the element of the previous band) and assigns Huffman codes to the differentials. For the first element in the matrix (i.e., the mask element for the band 0), the encoder uses a prediction constant that depends on the quantization step size for the mask elements.

$$\text{PredConst}=45/\text{MaskQuantMultiplier}_{iChannel} \quad (19).$$

Alternatively, the encoder uses another compression technique for the anchor matrix.

The encoder then sets (3640) the quantization matrix as the anchor matrix for the channel of the frame. When the encoder uses tiles, the tile including the anchor matrix for a channel can be called the anchor tile. The encoder notes the anchor matrix size or the tile size for the anchor tile, which may be used to form predictions for matrices with a different size.

On the other hand, if an anchor matrix is available, the encoder compresses the quantization matrix using temporal prediction. The encoder computes (3650) a prediction for the quantization matrix based upon the anchor matrix for the channel. If the quantization matrix being compressed has the same number of bands as the anchor matrix, the prediction is the elements of the anchor matrix. If the quantization matrix being compressed has a different number of bands than the anchor matrix, however, the encoder re-samples the anchor matrix to compute the prediction.

The re-sampling process uses the size of the quantization matrix being compressed/current tile size and the size of the anchor matrix/anchor tile size.

$$\text{MaskPrediction[iBand]}=\text{AnchorMask[iScaledBand]} \quad (20),$$

where iScaledBand is the anchor matrix band that includes the representative (e.g., average) frequency of iBand. iBand is in terms of the current quantization matrix/current tile size, whereas iScaledBand is in terms of the anchor matrix/anchor tile size.

Figures 37, 40:
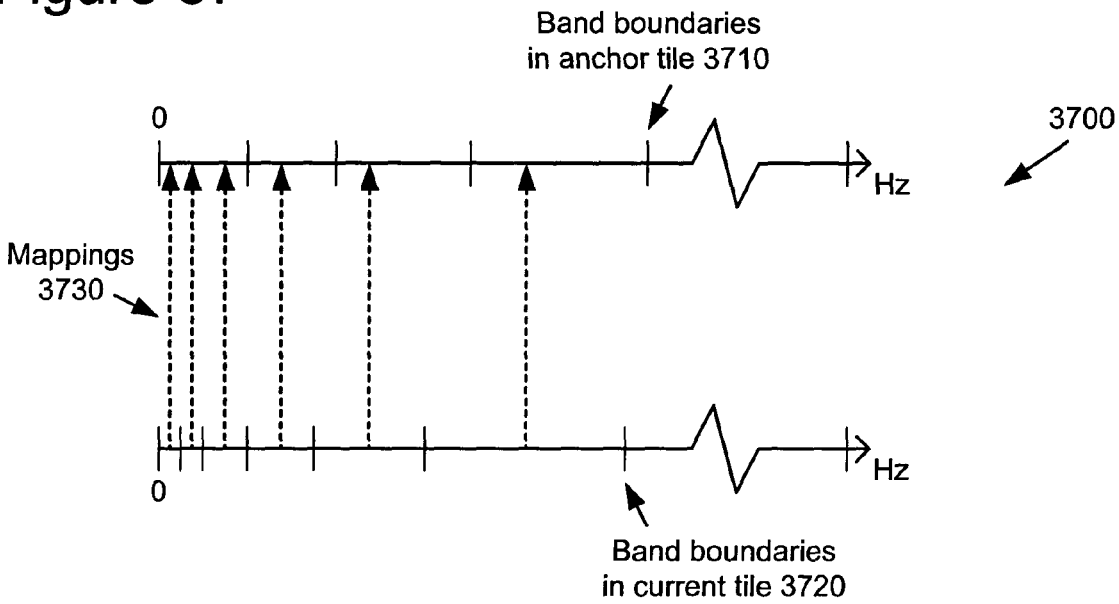
FIG. 37 is a chart showing a mapping of bands for prediction of quantization matrix elements.
FIG. 40 is a chart showing an example matrix for multi-channel post-processing.

FIG. 37 illustrates one technique for re-sampling the anchor matrix when the encoder uses tiles. FIG. 37 shows an example mapping (3700) of bands of a current tile to bands of an anchor tile to form a prediction. Frequencies in the middle of band boundaries (3720) of the quantization matrix in the current tile are mapped (3730) to frequencies of the anchor matrix in the anchor tile. The values for the mask prediction are set depending on where the mapped frequencies are relative to the band boundaries (3710) of the anchor matrix in the anchor tile. Alternatively, the encoder uses temporal prediction relative to the preceding quantization matrix in the channel or some other preceding matrix, or uses another re-sampling technique.

Returning to FIG. 36, the encoder computes (3660) a residual for the quantization matrix relative to the prediction. Ideally, the prediction is perfect and the residual has no energy. If necessary, however, the encoder encodes (3670) the residual. For example, the encoder uses run-level coding or another compression technique for the prediction residual.

The encoder then determines (3680) whether there are any more matrices to be compressed and, if not, exits. Otherwise, the encoder gets (3610) the next quantization matrix and continues.

Figure 38:
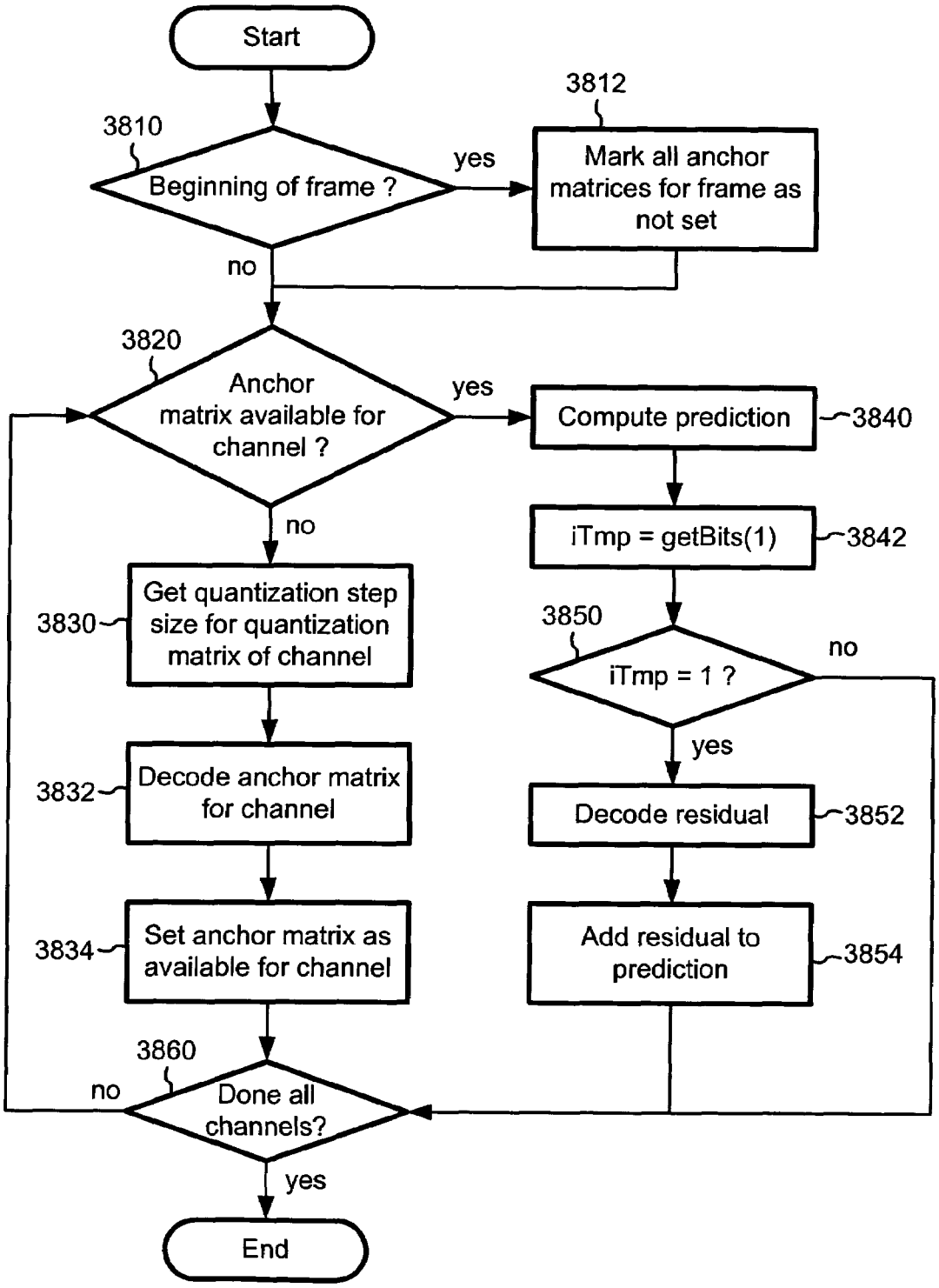
FIG. 38 is a flowchart showing a technique for retrieving and decoding quantization matrices compressed using temporal prediction according to a particular bitstream syntax.

FIG. 38 shows a technique (3800) for retrieving and decoding quantization matrices compressed using temporal prediction according to a particular bitstream syntax. The quantization matrices are for the channels of a single tile of a frame. FIG. 38 shows the technique (3800) performed by the decoder to parse information into the bitstream; the encoder performs a corresponding technique. Alternatively, the decoder and encoder use another syntax for one or more of the options shown in FIG. 38, for example, one that uses different flags or different ordering, or one that does not use tiles.

The decoder checks (3810) whether the encoder has reached the beginning of a frame. If so, the decoder marks (3812) all anchor matrices for the frame as being not set.

The decoder then checks (3820) whether the anchor matrix is available in the channel of the next quantization matrix to be encoded. If no anchor matrix is available, the decoder gets (3830) the quantization step size for the quantization matrix for the channel. In one implementation, the decoder gets the value 1, 2, 3, or 4 dB.

$$\text{MaskQuantMultiplier}_{iChannel}=\text{getBits}(2)+1 \quad (21).$$

The decoder then decodes (3832) the anchor matrix for the channel. For example, the decoder Huffman decodes differentially coded elements of the anchor matrix (where the difference for an element is relative to the element of the previous band) and reconstructs the elements. For the first element, the decoder uses the prediction constant used in the encoder.

$$\text{PredConst}=45/\text{MaskQuantMultiplier}_{iChannel} \quad (22).$$

Alternatively, the decoder uses another decompression technique for the anchor matrix in a channel in the frame.

The decoder then sets (3834) the quantization matrix as the anchor matrix for the channel of the frame and sets the values of the quantization matrix for the channel to those of the anchor matrix.

$$Q_{m,iChannel,iBand}=\text{AnchorMask[iBand]} \quad (23).$$

The decoder also notes the tile size for the anchor tile, which may be used to form predictions for matrices in tiles with a different size than the anchor tile.

On the other hand, if an anchor matrix is available for the channel, the decoder decompresses the quantization matrix using temporal prediction. The decoder computes (3840) a prediction for the quantization matrix based upon the anchor matrix for the channel. If the quantization matrix for the current tile has the same number of bands as the anchor matrix, the prediction is the elements of the anchor matrix. If the quantization matrix for the current tile has a different number of bands as the anchor matrix, however, the encoder re-samples the anchor matrix to get the prediction, for example, using the current tile size and anchor tile size as shown in FIG. 37.

$$\text{MaskPrediction[iBand]}=\text{AnchorMask[iScaledBand]} \quad (24).$$

Alternatively, the decoder uses temporal prediction relative to the preceding quantization matrix in the channel or some other preceding matrix, or uses another re-sampling technique.

The decoder gets (3842) the next bit in the bitstream and checks (3850) whether the bitstream includes a residual for the quantization matrix. If there is no mask update for this channel in the current tile, the mask prediction residual is 0, so:

$$Q_{m,iChannel,iBand}=\text{MaskPrediction[iBand]} \quad (25).$$

On the other hand, if there is a prediction residual, the decoder decodes (3852) the residual, for example, using run-level decoding or some other decompression technique. The decoder then adds (3854) the prediction residual to the prediction to reconstruct the quantization matrix. For example, the addition is a simple scalar addition on a band-by-band basis to get the element for band iBand for the current channel iChannel:

$$Q_{m,iChannel,iBand}=\text{MaskPrediction[iBand]}+\text{MaskPredResidual[iBand]} \quad (26).$$

The decoder then checks (3860) whether quantization matrices for all channels in the current tile have been decoded and, if so, exits. Otherwise, the decoder continues decoding for the next quantization matrix in the current tile.

D. Combined Inverse Quantization and Inverse Weighting

Once the decoder retrieves all the necessary quantization and weighting information, the decoder inverse quantizes and inverse weights the audio data. In one implementation, the decoder performs the inverse quantization and inverse weighting in one step, which is shown in two equations below for the sake of clear printing.

$$\text{Combined}Q=Q_t+Q_{c,iChannel}-(\text{Max}(Q_{m,iChannel,*})-Q_{m,iChannel,iBand})\cdot\text{MaskQuantMultiplier}_{iChannel} \quad (27a),$$

$$y_{iqw}[n]=10^{CombinedQ/20}x_{iqw}[n] \quad (27b).$$

where $x_{iqw}$ is the input (e.g., inverse MC-transformed coefficient) of channel iChannel, and n is a coefficient index in band iBand. $\text{Max}(Q_{m,iChannel,*})$ is the maximum mask value for the channel iChannel over all bands. (The difference between the largest and smallest weighting factors for a mask is typically much less than the range of potential values for mask elements, so the amount of quantization adjustment per weighting factor is computed relative to the maximum.) $\text{MaskQuantMultiplier}_{iChannel}$ is the mask quantization step multiplier for the quantization matrix of channel iChannel, and $y_{iqw}$ is the output of this step.

Alternatively, the decoder performs the inverse quantization and weighting separately or using different techniques.

VII. Multi-Channel Post-Processing

In some embodiments, a decoder such as the decoder (700) of FIG. 7 performs multi-channel post-processing on reconstructed audio samples in the time-domain.

The multi-channel post-processing can be used for many different purposes. For example, the number of decoded channels may be less than the number of channels for output (e.g., because the encoder dropped one or more input channels or multi-channel transformed channels to reduce coding complexity or buffer fullness). If so, a multi-channel post-processing transform can be used to create one or more phantom channels based on actual data in the decoded channels. Or, even if the number of decoded channels equals the number of output channels, the post-processing transform can be used for arbitrary spatial rotation of the presentation, remapping of output channels between speaker positions, or other spatial or special effects. Or, if the number of decoded channels is greater than the number of output channels (e.g., playing surround sound audio on stereo equipment), the post-processing transform can be used to "fold-down" channels. In some embodiments, the fold-down coefficients potentially vary over time—the multi-channel post-processing is bitstream-controlled. The transform matrices for these scenarios and applications can be provided or signaled by the encoder.

Figure 39:
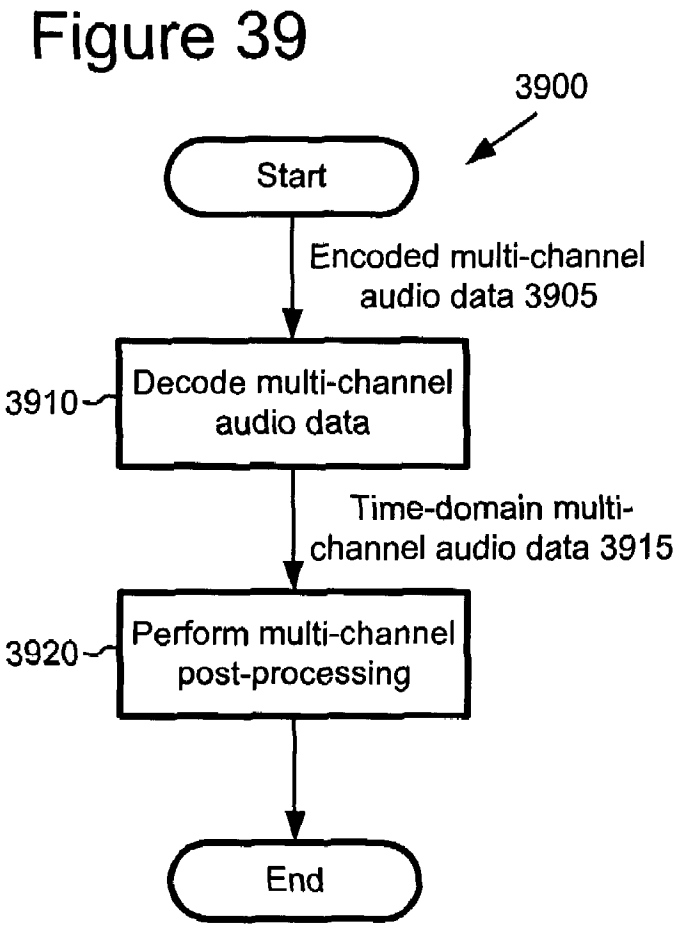
FIG. 39 is a flowchart showing a generalized technique for multi-channel post-processing.

FIG. 39 shows a generalized technique (3900) for multi-channel post-processing. The decoder decodes (3910) encoded multi-channel audio data (3905) using techniques shown in FIG. 7 or other decompression techniques, producing reconstructed time-domain multi-channel audio data (3915).

The decoder then performs (3920) multi-channel post-processing on the time-domain multi-channel audio data (3915). For example, when the encoder produces M decoded channels and the decoder outputs N channels, the post-processing involves a general M to N transform. The decoder takes M co-located (in time) samples, one from each of the reconstructed M coded channels, then pads any channels that are missing (i.e., the N-M channels dropped by the encoder) with zeros. The decoder multiplies the N samples with a matrix $A_{post}$.

$$y_{post}=A_{post}\cdot x_{post} \tag{28}$$

where $x_{post}$ and $y_{post}$ are the N channel input to and the output from the multi-channel post-processing, $A_{post}$ is a general NxN transform matrix, and $x_{post}$ is padded with zeros to match the output vector length N.

The matrix $A_{post}$ can be a matrix with pre-determined elements, or it can be a general matrix with elements specified by the encoder. The encoder signals the decoder to use a pre-determined matrix (e.g., with one or more flag bits) or sends the elements of a general matrix to the decoder, or the decoder may be configured to always use the same matrix $A_{post}$. The matrix $A_{post}$ need not possess special characteristics such as being as symmetric or invertible. For additional flexibility, the multi-channel post-processing can be turned on/off on a frame-by-frame or other basis (in which case, the decoder may use an identity matrix to leave channels unaltered).

FIG. 40 shows an example matrix $A_{P\text{-}center}$ (4000) used to create a phantom center channel from left and right channels in a 5.1 channel playback environment with the channels ordered as shown in FIG. 4. The example matrix $A_{P\text{-}center}$ (4000) passes the other channels through unaltered. The decoder gets samples co-located in time from the left, right, sub-woofer, back left, and back right channels and pads the center channel with 0 s. The decoder then multiplies the six input samples by the matrix $A_{P\text{-}center}$ (4000).

$$\begin{bmatrix} a \\ b \\ \frac{a+b}{2} \\ d \\ e \\ f \end{bmatrix} = A_{P\text{-}Center}\cdot\begin{bmatrix} a \\ b \\ 0 \\ d \\ e \\ f \end{bmatrix}. \tag{29}$$

Alternatively, the decoder uses a matrix with different coefficients or a different number of channels. For example, the decoder uses a matrix to create phantom channels in a 7.1 channel, 9.1 channel, or some other playback environment from coded channels for 5.1 multi-channel audio.

Figure 41:
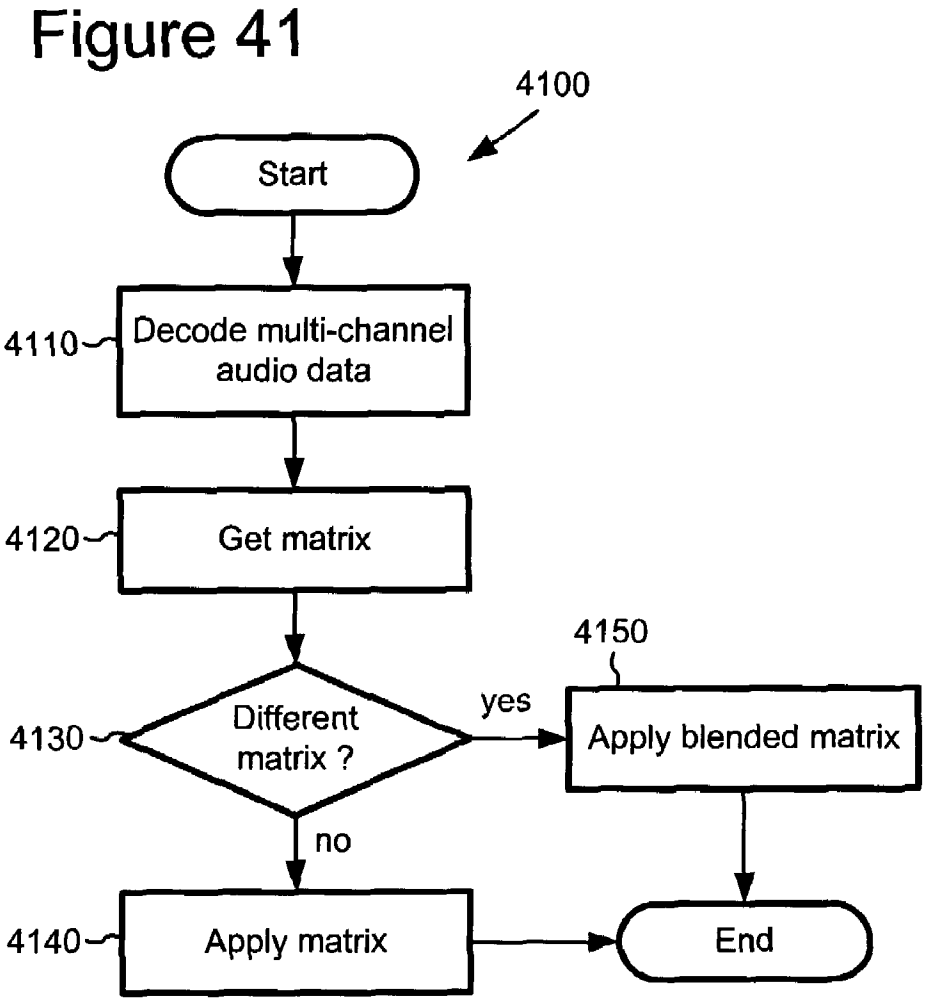
FIG. 41 is a flowchart showing a technique for multi-channel post-processing in which the transform matrix potentially changes on a frame-by-frame basis.

FIG. 41 shows a technique (4100) for multi-channel post-processing in which the transform matrix potentially changes on a frame-by-frame basis. Changing the transform matrix can lead to audible noise (e.g., pops) in the final output if not handled carefully. To avoid introducing the popping noise, the decoder gradually transitions from one transform matrix to another between frames.

Figure 42:
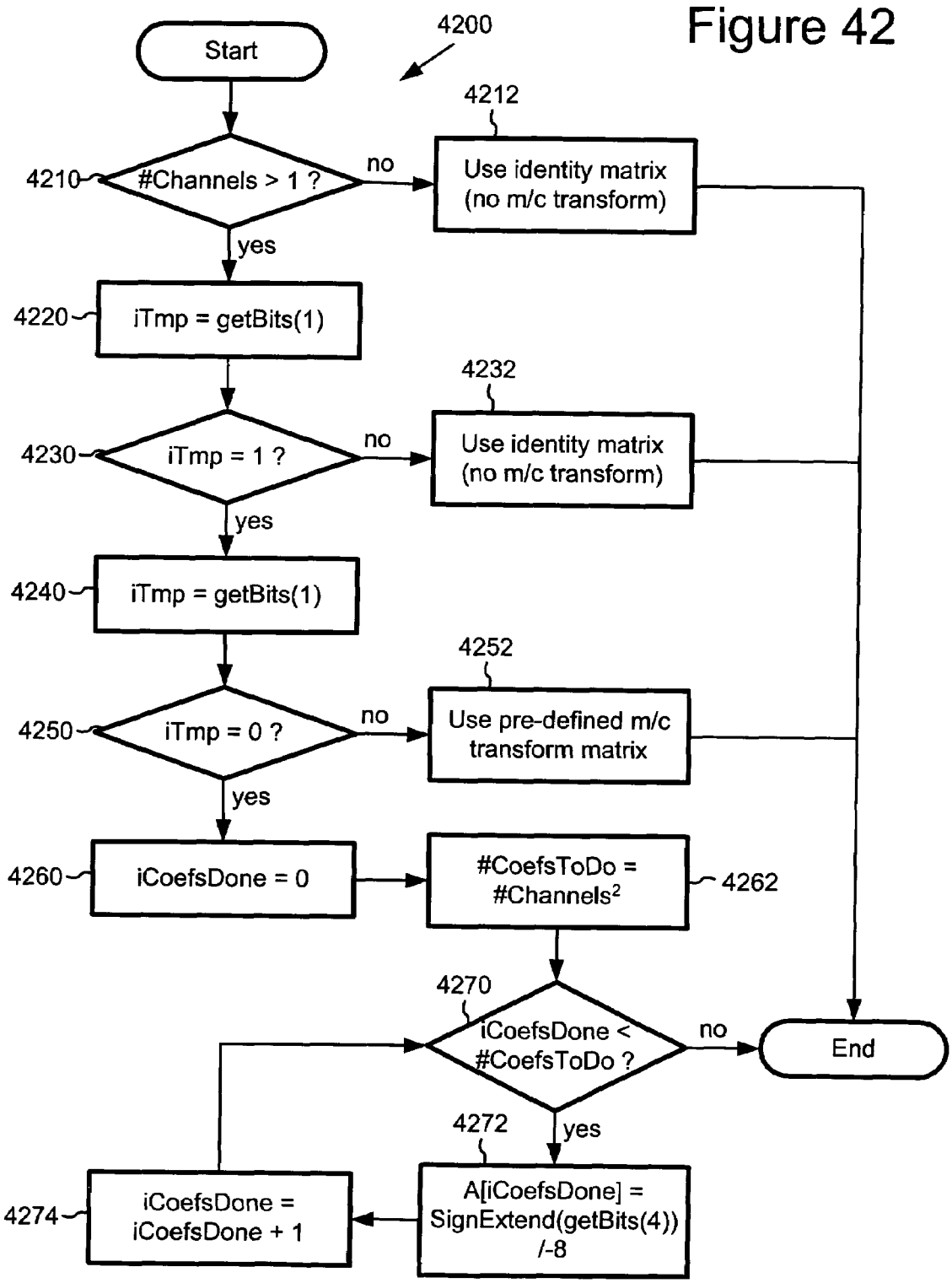
FIG. 42 is a flowchart showing a technique for identifying and retrieving a transform matrix for multi-channel post-processing according to a particular bitstream syntax.

The decoder first decodes (4110) the encoded multi-channel audio data for a frame, using techniques shown in FIG. 7 or other decompression techniques, and producing reconstructed time-domain multi-channel audio data. The decoder then gets (4120) the post-processing matrix for the frame, for example, as shown in FIG. 42.

The decoder determines (4130) if the matrix for the current frame is the different than the matrix for the previous frame (if there was a previous frame). If the current matrix is the same or there is no previous matrix, the decoder applies (4140) the matrix to the reconstructed audio samples for the current frame. Otherwise, the decoder applies (4150) a blended transform matrix to the reconstructed audio samples for the current frame. The blending function depends on implementation. In one implementation, at sample i in the current frame, the decoder uses a short-term blended matrix $A_{post,i}$.

$$A_{post,i} = \frac{NumSamples - i}{NumSamples}A_{post,prev} + \frac{i}{NumSamples}A_{post,current}, \tag{30}$$

where $A_{post,prev}$ and $A_{post,current}$ are the post-processing matrices for the previous and current frames, respectively, and NumSamples is the number of samples in the current frame. Alternatively, the decoder uses another blending function to smooth discontinuities in the post-processing transform matrices.

The decoder repeats the technique (4100) on a frame-by-frame basis. Alternatively, the decoder changes multi-channel post-processing on some other basis.

FIG. 42 shows a technique (4200) for identifying and retrieving a transform matrix for multi-channel post-processing according to a particular bitstream syntax. The syntax allows specification pre-defined transform matrices as well as custom matrices for multi-channel post-processing. FIG. 42 shows the technique (4200) performed by the decoder to parse the bitstream; the encoder performs a corresponding technique (setting flags, packing data for elements, etc.) to format the transform matrix according to the bitstream syntax. Alternatively, the decoder and encoder use another syntax for one or more of the options shown in FIG. 42, for example, one that uses different flags or different ordering.

First, the decoder determines (4210) if the number of channels #Channels is greater than 1. If #Channels is 1, the audio data is mono, and the decoder uses (4212) an identity matrix (i.e., performs no multi-channel post-processing per se).

On the other hand, if #Channels is >1, the decoder sets (4220) a temporary value iTmp equal to the next bit in the bitstream. The decoder then checks (4230) the value of the temporary value, which signals whether or not the decoder should use (4232) an identity matrix.

If the decoder uses something other than an identity matrix for the multi-channel audio, the decoder sets (4240) the temporary value iTmp equal to the next bit in the bitstream. The decoder then checks (4250) the value of the temporary value, which signals whether or not the decoder should use (4252) a pre-defined multi-channel transform matrix. If the decoder uses (4252) a pre-defined matrix, the decoder may get one or more additional bits from the bitstream (not shown) that indicate which of several available pre-defined matrices the decoder should use.

If the decoder does not use a pre-defined matrix, the decoder initializes various temporary values for decoding a custom matrix. The decoder sets (4260) a counter iCoefsDone for coefficients done to 0 and sets (4262) the number of coefficients #CoefsToDo to decode to equal the number of elements in the matrix (#Channels$^2$). For matrices known to have particular properties (e.g., symmetric), the number of coefficients to decode can be decreased. The decoder then determines (4270) whether all coefficients have been retrieved from the bitstream and, if so, ends. Otherwise, the decoder gets (4272) the value of the next element A[iCoefsDone] in the matrix and increments (4274) iCoefsDone. The way elements are coded and packed into the bitstream is implementation dependent. In FIG. 42, the syntax allows four bits of precision per element of the transform matrix, and the absolute value of each element is less than or equal to 1. In other implementations, the precision per element is different, the encoder and decoder use compression to exploit patterns of redundancy in the transform matrix, and/or the syntax differs in some other way.

Having described and illustrated the principles of our invention with reference to described embodiments, it will be recognized that the described embodiments can be modified in arrangement and detail without departing from such principles. It should be understood that the programs, processes, or methods described herein are not related or limited to any particular type of computing environment, unless indicated otherwise. Various types of general purpose or specialized computing environments may be used with or perform operations in accordance with the teachings described herein. Elements of the described embodiments shown in software may be implemented in hardware and vice versa.

In view of the many possible embodiments to which the principles of our invention may be applied, we claim as our invention all such embodiments as may come within the scope and spirit of the following claims and equivalents thereto.

We claim:

1. In an audio encoder, a computer-implemented method comprising:

receiving audio data in plural channels;

partitioning each channel of the plural channels into variable-size windows, wherein window configuration of each channel of the plural channels is independent of other channels of the plural channels;

grouping the windows into plural tiles, wherein for each of the plural tiles the grouped windows in the tile have identical start positions and identical stop positions; and quantizing the audio data, including for a tile of the plural tiles applying a channel-specific quantization factor for each channel of the plural channels for the grouped windows in the tile.

2. The method of claim 1 wherein the plural channels consist of two channels.

3. The method of claim 1 wherein the plural channels consist of more than two channels.

4. The method of claim 1 wherein the channel-specific quantization factors are channel-specific quantization step modifiers.

5. The method of claim 4 wherein the applying the modifiers balances perceptual reconstruction quality across the plural channels.

6. The method of claim 1 further comprising, in the encoder, computing the quantization factors based at least in part upon one or more criteria.

7. The method of claim 6 wherein the criteria include equality in perceptual reconstruction quality across the plural channels.

8. The method of claim 6 wherein the criteria include favoring one or more of the plural channels that are more important than other channels perceptually.

9. The method of claim 6 wherein the computing is based at least in part upon respective energies in the plural channels.

10. The method of claim 1 further comprising, in the encoder, computing the quantization factors by open loop estimation.

11. The method of claim 1 further comprising, in the encoder, computing the quantization factors by closed loop evaluation.

12. In an audio decoder, a computer-implemented method comprising:

receiving encoded audio data in plural channels;

retrieving information for plural channel-specific quantizer step modifiers for one or more tiles, each of the one or more tiles grouping plural windows that:

are in different channels of the plural channels, and have identical start positions and identical stop positions; and decoding the audio data, including for a tile of the one or more tiles applying one of the channel-specific quantizer step modifiers for each channel of the plural channels for the grouped windows in the tile in inverse quantization.

13. The method of claim 12 wherein the plural channels consist of two channels.

14. The method of claim 12 wherein the plural channels consist of more than two channels.

15. The method of claim 12 wherein the retrieving includes getting plural bits indicating precision of the plural channel-specific quantizer step modifiers.

16. The method of claim 12 wherein the retrieving includes getting a single bit per modifier to indicate whether that modifier has a value of zero.

17. The method of claim 12 wherein the applying is part of a combined step for quantization, and wherein for each of plural coefficients of the audio data the combined step includes a single multiplication by a total quantization amount.

18. A computer-readable medium storing computer-executable instructions for causing a computer programmed thereby to perform a method in an audio encoder, the method comprising:

receiving audio data in plural channels;

partitioning each channel of the plural channels into variable-size windows, wherein window configuration of each channel of the plural channels is independent of other channels of the plural channels;

grouping the windows into plural tiles, wherein for each of the plural tiles the grouped windows in the tile have identical start positions and identical stop positions; and quantizing the audio data, including for a tile of the plural tiles applying a channel-specific quantization factor for each channel of the plural channels for the grouped windows in the tile.

19. A computer-readable medium storing computer-executable instructions for causing a computer programmed thereby to perform a method in an audio decoder, the method comprising:

receiving encoded audio data in plural channels;

retrieving information for plural channel-specific quantizer step modifiers for one or more tiles, each of the one or more tiles grouping plural windows that:

are in different channels of the plural channels, and have identical start positions and identical stop positions; and decoding the audio data, including for a tile of the one or more tiles applying one of the channel-specific quantizer step modifiers for each channel of the plural channels for the grouped windows in the tile in inverse quantization.

20. An audio encoder, comprising:

means for receiving audio data in plural channels;

means for partitioning each channel of the plural channels into variable-size windows, wherein window configuration of each channel of the plural channels is independent of other channels of the plural channels;

means for grouping the windows into plural tiles, wherein for each of the plural tiles the grouped windows in the tile have identical start positions and identical stop positions; and means for quantizing the audio data, including for a tile of the plural tiles applying a channel-specific quantization factor for each channel of the plural channels for the grouped windows in the tile.

21. An audio decoder, comprising:

means for receiving encoded audio data in plural channels;

means for retrieving information for plural channel-specific quantizer step modifiers for one or more tiles, each of the one or more tiles grouping plural windows that:

are in different channels of the plural channels, and have identical staff positions and identical stop positions; and means for decoding the audio data, including for a tile of the one or more tiles applying one of the channel-specific quantizer step modifiers for each channel of the plural channels for the grouped windows in the tile in inverse quantization.

* * * * *